US009095862B2

(12) United States Patent
Hanna et al.

(10) Patent No.: US 9,095,862 B2
(45) Date of Patent: Aug. 4, 2015

(54) SHOWER AND SPEAKER ASSEMBLY

(71) Applicant: Kohler Co., Kohler, WI (US)

(72) Inventors: Kenneth Scott Hanna, Bellingham, WA (US); Michael James Soetaert, Sheboygan, WI (US); Keith Scott Ruh, Elkhart Lake, WI (US); William Clement Kuru, Plymouth, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 14/200,540

(22) Filed: Mar. 7, 2014

(65) Prior Publication Data

US 2014/0183279 A1 Jul. 3, 2014

Related U.S. Application Data

(63) Continuation of application No. 13/605,587, filed on Sep. 6, 2012.

(60) Provisional application No. 61/573,448, filed on Sep. 6, 2011, provisional application No. 61/631,912, filed on Jan. 13, 2012, provisional application No. 61/637,009, filed on Apr. 23, 2012.

(51) Int. Cl.
*B67D 7/08* (2010.01)
*B05B 1/18* (2006.01)
(Continued)

(52) U.S. Cl.
CPC . *B05B 1/185* (2013.01); *B05B 1/18* (2013.01); *E03C 1/055* (2013.01); *F21V 33/004* (2013.01); *H04R 1/026* (2013.01); *H04R 2201/021* (2013.01)

(58) Field of Classification Search
CPC ..... B05B 7/1218; B05B 7/0081; B05B 1/18; B05B 1/185; A47K 3/281; H05K 11/00
USPC ..... 239/72, 289; 4/615, 567, 559, 661
See application file for complete search history.

(56) References Cited

U.S. PATENT DOCUMENTS 1,947,407 A 2/1934 Cornell, Jr.
2,281,499 A 4/1942 Herzbrun et al.
(Continued)

FOREIGN PATENT DOCUMENTS

CN 3618397 3/2007
CN 3637897 4/2007
(Continued)

OTHER PUBLICATIONS

Smartak Audio Wireless Waterproof Shower Speaker with Dock Transmitter known at least as early as Jul. 12, 2011.
(Continued)

*Primary Examiner* — Len Tran
*Assistant Examiner* — Joel Zhou
(74) *Attorney, Agent, or Firm* — Michael Best & Friedrich LLP

(57) ABSTRACT

A shower assembly and system. The assembly may include a shower device including a device housing defining an inlet communicating with an inlet chamber, an outlet and a waterway communicating between the inlet chamber and the outlet, the device housing further defining a receptacle having a closed end and an open end, the inlet chamber being behind the closed end, the waterway extending along the receptacle from the closed end toward the open end; and a second device supportable in the receptacle. The outlet may define an outlet plane, and the second device may include a speaker with a speaker housing providing a speaker outlet, the speaker outlet being one of aligned with and positioned forwardly of the outlet plane when the speaker is supported in the receptacle. The assembly may further include a magnetic connecting structure operable to releasably connect the speaker and the shower device.

25 Claims, 63 Drawing Sheets

(51) Int. Cl.

| | |
|---|---|
| ***E03C 1/05*** | (2006.01) |
| ***F21V 33/00*** | (2006.01) |
| ***H04R 1/02*** | (2006.01) |

(56) References Cited

U.S. PATENT DOCUMENTS

| | | | | |
|---|---|---|---|---|
| 4,121,741 | A | 10/1978 | Adamson | |
| 4,468,321 | A | 8/1984 | St. John | |
| 4,964,181 | A | 10/1990 | Alpert | |
| D326,854 | S | 6/1992 | Terk et al. | |
| 5,140,254 | A | 8/1992 | Katzman | |
| D329,233 | S | 9/1992 | Miura | |
| 5,329,650 | A | 7/1994 | Zaccai et al. | |
| 5,647,007 | A | 7/1997 | Wooderson et al. | |
| 5,664,015 | A | 9/1997 | Ford et al. | |
| 5,868,439 | A | 2/1999 | Schmidt | |
| 6,061,457 | A | 5/2000 | Stockhamer | |
| 6,182,910 | B1 | 2/2001 | Huen | |
| 6,823,536 | B2 * | 11/2004 | Yip | 4/615 |
| D500,839 | S | 1/2005 | Blomstrom | |
| 6,879,818 | B2 | 4/2005 | Wageneck | |
| 6,892,952 | B2 | 5/2005 | Chang et al. | |
| D507,820 | S | 7/2005 | Blomstrom | |
| D511,810 | S | 11/2005 | Hanna | |
| D524,412 | S | 7/2006 | Blomstrom | |
| D526,308 | S | 8/2006 | Kasden | |
| D530,308 | S | 10/2006 | Topping | |
| 7,269,862 | B2 | 9/2007 | Rooke et al. | |
| D559,357 | S | 1/2008 | Wang | |
| D560,273 | S | 1/2008 | Hanna | |
| 7,412,206 | B1 | 8/2008 | Hutchings et al. | |
| 7,611,073 | B2 | 11/2009 | Crutcher | |
| D619,218 | S | 7/2010 | Lee | |
| 7,753,079 | B2 | 7/2010 | Nelson | |
| 7,761,937 | B2 | 7/2010 | Foutz et al. | |
| D633,078 | S | 2/2011 | Lewis | |
| 7,909,061 | B2 | 3/2011 | Nelson | |
| D678,468 | S | 3/2013 | Hanna | |
| 8,702,018 | B1 | 4/2014 | Rivera | |
| 2003/0211838 | A1 * | 11/2003 | Wageneck | 455/344 |
| 2004/0078891 | A1 * | 4/2004 | Yip | 4/615 |
| 2004/0255377 | A1 * | 12/2004 | Mueller et al. | 4/615 |
| 2006/0283511 | A1 | 12/2006 | Nelson | |
| 2007/0022528 | A1 * | 2/2007 | Gilbert | 4/615 |
| 2009/0007330 | A1 | 1/2009 | Genord et al. | |
| 2009/0031492 | A1 * | 2/2009 | Foutz et al. | 4/597 |
| 2009/0323761 | A1 | 12/2009 | Tsai | |
| 2010/0043135 | A1 | 2/2010 | Patterson et al. | |
| 2010/0170588 | A1 | 7/2010 | Nelson | |
| 2010/0213278 | A1 * | 8/2010 | Zan | 239/289 |
| 2010/0237166 | A1 * | 9/2010 | Nelson | 239/11 |
| 2011/0031331 | A1 * | 2/2011 | Klicpera | 239/71 |
| 2011/0067815 | A1 | 3/2011 | Iizuka et al. | |
| 2011/0162743 | A1 | 7/2011 | Nelson | |
| 2011/0210188 | A1 | 9/2011 | Yao et al. | |
| 2012/0042973 | A1 | 2/2012 | Ko | |
| 2013/0062437 | A1 | 3/2013 | Hanna et al. | |

FOREIGN PATENT DOCUMENTS

| | | | | |
|---|---|---|---|---|
| CN | 300718588 | | 12/2007 | |
| CN | 300755086 | | 3/2008 | |
| CN | 300822364 | | 8/2008 | |
| CN | 300991690 | | 8/2009 | |
| CN | 300997525 | | 9/2009 | |
| CN | 301006088 | | 9/2009 | |
| CN | 301063028 | | 11/2009 | |
| CN | 301067033 | | 11/2009 | |
| CN | 301130555 | | 2/2010 | |
| CN | 301238499 | | 5/2010 | |
| CN | 301264979 | | 6/2010 | |
| CN | 301410164 | | 12/2010 | |
| CN | 301605047 | | 7/2011 | |
| CN | 301626438 | | 7/2011 | |
| CN | 301914213 | | 5/2012 | |
| CN | 203635370 | | 11/2012 | |
| CN | 202516713 | | 6/2014 | |
| EP | 2218512 | | 8/2010 | |
| EP | 2218512 | A1 * | 8/2010 | B05B 1/18 |
| JP | 200818922 | | 5/2009 | |
| KR | 30-2008-0026963 | | 2/2009 | |
| WO | 2007051367 | | 5/2007 | |
| WO | DM/070414 | | 8/2008 | |
| WO | DM/070423 | | 1/2009 | |

OTHER PUBLICATIONS

Sangean Digital Shower Radio known at least as early as Jul. 12, 2011.

Sony AM/FM/Weather Shower CD Clock Radio known at least as early as Jul. 12, 2011.

Notice of Allowance from the United States Patent and Trademark Office for U.S. Appl. No. 29/418,868 dated Oct. 23, 2012 (5 pages).

International Search Report and Written Opinion for Application No. PCT/US2012/053953 dated Jan. 25, 2013 (10 pages).

Notification of First Office Action from the State Intellectual Property Office of the People's Republic of China for Application No. 201430121787.8 dated Jul. 1, 2014 (3 pages).

Evaluation Report of Design Patent from the State Intellectual Property Office of the People's Republic of China for Application No. ZL201330110255.X dated Jan. 2, 2014 (22 pages).

Evaluation Report of Design Patent from the State Intellectual Property Office of the People's Republic of China for Application No. ZL201330110628.3 dated Jan. 2, 2014 (20 pages).

Evaluation Report of Design Patent from the State Intellectual Property Office of the People's Republic of China for Application No. ZL201230426055.0 dated Dec. 27, 2013 (24 pages).

Search Report and Written Opinion from the Intellectual Property Office of the United Kingdom for Application No. 14152136 dated Mar. 2, 2015 (3 pages).

Extended European Search Report for Application No. 12830807.9 dated May 4, 2015 (5 pages).

* cited by examiner

SHOWER AND SPEAKER ASSEMBLY

RELATED APPLICATIONS

The present application is a continuation of U.S. patent application Ser. No. 13/605,587, filed on Sep. 6, 2012, entitled SHOWER AND SPEAKER ASSEMBLY, which claims priority to U.S. Patent Application Ser. No. 61/573,448, filed Sep. 6, 2011, entitled SHOWER AND SPEAKER ASSEMBLY, and to U.S. Patent Application Ser. No. 61/631,912, filed Jan. 13, 2012, entitled SHOWER AND SPEAKER ASSEMBLY, and to U.S. Patent Application Ser. No. 61/637,009, filed Apr. 23, 2012, entitled SHOWER AND SPEAKER ASSEMBLY, the entire contents of all of which are hereby incorporated by reference.

FIELD

The present invention generally relates to shower devices and, more particularly, to a shower and speaker assembly.

SUMMARY

In one independent aspect, a shower assembly may generally include a shower device including a device housing defining an inlet communicating with an inlet chamber, an outlet and a waterway communicating between the inlet chamber and the outlet, the device housing further defining a receptacle having a closed end and an open end, the inlet chamber being behind the closed end, the waterway extending along the receptacle from the closed end toward the open end; and a second device supportable in the receptacle.

In another independent aspect, a shower and speaker assembly may generally include a shower device including a device housing defining an inlet, an outlet and a waterway communicating between the inlet and the outlet, the outlet defining an outlet plane, the device housing further defining a receptacle; and a speaker supportable in the receptacle, the speaker including a speaker housing providing a speaker outlet, the speaker outlet being one of aligned with and positioned forwardly of the outlet plane when the speaker is supported in the receptacle.

In yet another independent aspect, a shower and speaker assembly may generally include a shower device including a device housing defining an inlet, an outlet and a waterway communicating between the inlet and the outlet, the device housing further defining a receptacle; and a speaker supportable in the receptacle, the speaker including a speaker housing providing a speaker outlet and a grip surface formed radially of the speaker outlet, the grip surface facilitating removal of the speaker from the shower device. In a further independent aspect, a shower system may generally include a first shower device including a first device housing defining an inlet, an outlet and a waterway communicating between the inlet and the outlet, the first device housing defining a first receptacle, the first shower device having a first configuration; a second shower device including a second device housing defining an inlet, an outlet and a waterway communicating between the inlet and the outlet, the second device housing defining a second receptacle, the second shower device having a second configuration different from the first configuration; and a second device selectively and alternately supportable in the first receptacle and in the second receptacle.

In a still further independent aspect, a shower and speaker assembly may generally include a shower device and a speaker. The shower device may generally include a device housing having an inlet and defining a waterway, and a face plate having a front surface defining a plurality of shower openings, the face plate defining a central opening recessed from the front surface and having a flared surface extending between the central opening and the front surface, the waterway communicating between the inlet and the shower openings. The speaker may be supported on the device housing behind the face plate and operable to output sound through the central opening.

In another independent aspect, a shower and speaker assembly may generally include a shower device including a device housing having an inlet extending along an inlet axis and an outlet extending along an outlet axis, the device housing defining a waterway communicating between the inlet and the outlet, and a speaker supported on the device housing axially between the inlet and the outlet, the speaker outputting sound along an output axis parallel to the outlet axis, the waterway being diverted around the speaker from the inlet to the outlet.

In yet another independent aspect, a shower and speaker assembly may generally include a shower device including a device housing having an inlet extending along an inlet axis, an inlet chamber and an outlet extending along an outlet axis, the device housing defining a waterway communicating between the inlet chamber and the outlet, and a speaker supported on the device housing axially between the inlet chamber and the outlet, the speaker outputting sound along an output axis parallel to the outlet axis, water being in the inlet chamber directly behind the speaker, the outlet being axially in front of the speaker.

In a further independent aspect, a shower and speaker assembly may generally include a shower device including a device housing having an inlet extending along an inlet axis and an outlet extending along an outlet axis, the device housing defining a waterway communicating between the inlet and the outlet, the device housing defining a receptacle between the inlet and the outlet, and a speaker removably supported in the receptacle axially between the inlet and the outlet, the speaker outputting sound along an output axis parallel to the outlet axis, the speaker being movable relative to the receptacle in a direction transverse to the outlet axis.

In another independent aspect, a shower and speaker assembly may generally include a shower device and a speaker. The shower device may generally include a device housing having an inlet and defining a waterway and a receptacle, and an outlet assembly including a back plate and a face plate having a front surface defining a plurality of shower openings, an outlet chamber being defined between the back plate and the face plate, the waterway communicating between the inlet and the outlet chamber, water being discharged through the openings along an outlet axis. The speaker may be removably supported in the receptacle, the speaker outputting sound along an output axis parallel to the outlet axis, the speaker being movable relative to the receptacle axially behind the back plate.

In yet another independent aspect, a shower and speaker assembly may generally include a first shower device including a first device housing having an inlet and an outlet, the first device housing defining a waterway communicating between the inlet and the outlet, the first device housing defining a first receptacle, the first shower device having a first configuration, a second shower device including a second device housing having an inlet and an outlet, the second device housing defining a waterway communicating between the inlet and the outlet, the second device housing defining a second receptacle, the second shower device having a second configuration different that the first configuration, and a speaker selectively and alternatively supportable in the first receptacle and in the second receptacle.

In a further independent aspect, a shower and speaker assembly may generally include a shower device including a device housing having an inlet and an outlet, the device housing defining a waterway communicating between the inlet and the outlet, the device housing defining a receptacle, and a speaker supportable in the receptacle, the speaker including speaker components operable to output sound from a remote source and communication components operable to communicate wirelessly between the remote source and the speaker components.

In another independent aspect, a shower and speaker assembly may generally include a shower device including a device housing defining an inlet communicating with an inlet chamber, an outlet and a waterway communicating between the inlet chamber and the outlet, the device housing further defining a receptacle having a closed end and an open end, the inlet chamber being behind the closed end, the waterway extending along the receptacle from the closed end toward the open end; and a speaker supportable in the receptacle.

In yet another independent aspect, a shower and speaker assembly may generally include a shower device including a device housing defining an inlet, an outlet and a waterway communicating between the inlet and the outlet, the outlet defining an outlet plane, the device housing further defining a receptacle; and a speaker supportable in the receptacle, the speaker including a speaker housing providing a speaker outlet, the speaker outlet being one of aligned with and positioned forwardly of the outlet plane when the speaker is supported in the receptacle.

In a further independent aspect, a shower and speaker assembly may generally include a shower device including a device housing defining an inlet, an outlet and a waterway communicating between the inlet and the outlet, the device housing further defining a receptacle; a speaker supportable in the receptacle; and a magnetic connecting structure operable to releasably connect the speaker and the shower device.

In another independent aspect, a shower and speaker assembly may generally include a shower device including a device housing defining an inlet, an outlet and a waterway communicating between the inlet and the outlet, the device housing further defining a receptacle; and a speaker supportable in the receptacle, the speaker including a speaker housing providing a speaker outlet and a grip surface formed radially of the speaker outlet, the grip surface facilitating removal of the speaker from the shower device.

In yet another independent aspect, a shower and speaker assembly may generally include a shower device including a device housing defining an inlet and a waterway, and a face plate having a front surface defining a plurality of outlet openings and a receptacle recessed from the front surface, the waterway communicating between the inlet and outlet openings; and a speaker supported in the receptacle.

In a further independent aspect, a shower and speaker assembly may generally include a shower device including a device housing defining an inlet and a waterway, an outlet assembly including a back plate and a face plate having a front surface defining a plurality of shower openings, an outlet chamber being defined between the back plate and the face plate, the waterway communicating between the inlet and the outlet chamber, and a receptacle; and a speaker removably supported in the receptacle.

In another independent aspect, a shower device and speaker assembly may generally include a device housing defining an inlet extending along an inlet axis, an outlet extending along an outlet axis, and a waterway communicating between the inlet and the outlet, the device housing defining a receptacle between the inlet and the outlet; and a speaker removably supported in the receptacle axially between the inlet and the outlet, the speaker outputting sound along an output axis parallel to the outlet axis, the speaker being movable relative to the receptacle in a direction transverse to the outlet axis.

In yet another independent aspect, a shower device and speaker assembly may generally include a device housing defining an inlet and a waterway, an outlet assembly including a back plate and a face plate having a front surface defining a plurality of shower openings, an outlet chamber being defined between the back plate and the face plate, and a receptacle; and a speaker removably supported in the receptacle and movable relative to the receptacle axially behind the back plate, the waterway communicating between the inlet and the outlet chamber for discharging water through the openings along an outlet axis, the speaker outputting sound along an output axis parallel to the outlet axis.

DETAILED DESCRIPTION

Figure 1A:
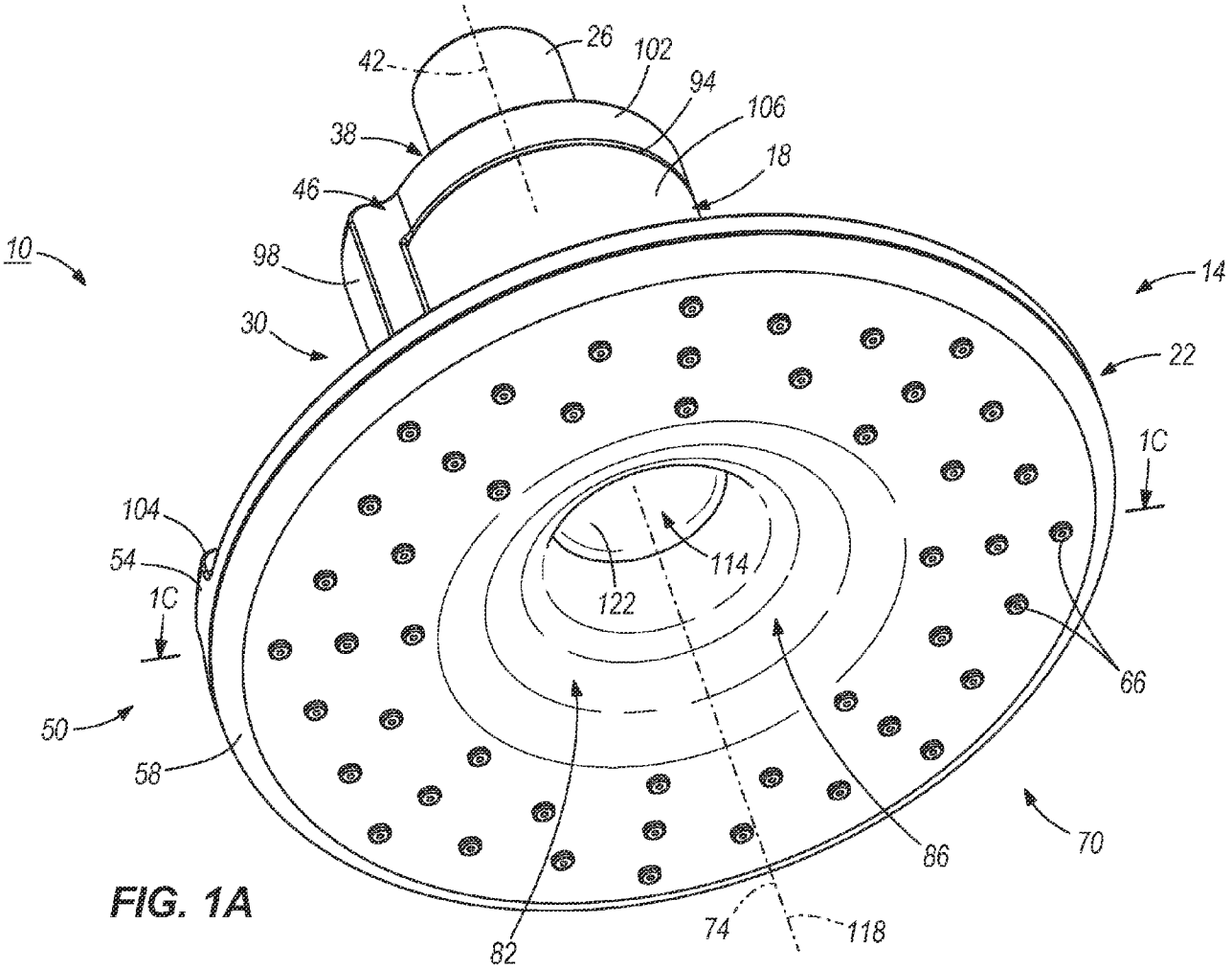
FIG. 1A is a front perspective view of a shower and speaker assembly.
Figure 1B:
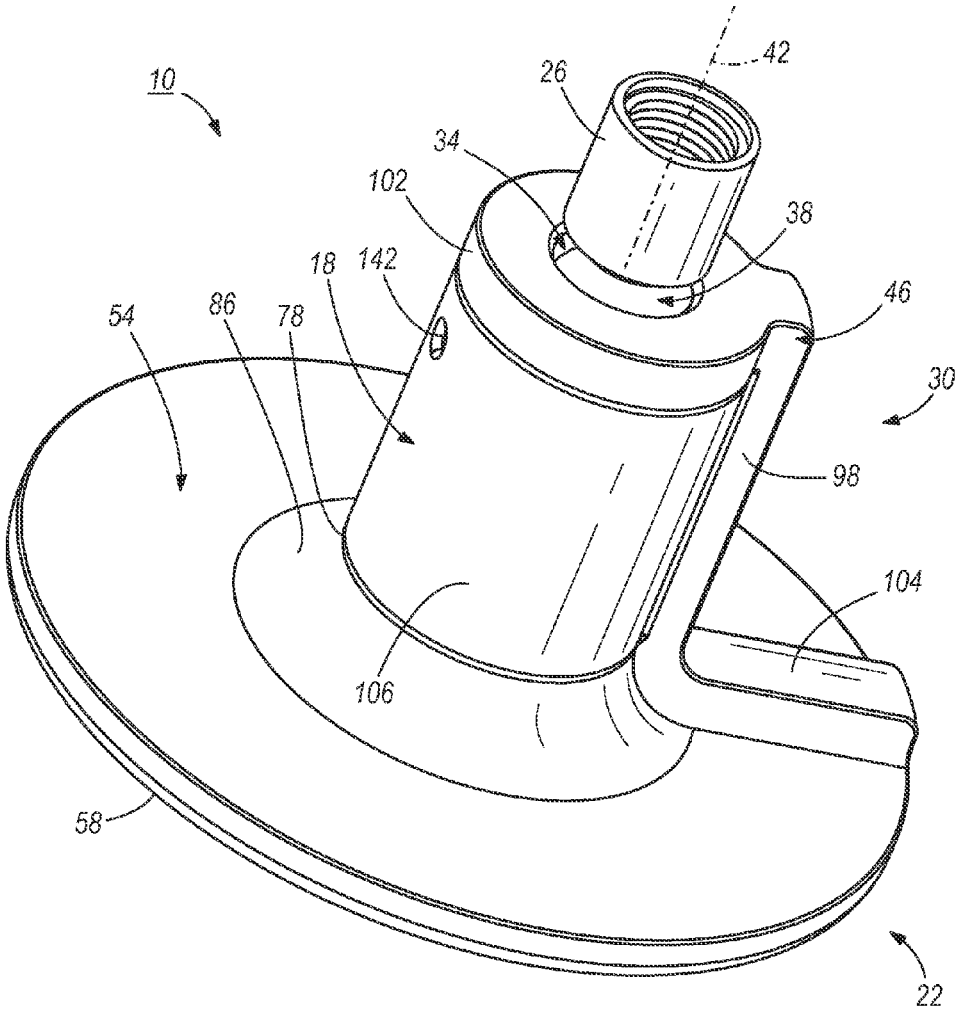
FIG. 1B is a rear perspective view of the assembly shown in FIG. 1A.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

A shower and speaker assembly 10 is shown in FIGS. 1A-1D. The assembly 10 generally includes a shower device 14 and a speaker 18. In the illustrated construction, the shower device 14 includes a showerhead 22. In other constructions (not shown), the assembly 10 may include another shower device having a configuration different than a showerhead, such as, for example, a rain can, a hand shower, a wall-mounted water tile, etc., with a speaker 18.

The showerhead 22 includes an inlet connector 26 for threaded connection to water supply pipe (not shown) of a water supply (e.g., household/residential, commercial, etc.). The showerhead 22 also includes a housing 30, and a ball joint 34 is provided between the housing 30 and the inlet connector 26. The housing 30 has an inlet 38 extending along an inlet axis 42. A waterway 46 extends from the inlet 38 to a showerhead outlet assembly 50.

The outlet assembly 50 includes a back plate 54 and a face plate 58 defining an annular outlet chamber 62 communicating with the waterway 46. Water nozzles or outlets 66 are provided on the face plate 58. Water flows through the outlets 66 to define a curtain or envelope 70 (partially shown in FIG. 1A) of water. The illustrated envelope 70 of water is generally conical (extending along an outlet axis 74) and surrounds an open center. The envelope may have other shapes.

The plates 54, 58 define aligned central openings 78, 82, respectively, such that the outlet assembly 50 has a generally annular, doughnut shape. A flared surface 86 extends from the opening 78 to a plane 90 of the face plate 58, and a flared surface 86 is also provided on the back plate 54 (see FIG. 1B). In the illustrated construction, the plane 90 is aligned with a front surface of the face plate 58, and the outlets 66 project forwardly of the plane 90. The illustrated flared surfaces 86 curve outwardly toward the plane 90 in a horn or bell shape. In other constructions (not shown), the flared surfaces 86 may have a straight taper and a conical shape.

The housing 30 defines a receptacle 94 for the speaker 18. In the illustrated construction, the receptacle 94 is provided along the inlet and outlet axes 42, 74. To accommodate the receptacle 94, the waterway 46 includes a diverted portion 98, and the illustrated diverted portion 98 is laterally shifted relative to the axes 42, 74. In other constructions (not shown), the diverted portion 98 may be laterally shifted relative to only one axis 42 or 74 or to a greater or lesser extent relative to each axis 42, 74 (e.g., if the axes 42, 74 are not aligned). In still other constructions (not shown), the diverted portion 98 may be oriented at a non-parallel angle relative to the axes 42, 74 (e.g., extending from the inlet connector 26 toward a radially-outer portion of the outlet assembly 50).

The housing 30 defines an inlet chamber 102 behind the receptacle 94, and the diverted portion 98 communicates between the chambers 102, 62. The front wall of the inlet chamber 102 provides a back wall of the receptacle 94. The peripheral surface around the opening 78 in the back plate 54 provides a front surface of the receptacle 94. The outer wall of the diverted portion 98 provides a lateral wall of the receptacle 94. A radial portion 104, formed with the diverted portion 98, extends radially along the back plate 54 and may provide additional strength, rigidity, etc. to the back plate 54 and/or to outlet assembly 50.

The speaker 18 is supported by the showerhead housing 30 and includes a speaker housing 106 supportable in the receptacle 94. The housing 106 supports speaker components 110 for producing an output (e.g., audio, sound, etc.) through a speaker outlet 114 along an output axis 118. The speaker 18 is supported in the receptacle 94 with the output axis 118 aligned and co-axial with the outlet axis 74 to project sound through the openings 78, 82.

A cover or screen 122 covers a speaker outlet 114. The screen 122 is sound permeable and substantially water impermeable. In the illustrated construction, the screen 122 is micro-etched to provide sound permeability/water impermeability. The speaker outlet 114 is arranged in a plane 126, and the speaker plane 126 is recessed from the plane 90 of the face plate 58 which may also limit water from entering the speaker 18. The flared surface 86 provides an angled surface between the speaker outlet 114 and the front surface of the face plate 58.

As shown in FIG. 1A, the outlets 66 surround the output of the speaker 18. The outlets 66 are arranged in multiple rings on the face plate 58 about the periphery of the speaker outlet 114. The resulting envelope 70 has multiple layers surrounding the output of the speaker 18. The flared surface 86 of the face plate 58, alone or in cooperation with the envelope 70, focuses sound output by the speaker 18, much like the horn of a phonograph. The face plate 58 and other components of the showerhead 22 may be formed of a material, such as hard plastic, silicone, etc., which may also enhance the sound output of the speaker 18.

The illustrated showerhead 22 is designed for use with the speaker 18 to enhance sound output by the speaker 18 and/or the audio experience of the user. For example, components of the illustrated showerhead 22 may have a shape and/or construction (e.g., the flared surface 86, the output/pattern of the outlets 66, etc.), may operate (e.g., the envelope 70 resulting from the water flow) and/or may be formed of materials to obtain or promote the desired output/experience. Other design factors (e.g., the combination of the showerhead 22 and the speaker 18) may also be considered.

Figure 1C:
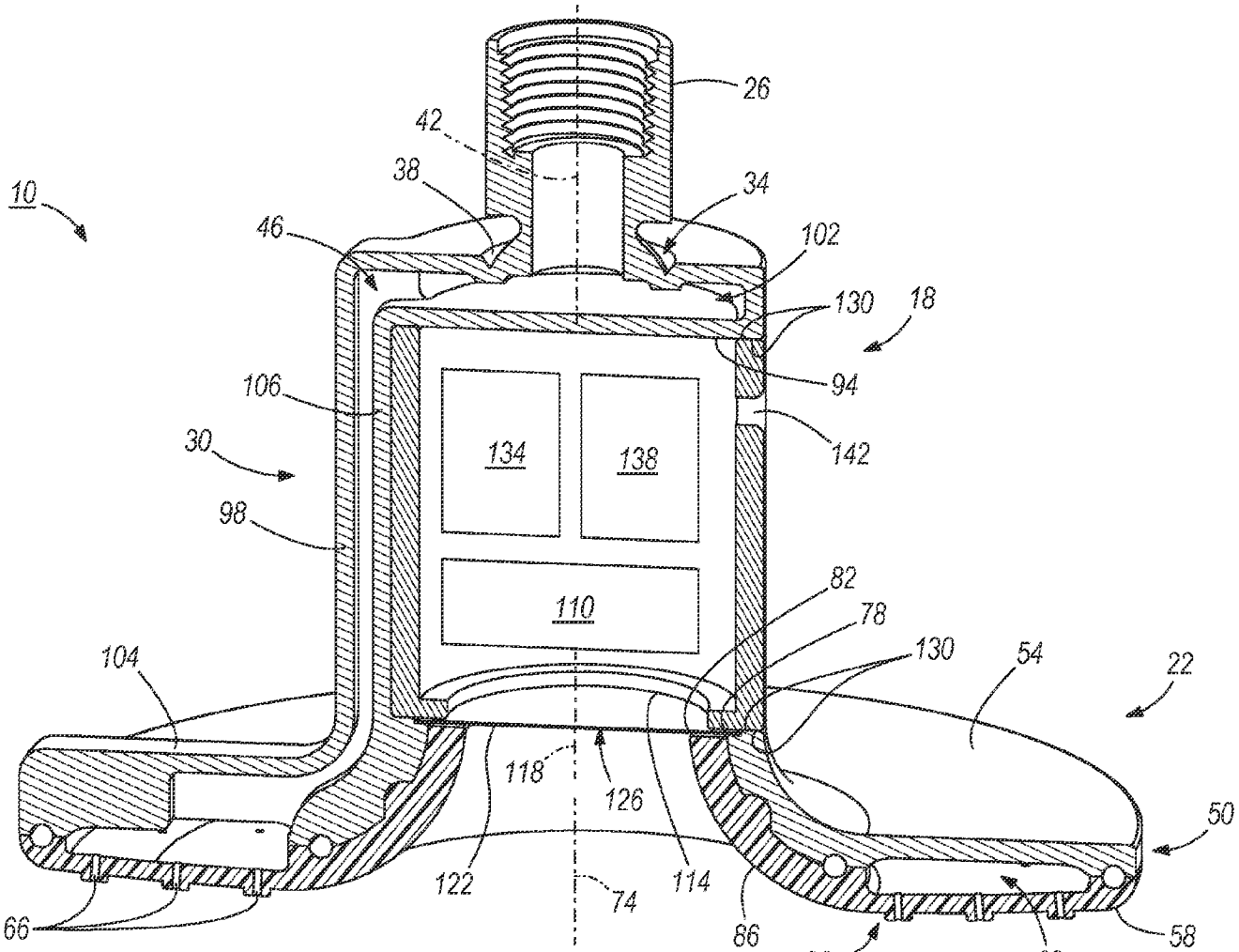
FIG. 1C is a side cross-sectional view of the assembly shown in FIG. 1A, taken generally along line 1C-1C.

The speaker 18 is positioned axially between the inlet 38 and the outlets 66 of the showerhead 22. As shown in FIG. 1C, in the illustrated construction, water is axially behind (in the inlet chamber 102) and axially in front of (in the outlet chamber 62) the speaker 18. Water is diverted around the speaker 18 through the diverted portion 98.

Figure 1D:
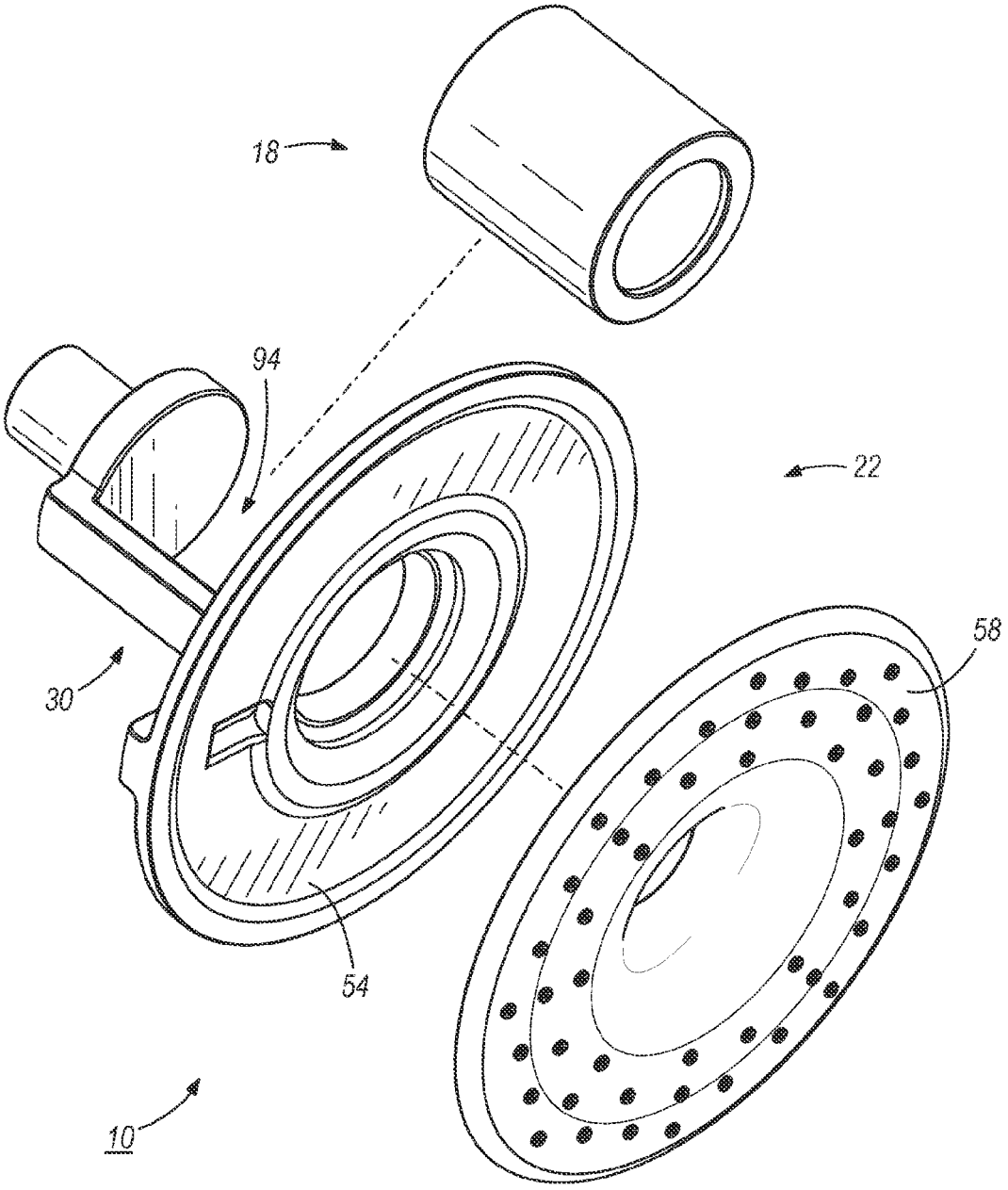
FIG. 1D is an exploded perspective view of the assembly shown in FIG. 1A.
Figure 2A:
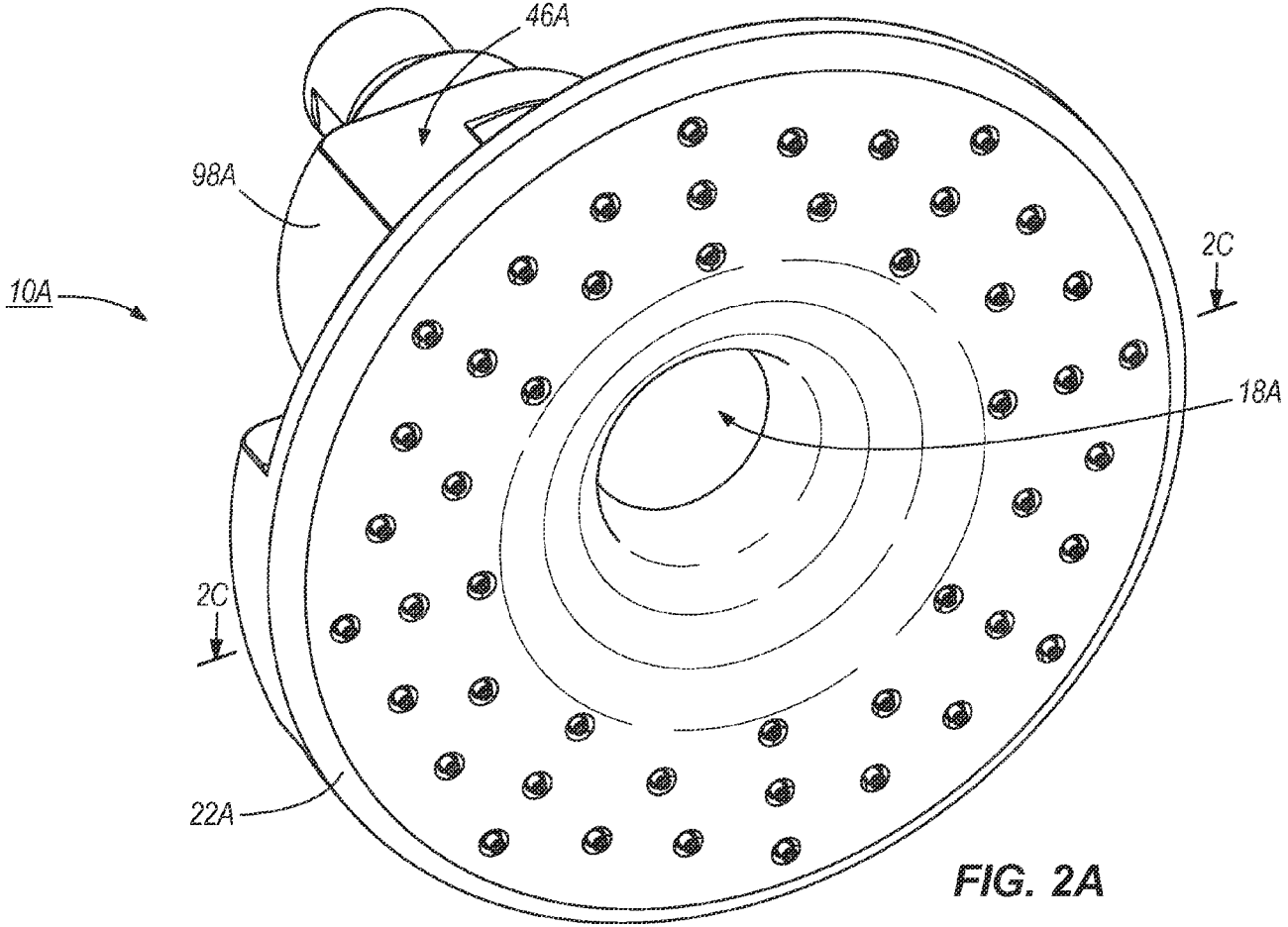
FIG. 2A is a front perspective view of an alternative construction of a shower and speaker assembly.
Figure 2B:
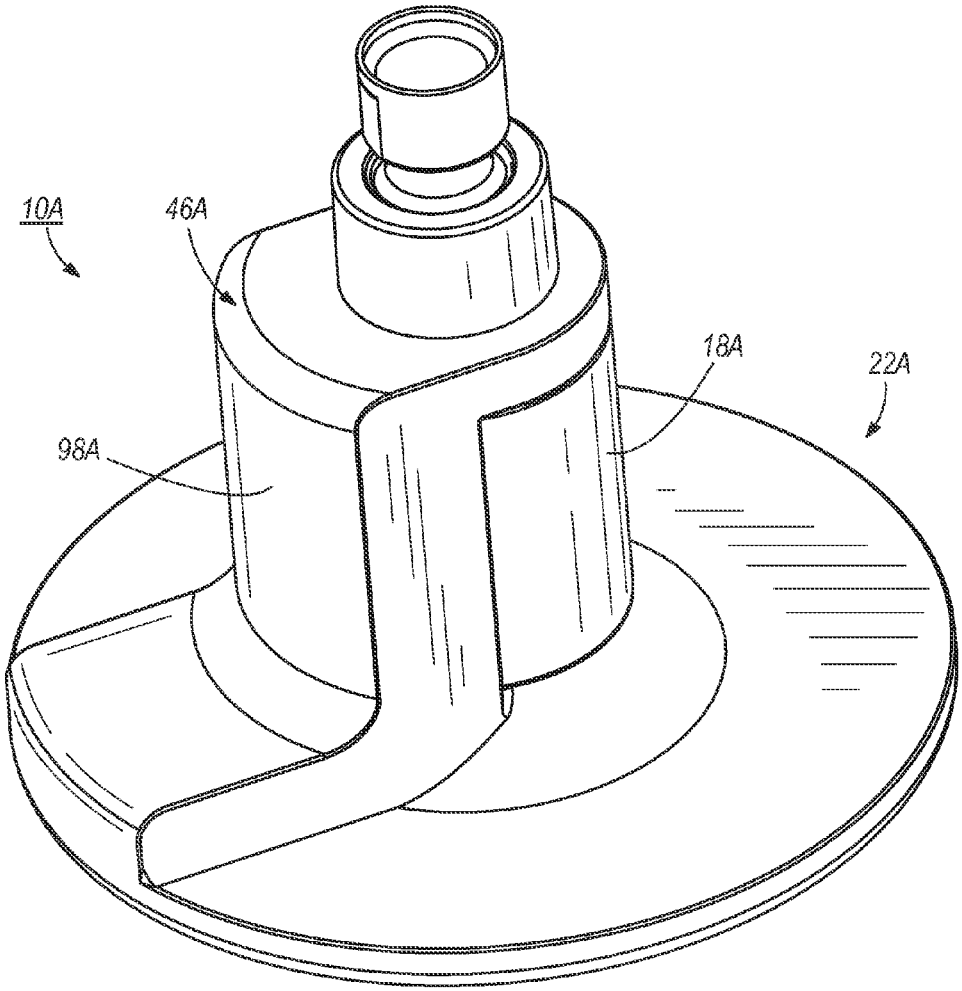
FIG. 2B is a rear perspective view of the assembly shown in FIG. 2A.
Figure 2C:
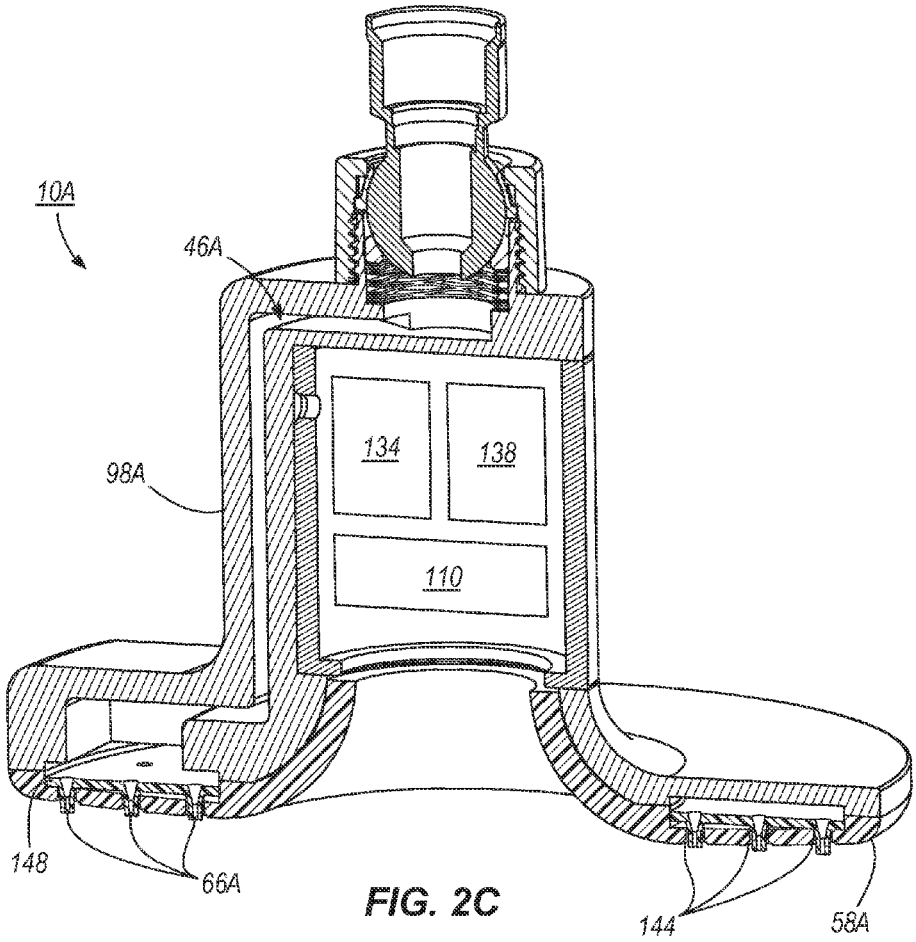
FIG. 2C is a side cross-sectional view of the assembly shown in FIG. 2A, taken generally along line 2C-2C.
Figure 2D:
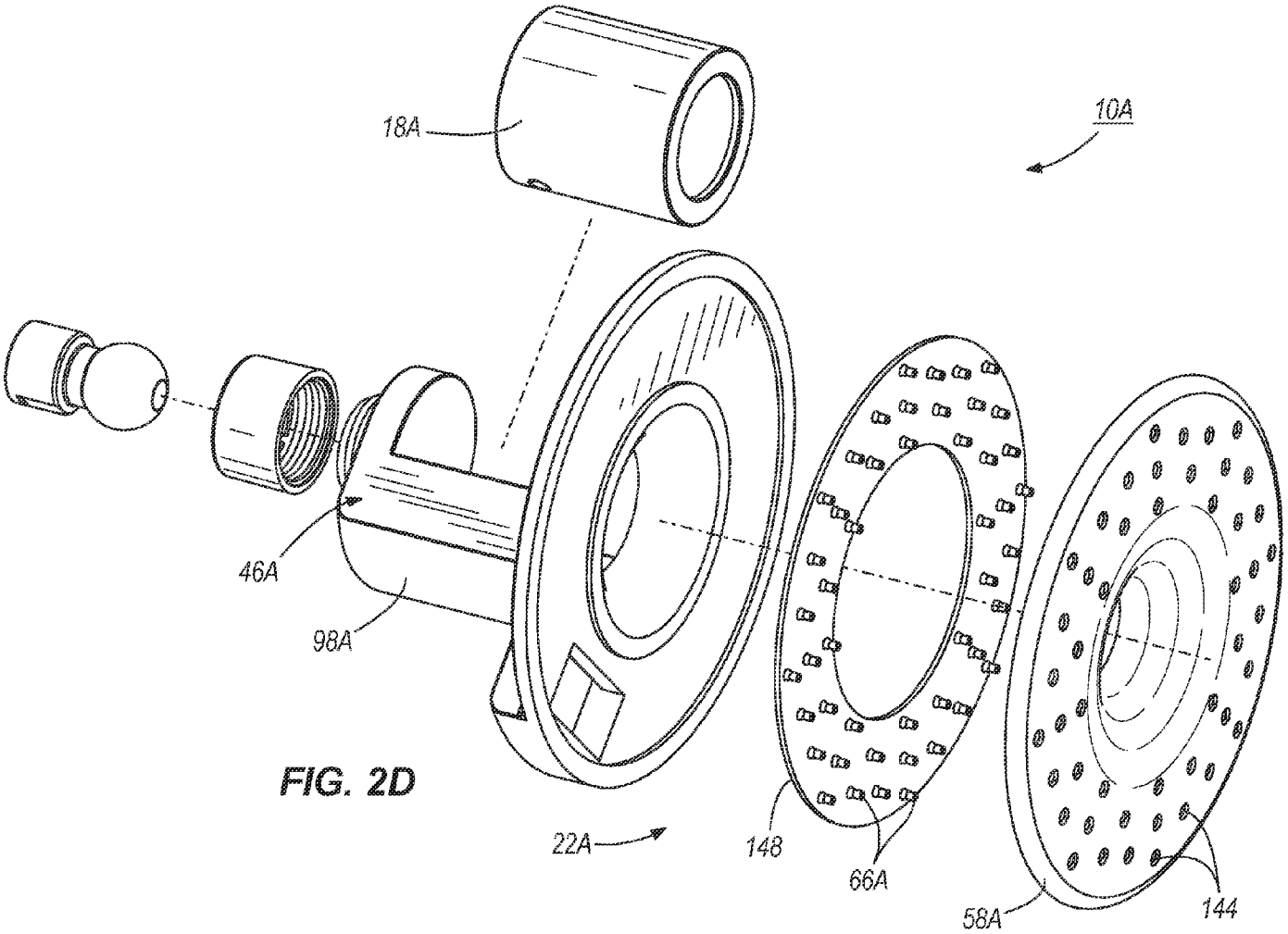
FIG. 2D is an exploded perspective view of the assembly shown in FIG. 2A.
Figure 3A:
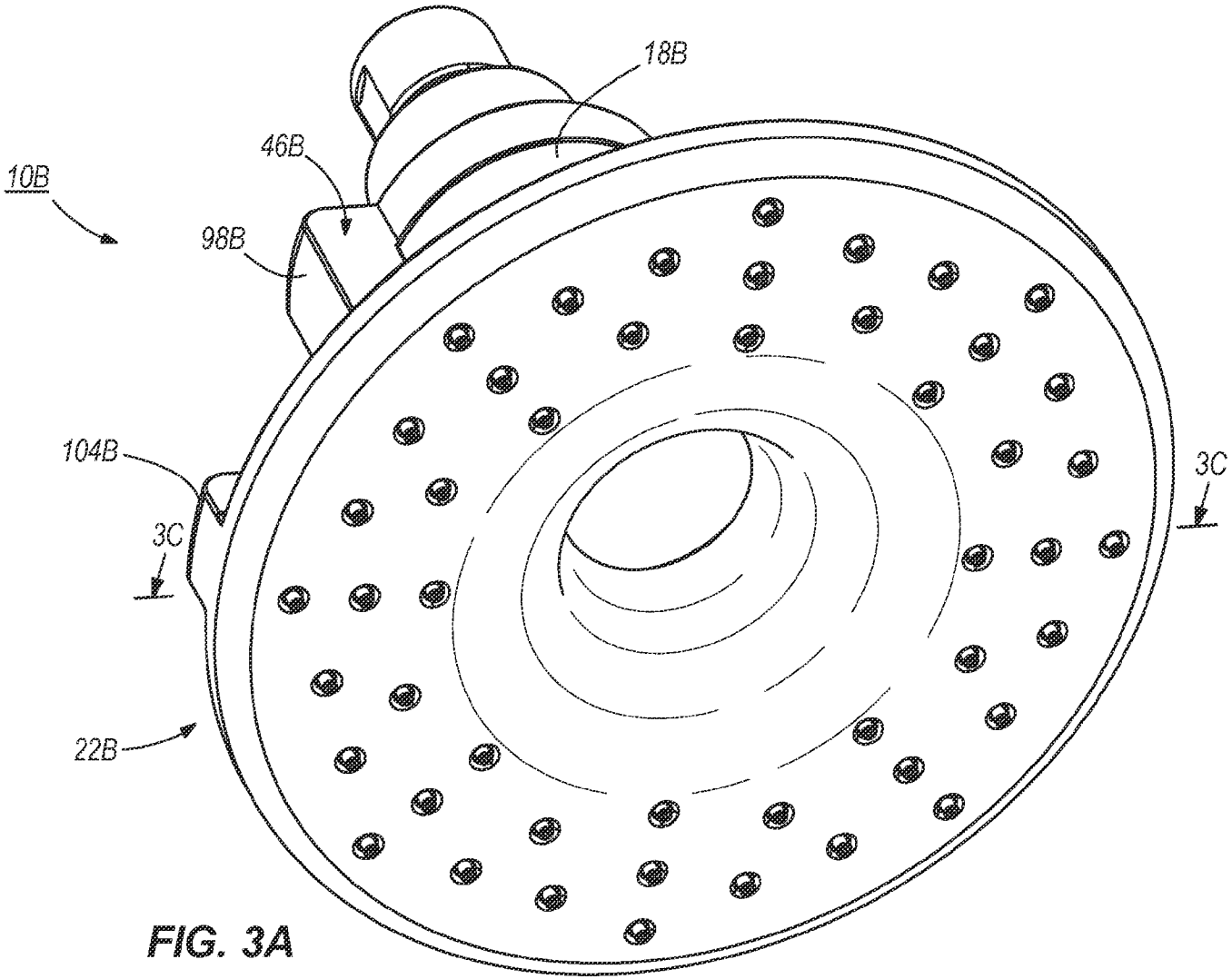
FIG. 3A is a front perspective view of another alternative construction of a shower and speaker assembly.
Figure 3B:
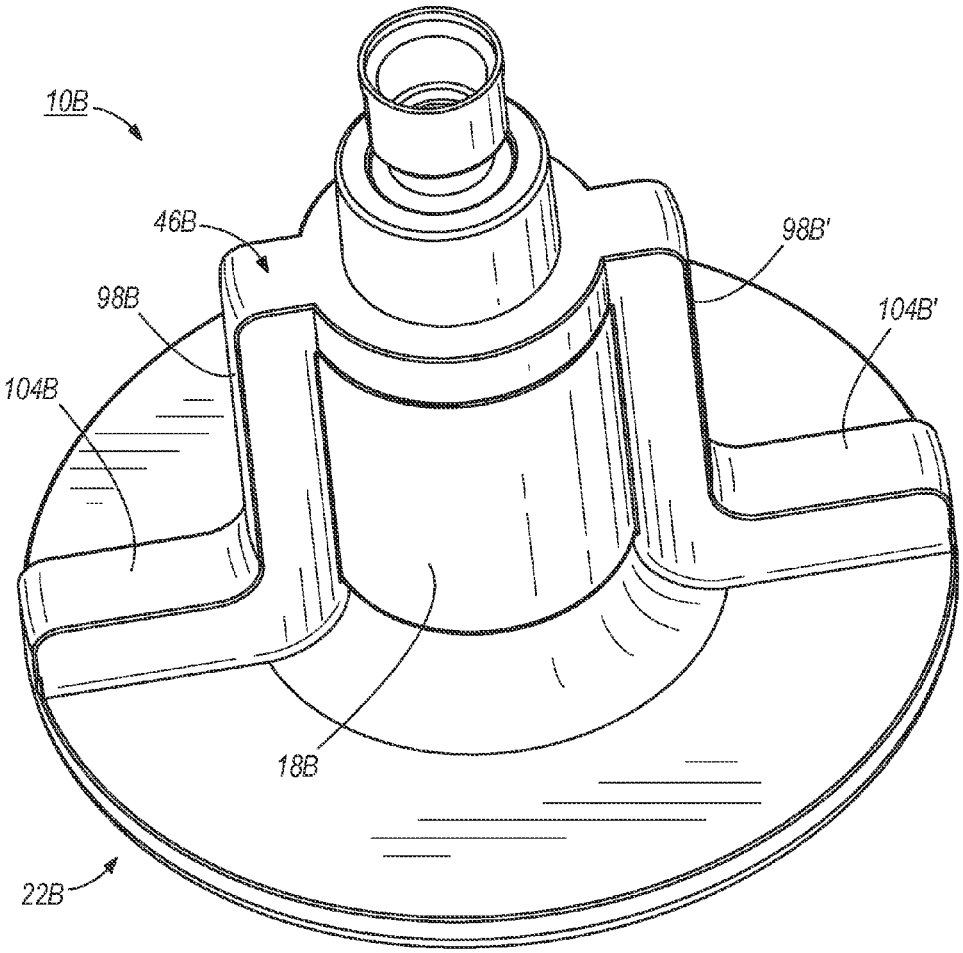
FIG. 3B is a rear perspective view of the assembly shown in FIG. 3A.
Figure 3C:
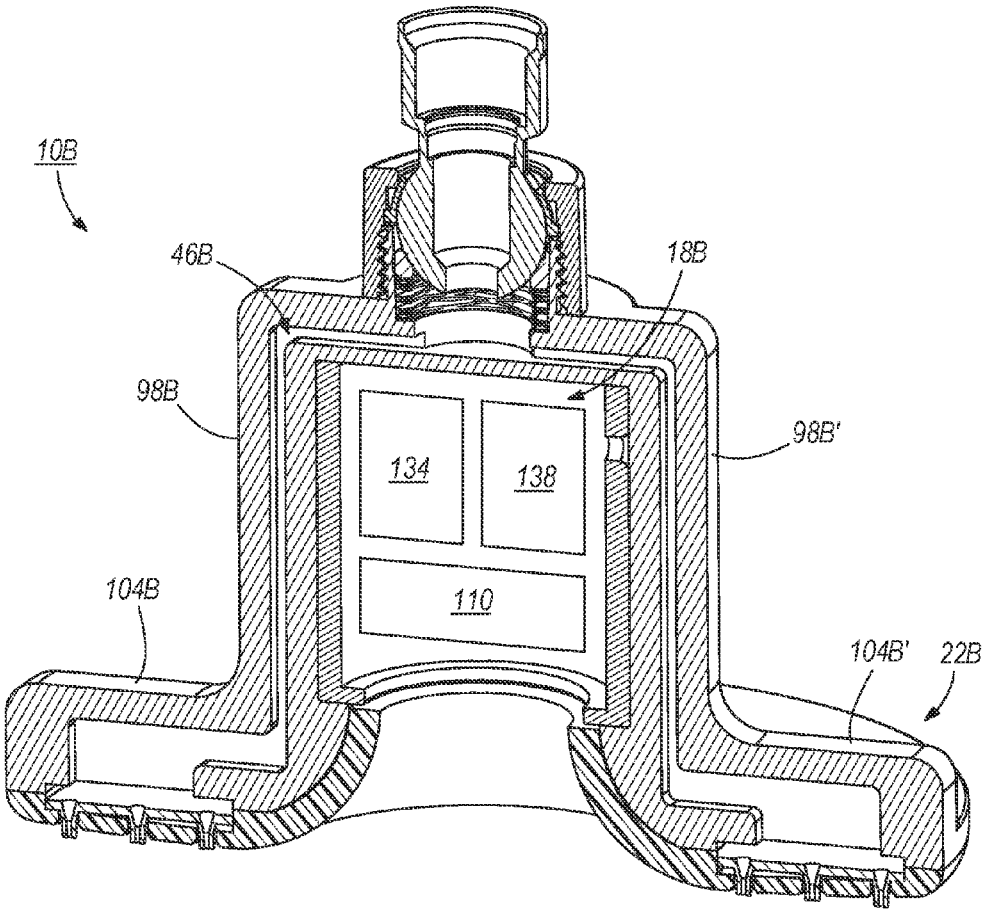
FIG. 3C is a side cross-sectional view of the assembly shown in FIG. 3A, taken generally along line 3C-3C.
Figure 3D:
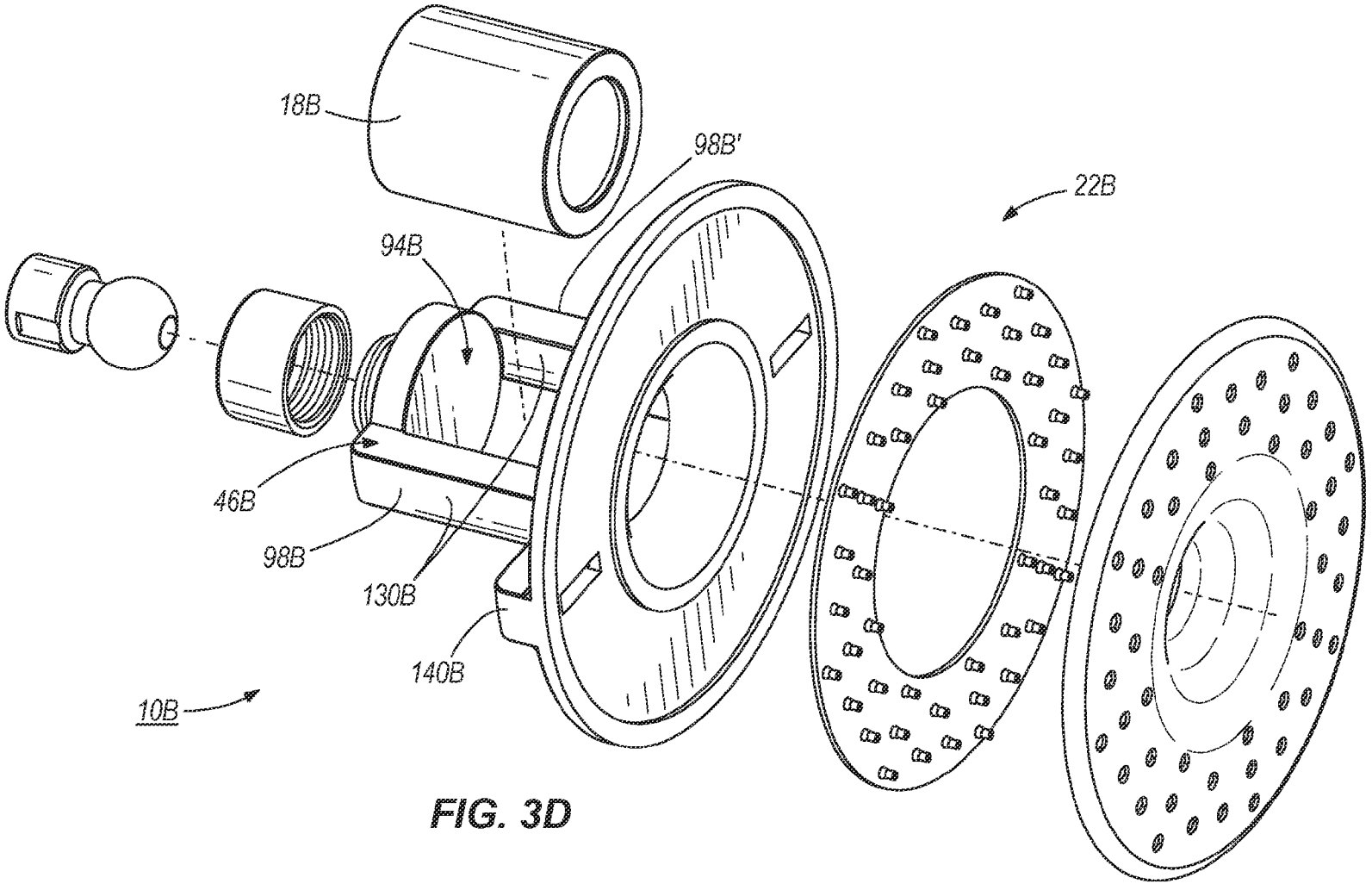
FIG. 3D is an exploded perspective view of the assembly shown in FIG. 3A.
Figure 4A:
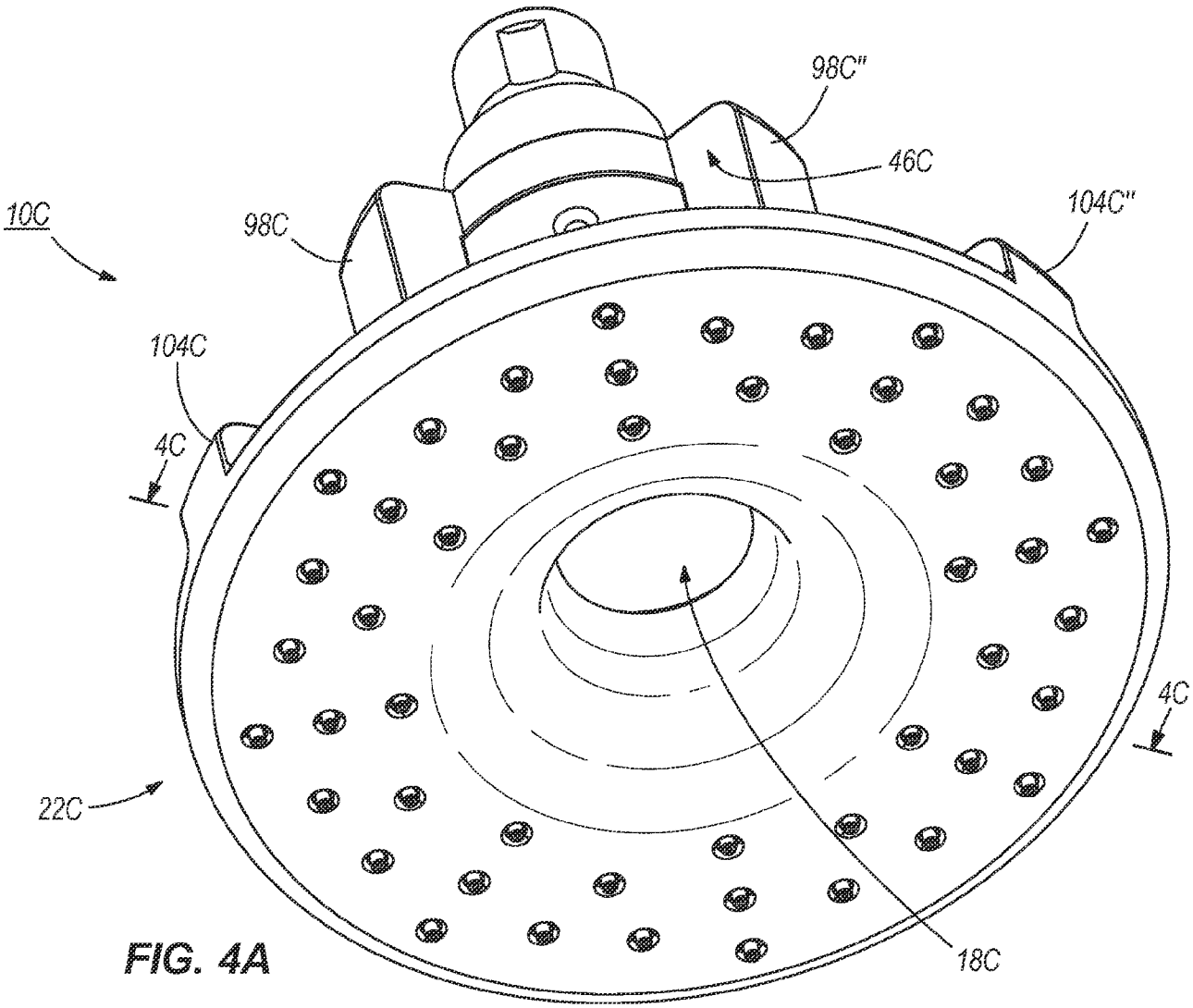
FIG. 4A is a front perspective view of yet another alternative construction of a shower and speaker assembly.
Figure 4B:
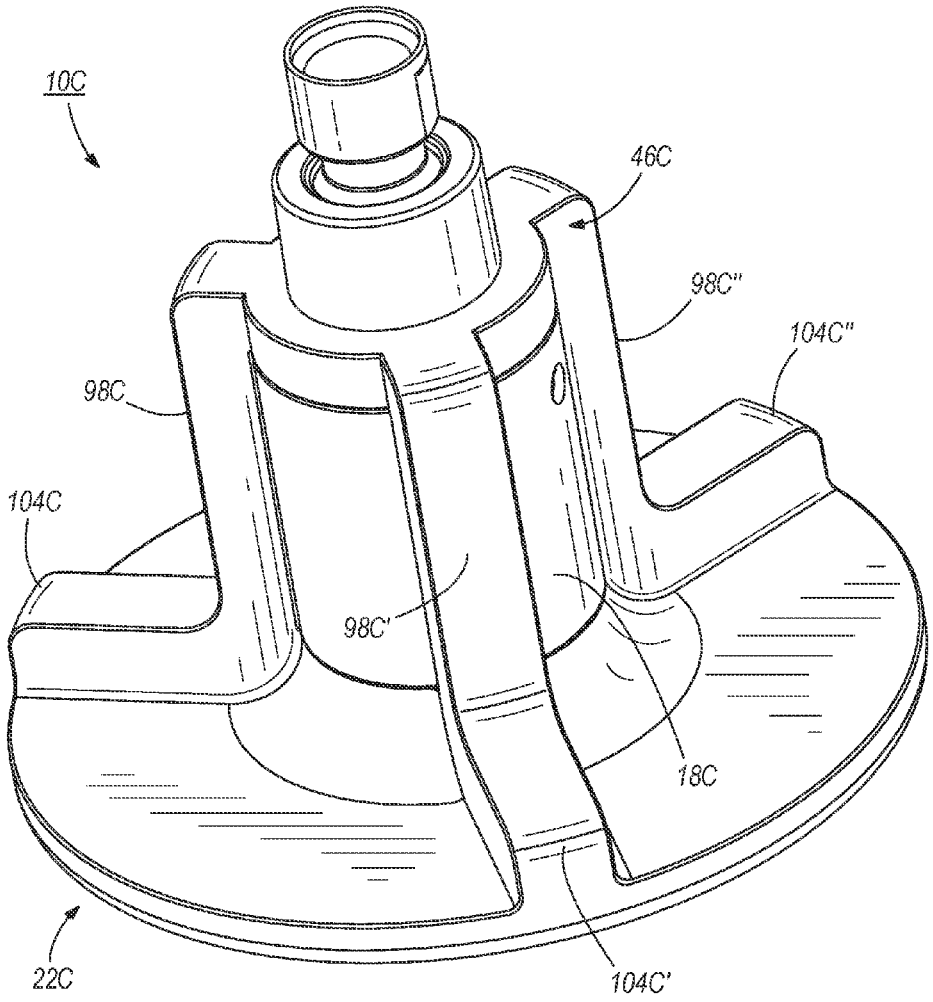
FIG. 4B is a rear perspective view of the assembly shown in FIG. 4A.
Figure 4C:
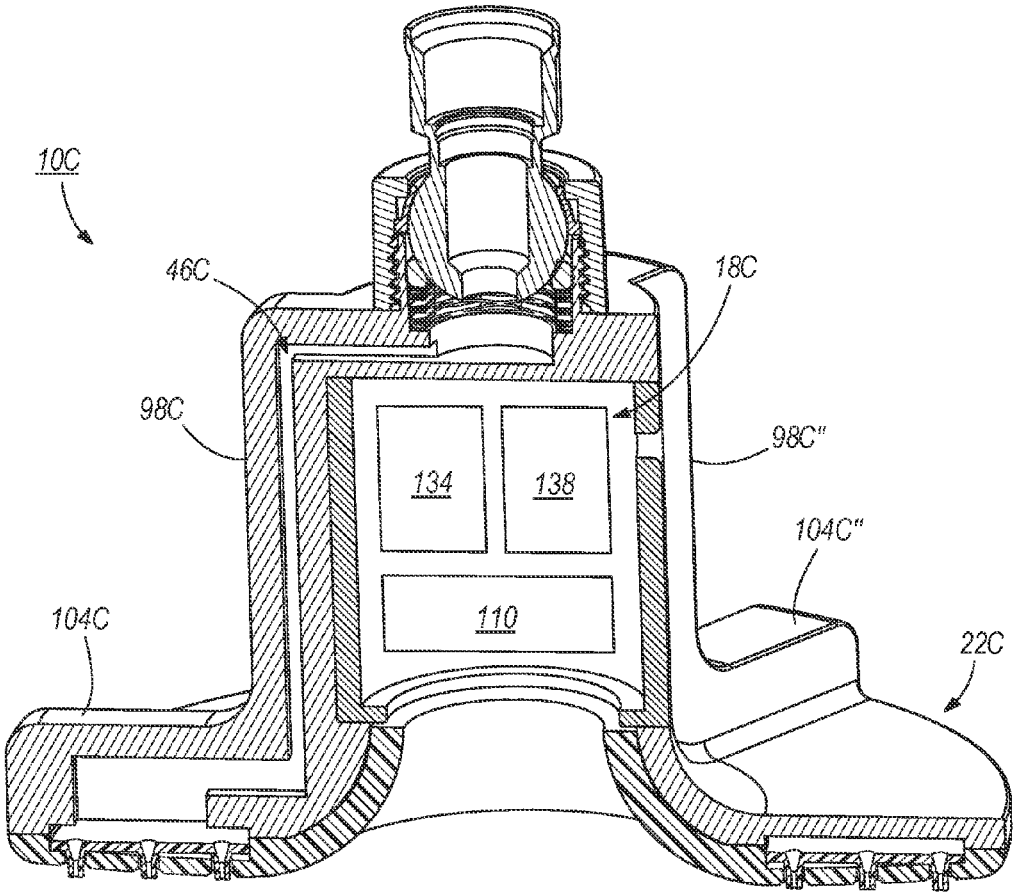
FIG. 4C is a side cross-sectional view of the assembly shown in FIG. 4A, taken generally along line 4C-4C.
Figure 4D:
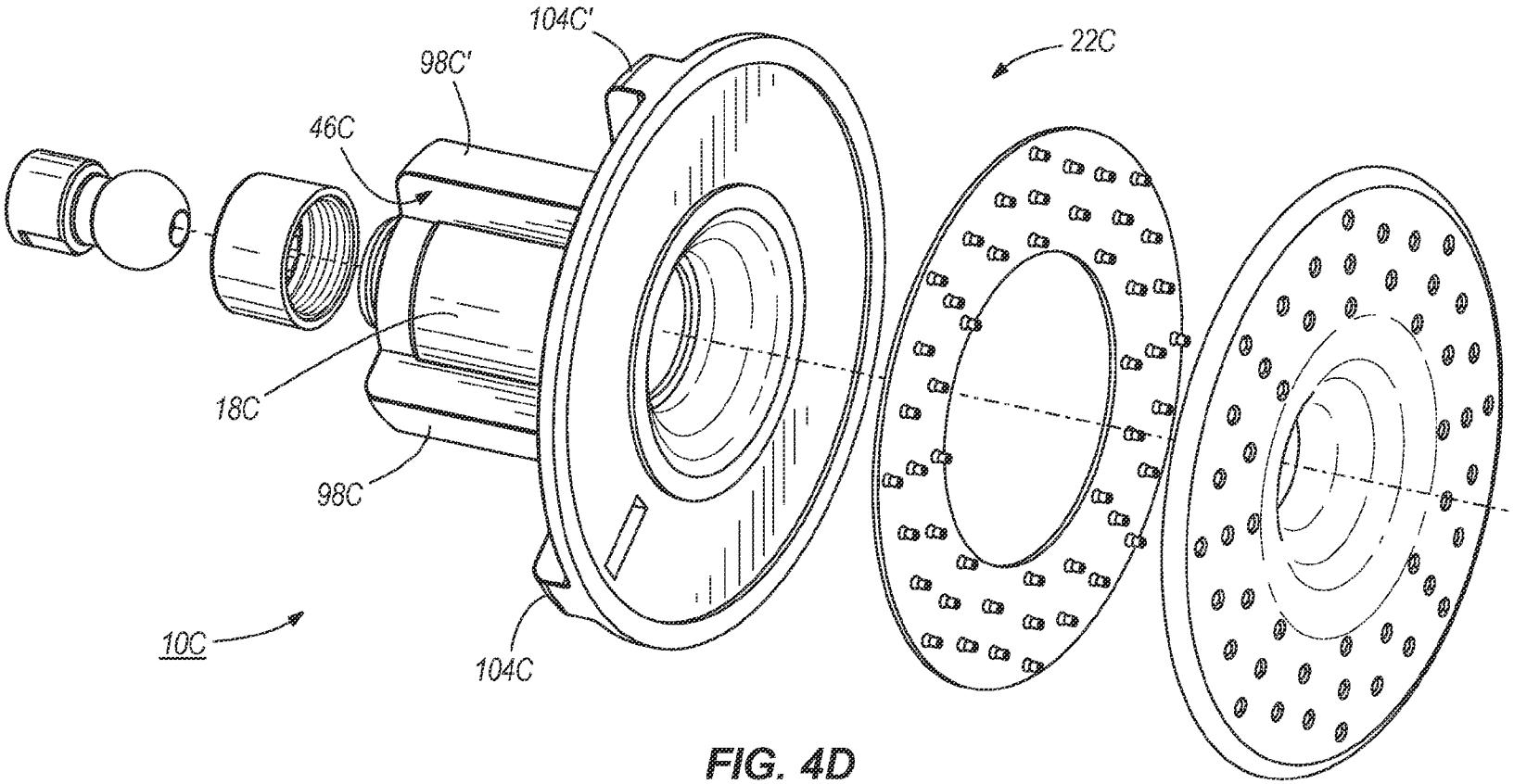
FIG. 4D is an exploded perspective view of the assembly shown in FIG. 4A.

In the illustrated construction, the speaker 18 is removably supported by the showerhead housing 30. The speaker 18 is inserted into and removed from the receptacle 94 without tools. As shown in FIG. 1D, the speaker 18 is inserted laterally (transverse to the outlet axis 74) into the receptacle 94. Also, the speaker 18 is connected to the speaker housing 30 behind the back plate 54.

Connecting structure 130 is provided between the speaker housing 106 and the showerhead housing 30 to removable connect the housings 106, 30. The connecting structure 130 may include frictional engagement between one or more of the walls of the receptacle 94 and the speaker housing 106 (e.g., a friction fit). Material (not shown) with enhanced frictional properties may be provided on the engaging surfaces. Force-applying structure (not shown) may be provided to increase the frictional force. Such structure may include a flexible "clamping" arrangement of components of the showerhead housing 30 (e.g., the spaced-apart diverted portions 98A of the waterway 46A shown in FIGS. 2A-2D).

The connecting structure 130 may include inter-engaging connecting members (not shown), such as one or more projections and recesses, rails and grooves, etc. The connecting structure 130 may include positive engagement structure (not shown) to lock the speaker 18 to the showerhead housing 30. For example, a movable locking member (not shown; e.g., a projection) may limit movement of the speaker housing 106 from the receptacle 94. A user moves the locking member (through direct engagement, a remote actuator, etc.) to allow the speaker 18 to be removed. The locking member may allow insertion of the speaker 18 into the receptacle without movement of the locking member by the user (e.g., an angled surface on the locking member is engaged by the speaker housing 106 to move the locking member out of the way).

Figure 20:
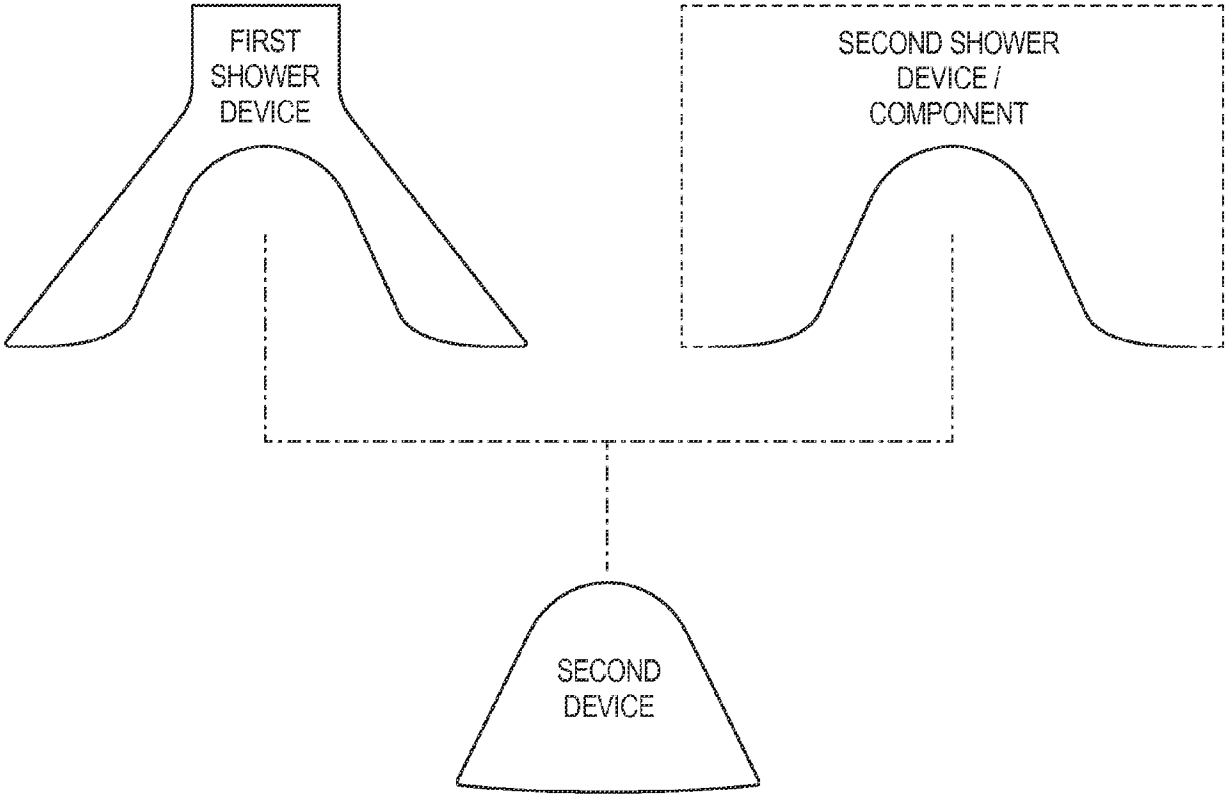
FIG. 20 is a schematic drawing of a shower system.

As illustrated schematically in FIG. 20, the speaker 18 may also be removably connectable to another shower component, such as, for example, a different style/model showerhead, e.g., any of the showerheads shown in FIGS. 2A-19, a rain can, a hand shower, a wall-mounted water tile, etc., to provide a modular shower and speaker system. In such a system, a single speaker 18 is removably connectable to the showerhead 22 and to another different shower component. The other shower component includes a housing defining a receptacle for supporting the speaker 18. The other shower component may incorporate structure similar to the showerhead 22 (e.g., a ring-shaped shower outlet assembly 50).

For example, U.S. Design Pat. No. D565,699 illustrates a hand shower. In the modular system, the illustrated hand shower may be modified to have a housing with a ring-shaped shower outlet assembly similar to the assembly 50 of the showerhead 22. The speaker 18 is supported in a similar manner on the modified hand shower.

The removable speaker 18 may also be connected separately in the shower enclosure (not shown). For example, the speaker 18 may be connected to connecting structure, similar to that described above, mounted on a wall of the enclosure. Alternatively, a suction cup (not shown) may be connected to the speaker 18 for connection to the wall or a clip (not shown) may be provided to hang the speaker 18 from a portion of the shower enclosure.

In the illustrated construction, the speaker components 110 receive a signal to output from a remote source (not shown), such as a phone, computer, other remotely-communicating source device, etc. (e.g., cell phone, smart phone (iPhone), desktop computer, laptop computer, tablet computer (iPad), MP3 player (iPod), other comparable device, etc.).

To communicate with the remote source, communication components 134 provide a wireless interface between the speaker components 110 and the remote source. The communication components 134 include, for example, Bluetooth or IEEE 802.11 ("Wi-Fi") compatible devices. The communication components 134 may provide one-way communication (e.g., from the remote source to the speaker components 110) or two-way communication (e.g., between components of the speaker 18 and the remote source).

If two-way communication is provided, the speaker 18 and/or the shower device 14 may include input components (not shown) capable of generating a signal to be sent to the remote source via the communication components 134. For example, the input components may include one or more buttons to control operation of the remote source (e.g., "ON/OFF", "Play/Pause", "Fwd", "Rev", "Volume", "Call Answer", "End Call" buttons, a key pad, a touch pad, etc.). The input components may include a microphone for use with a phone, intercom, etc.

The speaker 18 also includes power components, such as a battery 138, for powering components of the speaker 18. In the illustrated construction, the battery 138 is rechargeable when the speaker 18 is removed from the receptacle 94. One or more charging terminals 142 are provided on the speaker housing 106 for connection to a power source (not shown; such as line power through a removable power cord, USB cord, etc.). The speaker 18 is removed from the showerhead 22, and the terminals 142 are connected to the power source to recharge the battery 138. When the speaker 18 is supported on the showerhead 22, the terminals 142 are covered by a portion of the showerhead housing 30 (e.g., by the diverted portion 98). A terminal cover (not shown) may also be provided on the speaker housing 106. In other constructions (not shown), the battery may be removable for charging and/or replacement.

It should be understood that electronic components (e.g., the speaker components 110, the communication components 134, the power components, etc.), associated modules and logical structures are capable of being implemented in software executed by a microprocessor or a similar device or of being implemented in hardware using a variety of components including, for example, application specific integrated circuits ("ASICs"). Terms like "controller" and "module" may include or refer to both hardware and/or software.

FIGS. 2A-2D illustrate an alternative construction of a shower and speaker assembly 10A. The assembly 10A is similar to the assembly 10 described above and shown in FIGS. 1A-1D, and the description above is referred to for common elements. Modified elements are discussed below and have the same reference number "A".

In the assembly 10A, the waterway 46A includes a diverted portion 98A which is wider than the diverted portion 98 shown in FIGS. 1A-1D. The diverted portion 98A provides an arc-shaped recess to at least partially laterally capture the speaker 18A. The showerhead 22A may be arranged so that the diverted portion 98A is at the lowest point. The speaker 18A can thus rest on the diverted portion 98A when supported in the receptacle 94A.

Also, in assembly 10A, the face plate 58A defines openings 144. Nozzles 66A are provided on a plate 148. The plate 148 is arranged with the nozzles 66A projecting through the openings 144 in the face plate 58A.

FIGS. 3A-3D illustrate another alternative construction of a shower and speaker assembly 10B. The assembly 10B is similar to the assembly 10, 10A described above and shown in FIGS. 1A-1D and 2A-2D, respectively, and the description above is referred to for common elements. Modified elements are discussed below and have the same reference number "B".

In the assembly 10B, the waterway 46B includes multiple (two) diverted portions 98B and 98B'. The diverted portions 98B, 98B' are spaced apart on the showerhead housing 30B by about 180°. The diverted portions 98B, 98B' cooperate to capture the speaker 18B. As mentioned above, at least one of the diverted portions 98B, 98B' may be flexible to allow insertion of the speaker 18B and/or to apply force to retain the speaker 18B (e.g., to provide connecting structure 130B or to supplement other connecting structure).

The use of multiple diverted portions 98B, 98B' may also allow the flow through the showerhead 22B to be adjusted. For example, one diverted portion 98B provides a first flow path, and the other diverted portion 98B' provides a second flow path. Combined flow through both flow paths may provide increased flow through the shower outlet assembly 50B. The flow paths may have different volumes such that flow through one flow path is greater than through the other flow path. A valve arrangement (not shown) may be provided to selectively control flow through one or both of the flow paths (e.g., minimum flow through the smaller flow path, medium flow through the larger flow path, maximum flow through both flow paths). The valve arrangement may include a user control (not shown; e.g., a button or selector).

In other constructions (not shown), the valve arrangement may be automatically controlled through another input (e.g., based on the output of the speaker 18B). In such constructions, the valve arrangement may include one or more electronically-controlled valves (e.g., a solenoid valve) operated by control components (not shown). The water flow may be adjusted in relation to the intensity, rhythm, etc. of the sound output of the speaker 18B to also provide a tactile experience from the assembly 10B, in addition to the audio experience. The control components may be selectively activated/deactivated to add/remove the tactile experience.

FIGS. 4A-4D illustrate yet another alternative construction of a shower and speaker assembly 10C. The assembly 10C is similar to the assembly 10, 10A, 10B described above and shown in FIGS. 1A-1D, 2A-2D and 3A-3D, respectively, and the description above is referred to for common elements. Modified elements are discussed below and have the same reference number "C".

In the assembly 10C, the waterway 46C includes multiple (three) diverted portions 98C, 98C' 98C". The diverted portions 98C, 98C' 98C" are spaced apart on the showerhead housing 30C by about 120°. The diverted portions 98C, 98C' 98C" cooperate to capture the speaker 18C.

As mentioned above, at least one of the diverted portions 98C, 98C' 98C" may be flexible to allow lateral insertion of the speaker 18C and/or to apply force to retain the speaker 18C. However, in the illustrated construction, the speaker 18C is inserted into and removed from the receptacle 94C the receptacle 94C from the front of the shower outlet assembly 50C. As also mentioned above, the use of multiple diverted portions 98C, 98C', 98C" may also allow the flow through the showerhead 22C to be adjusted.

Figure 5B:
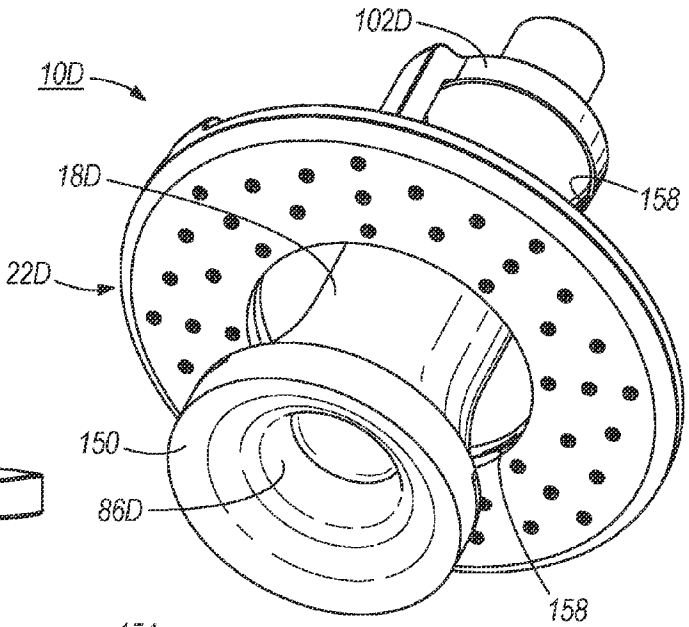
FIG. 5B is an exploded perspective view of the assembly shown in FIG. 5A.
Figure 5A:
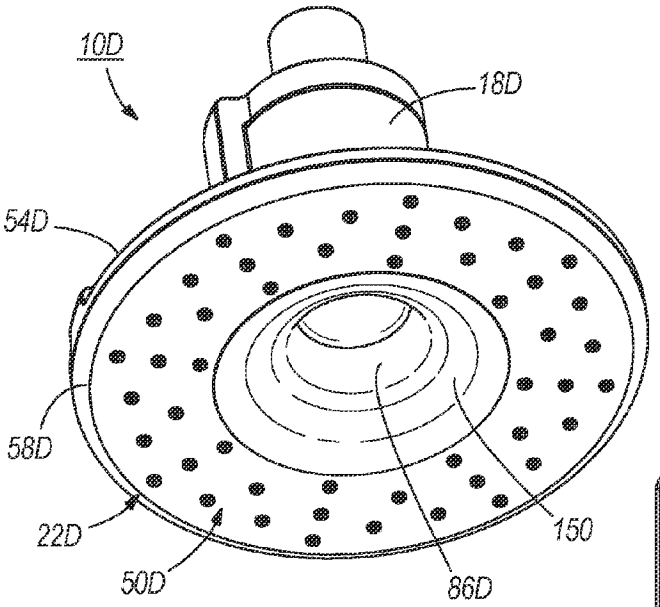
FIG. 5A is a front perspective view of an alternative construction of a shower and speaker assembly.
Figure 5C:
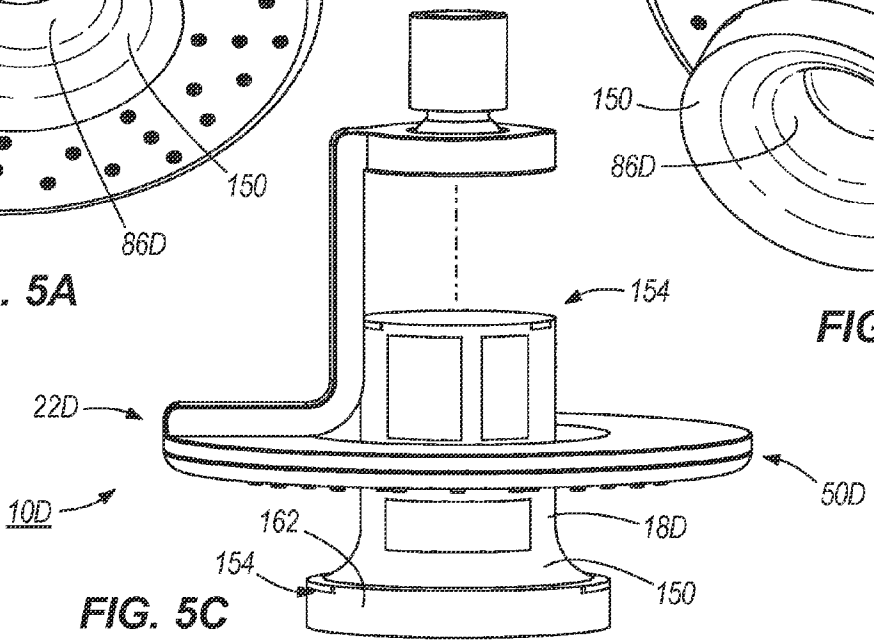
FIG. 5C is an exploded side view of the assembly shown in FIG. 5A.

FIGS. 5A-5C illustrate an alternative construction of a shower and speaker assembly 10D. The assembly 10D is similar to the assembly 10, 10A, 10B, 10C described above and shown in FIGS. 1A-1D, 2A-2D, 3A-3D and 4A-4D, respectively, and the description above is referred to for common elements. Modified elements are discussed below and have the same reference number "D".

In the assembly 10D, the speaker 18D is inserted into and removed from the receptacle 94D through the front of the shower outlet assembly 50D. In the illustrated construction, the flared surface 86D is provided on a flared portion 150 on the front of the speaker 18D. The back plate 54D and the front plate 58D are generally annular, and the shower outlet assembly 50D is in the shape of a relatively flatter ring (compared to the shower outlet assembly 50 shown in FIGS. 1A-1D).

The connecting structure 130D includes inter-engaging ramp surfaces 154, 158 on the speaker 18D and the showerhead 22D, respectively, engaging upon a ¼ turn. A first set of ramp surfaces 154, 158 is provided on a rim 162 of the flared portion 150 and the shower outlet assembly 50D, and a second set of ramp surfaces 154, 158 is provided on the rear of the speaker housing 106D and the front wall of the inlet chamber 102D. The speaker 18D is thus retained at both ends.

FIGS. 6-8 illustrate another alternative construction of a shower and speaker assembly 10E. The assembly 10E is similar to the assembly 10, 10A, 10B, 10C, 10D described above and shown in FIGS. 1A-1D, 2A-2D, 3A-3D, 4A-4D, 5A-5C, respectively, and the description above is referred to for common elements. Modified elements are discussed below and have the same reference number "E".

In the illustrated showerhead 22E, several common showerhead components are shown. For example (see FIGS. 6E-6F), the inlet connector 26E includes a screen washer 170 and a flow regulator 174. A holder 178, a flat ring 182 and a wave spring 186 are provided around the ball joint 34E.

The showerhead 22E also includes (see FIGS. 6E-6F and 7A-7F) a waterway assembly 190 communicating with the inlet 38E. As shown in FIG. 6E, cooperating threads 192 connect the housing 30E and the waterway assembly 190. The waterway assembly 190 includes (see FIGS. 6E and 7E-7F) outer and inner waterway members 194, 198 cooperating to define the waterway 46E and the inlet and outlet chambers 102E, 62E, respectively. The waterway members 194, 198 are connected, for example, by welding (e.g., ultrasonic), adhesive, etc., to provide a fluid tight seam.

The inner waterway member 198 includes a spray face assembly 202 providing the outlets 66E and arranged in the face plane 90E (see FIG. 6E). The spray face assembly 202 includes a soft thermoplastic elastomer (TPE) overmold and the nozzles/outlets 66E are self-cleaning.

Figure 6A:
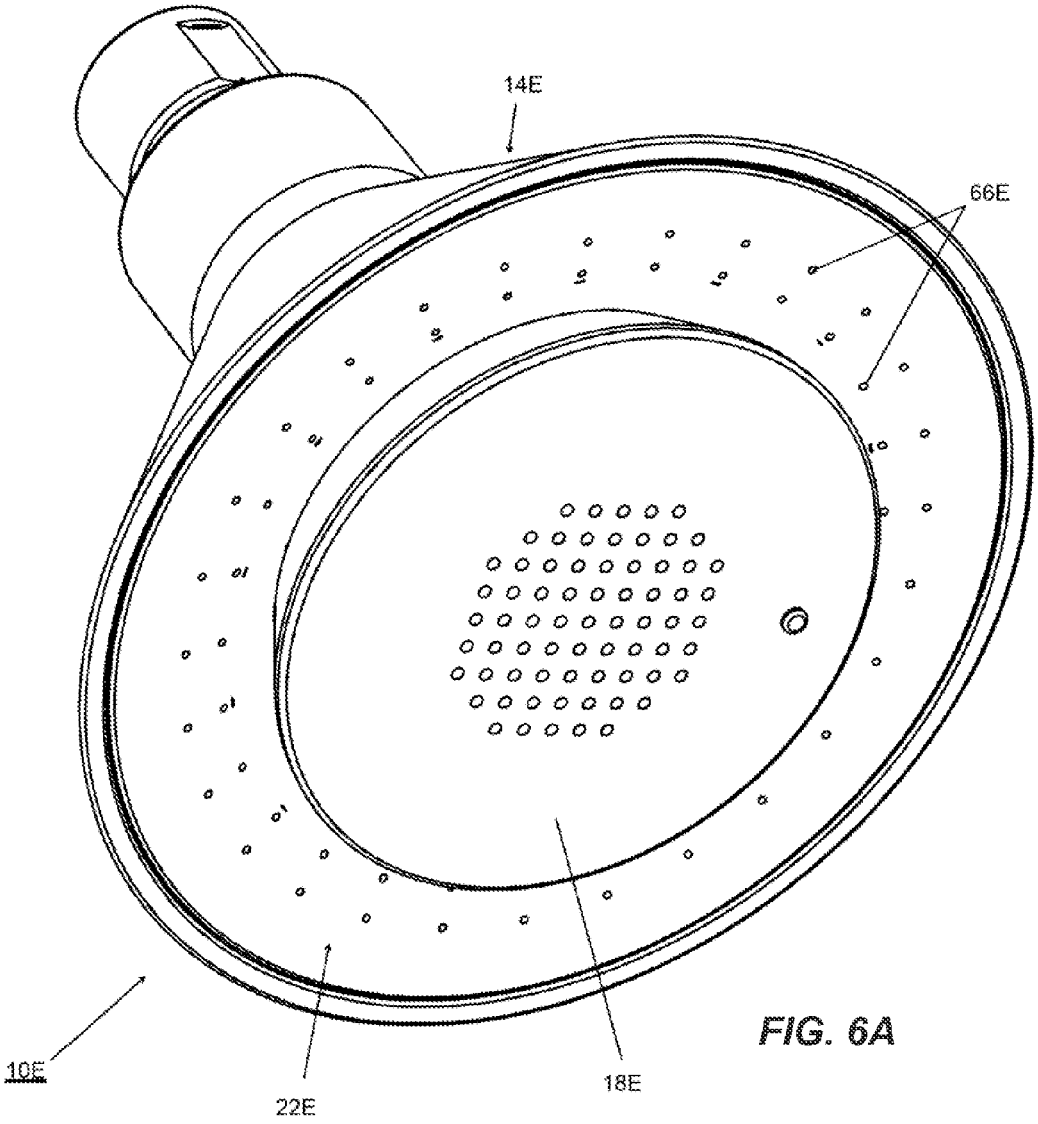
FIG. 6A is a front perspective view of another alternative construction of a shower and speaker assembly.
Figure 6B:
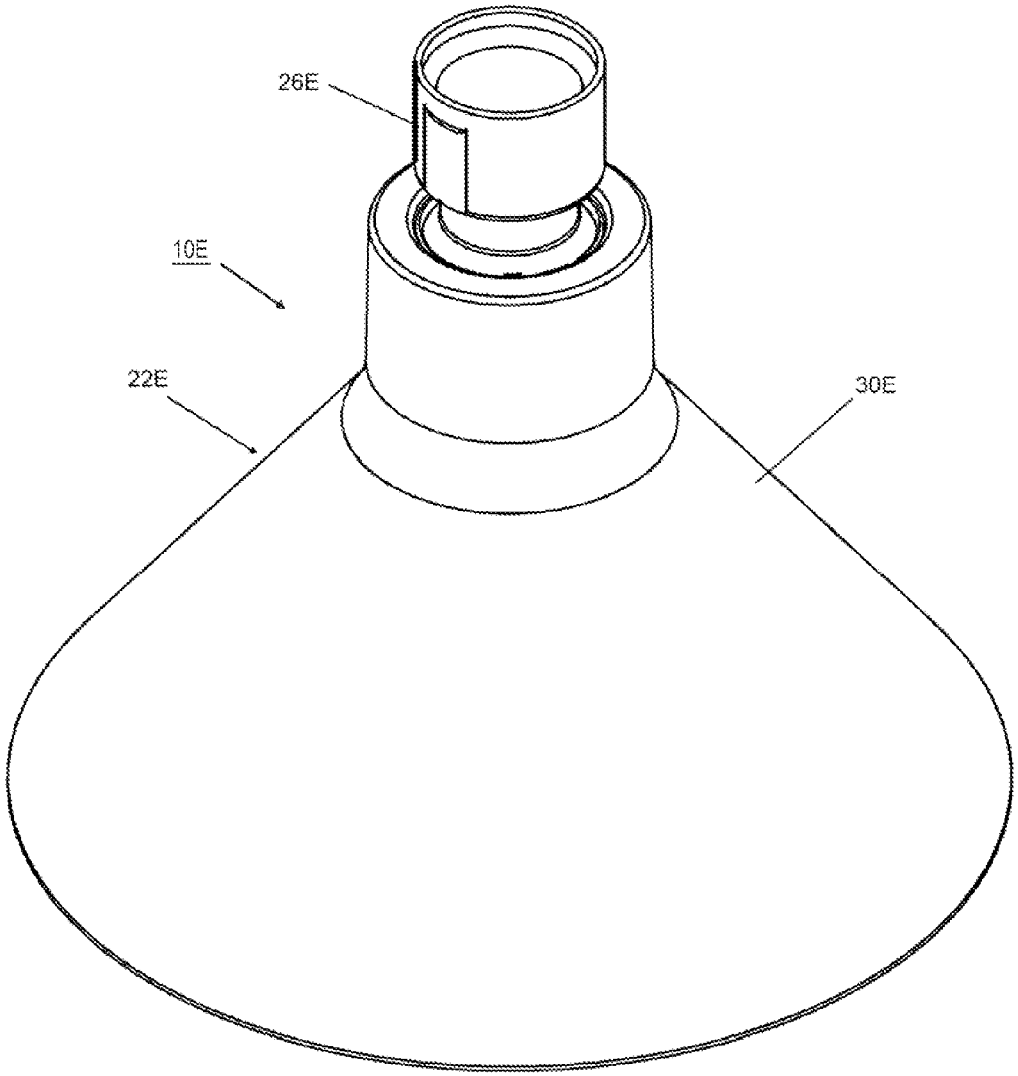
FIG. 6B is a rear perspective view of the assembly shown in FIG. 6A.
Figure 6C:
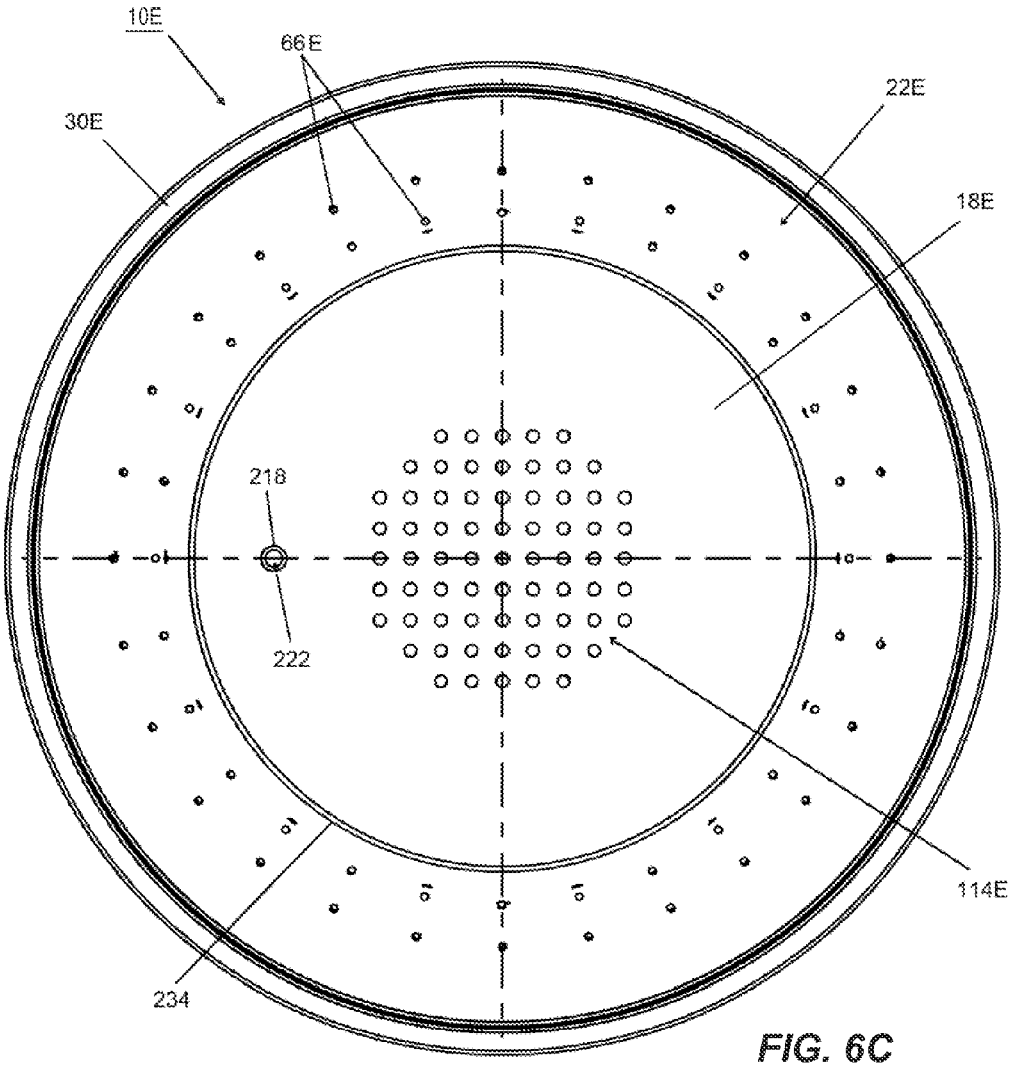
FIG. 6C is a front view of the assembly shown in FIG. 6A.
Figure 6D:
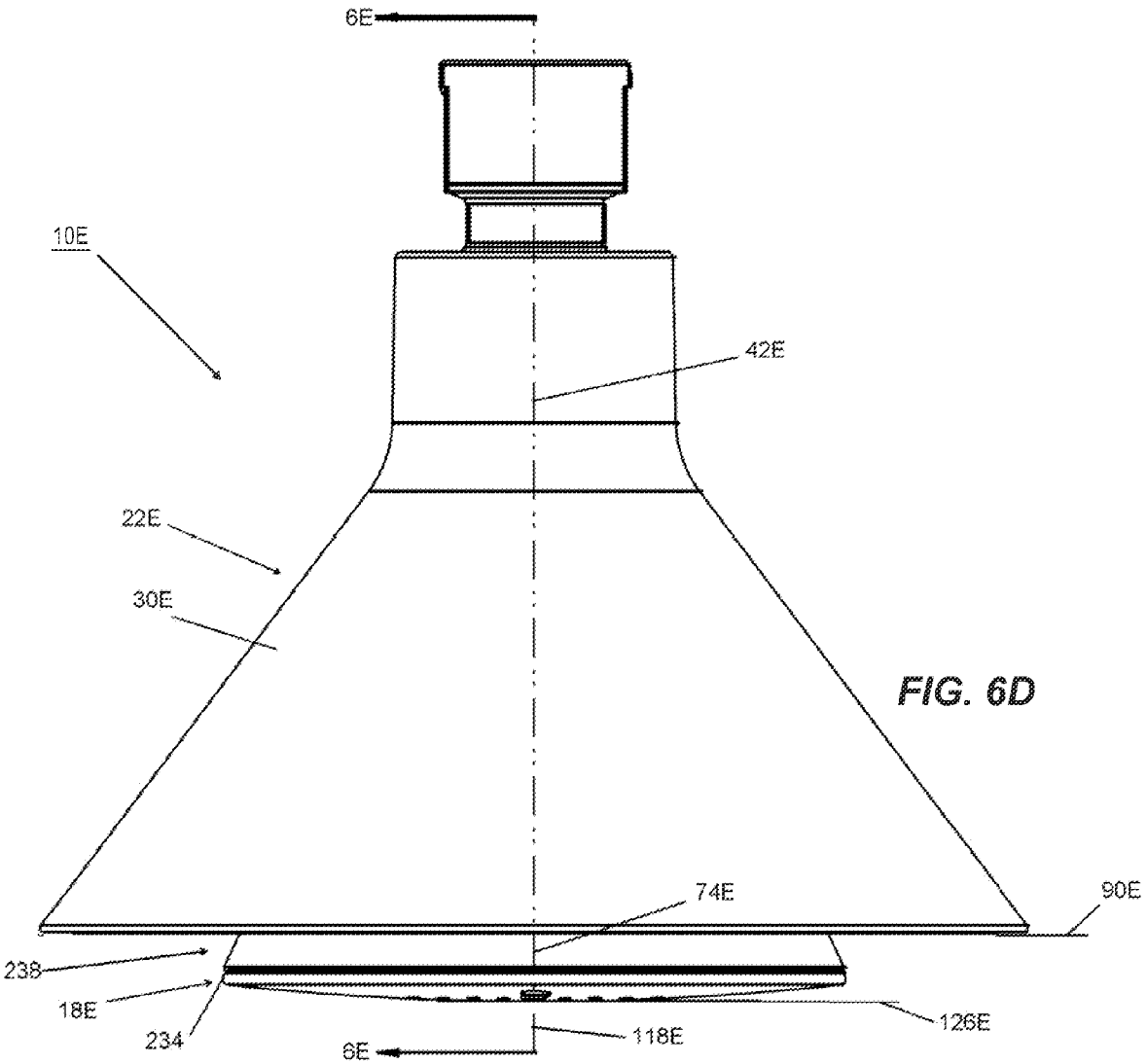
FIG. 6D is a side view of the assembly shown in FIG. 6A.
Figure 6E:
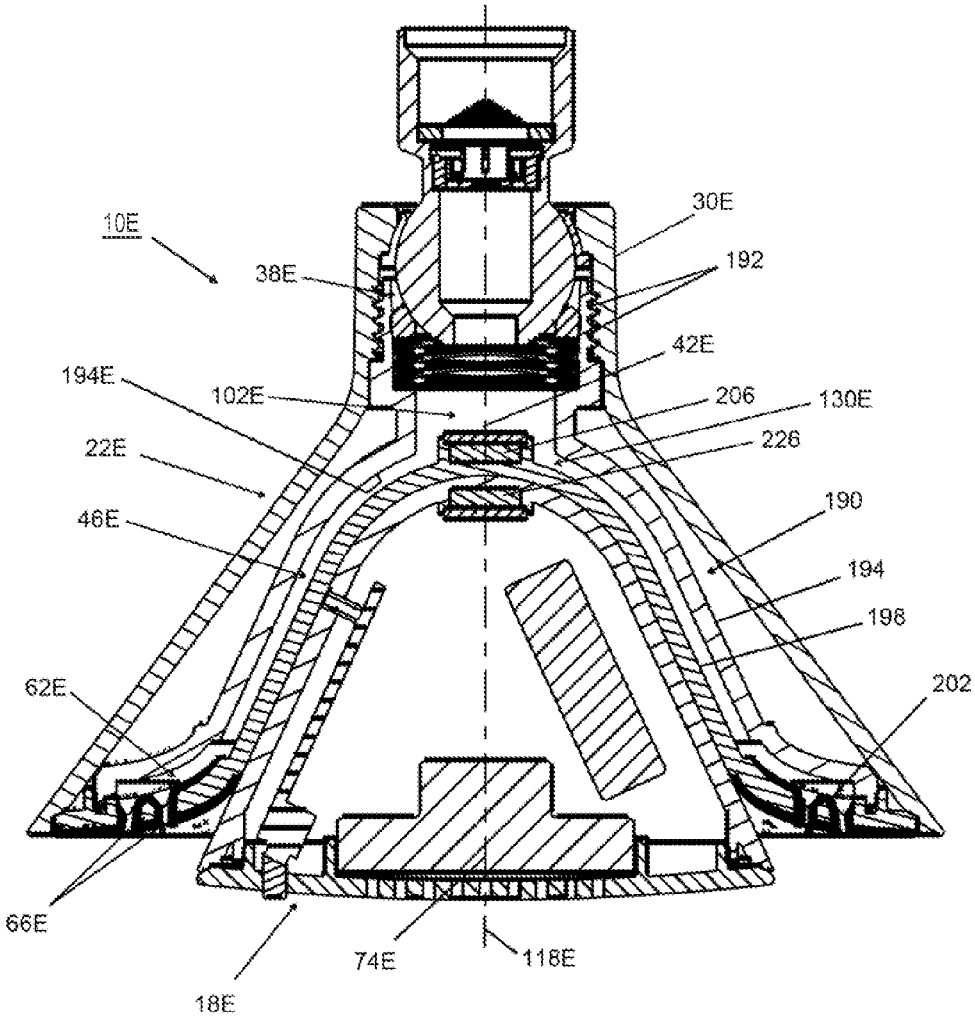
FIG. 6E is a side cross-sectional view of the assembly shown in FIG. 6A, taken generally along line 6E-6E in FIG. 6D.
Figure 6F:
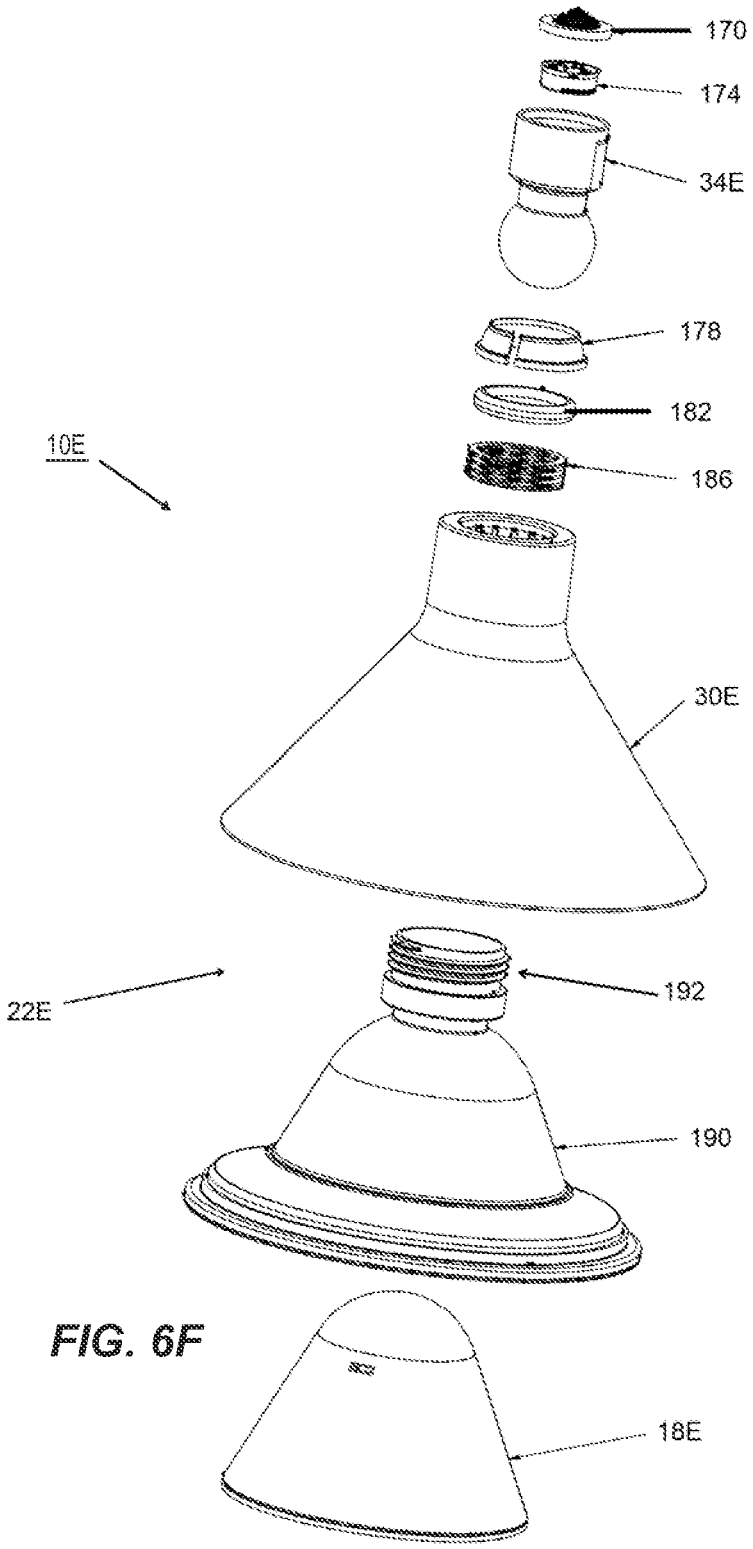
FIG. 6F is an exploded perspective view of the assembly shown in FIG. 6A.
Figure 7A:
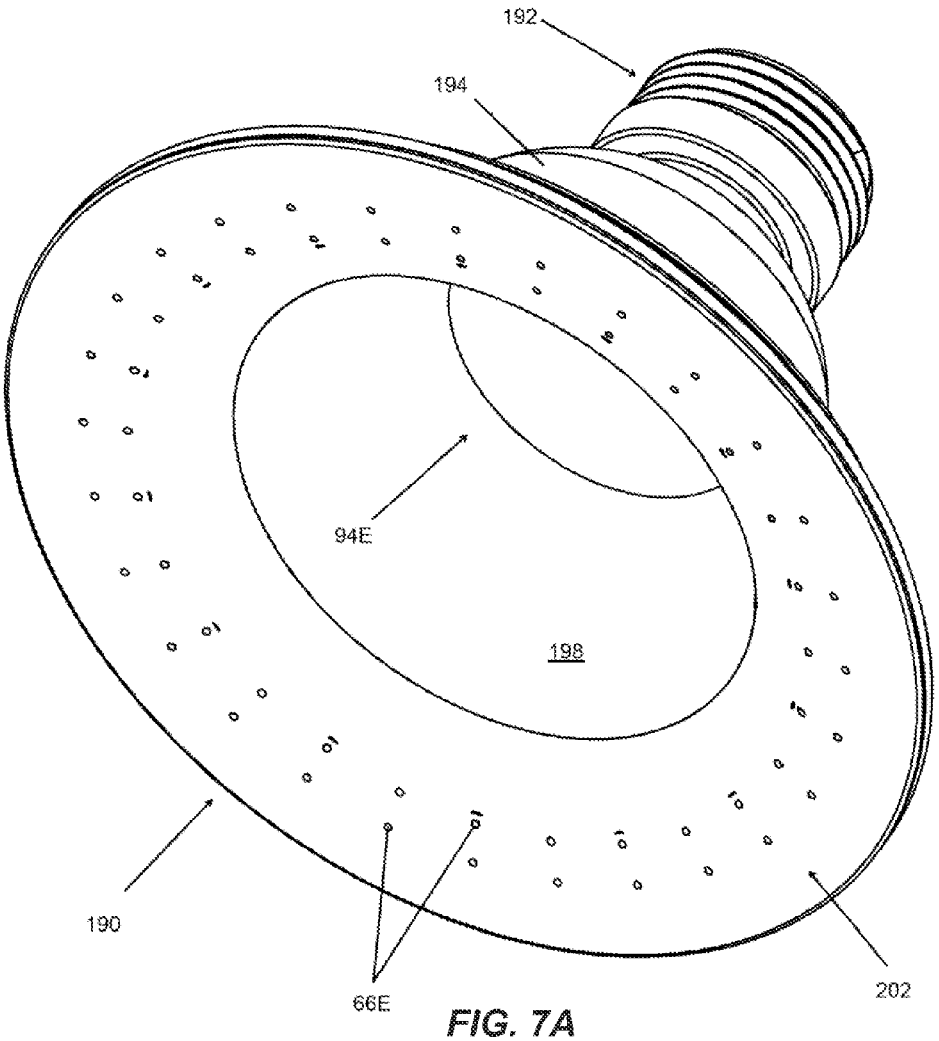
FIG. 7A is a front perspective view of the shower device shown in FIG. 6A.
Figure 7B:
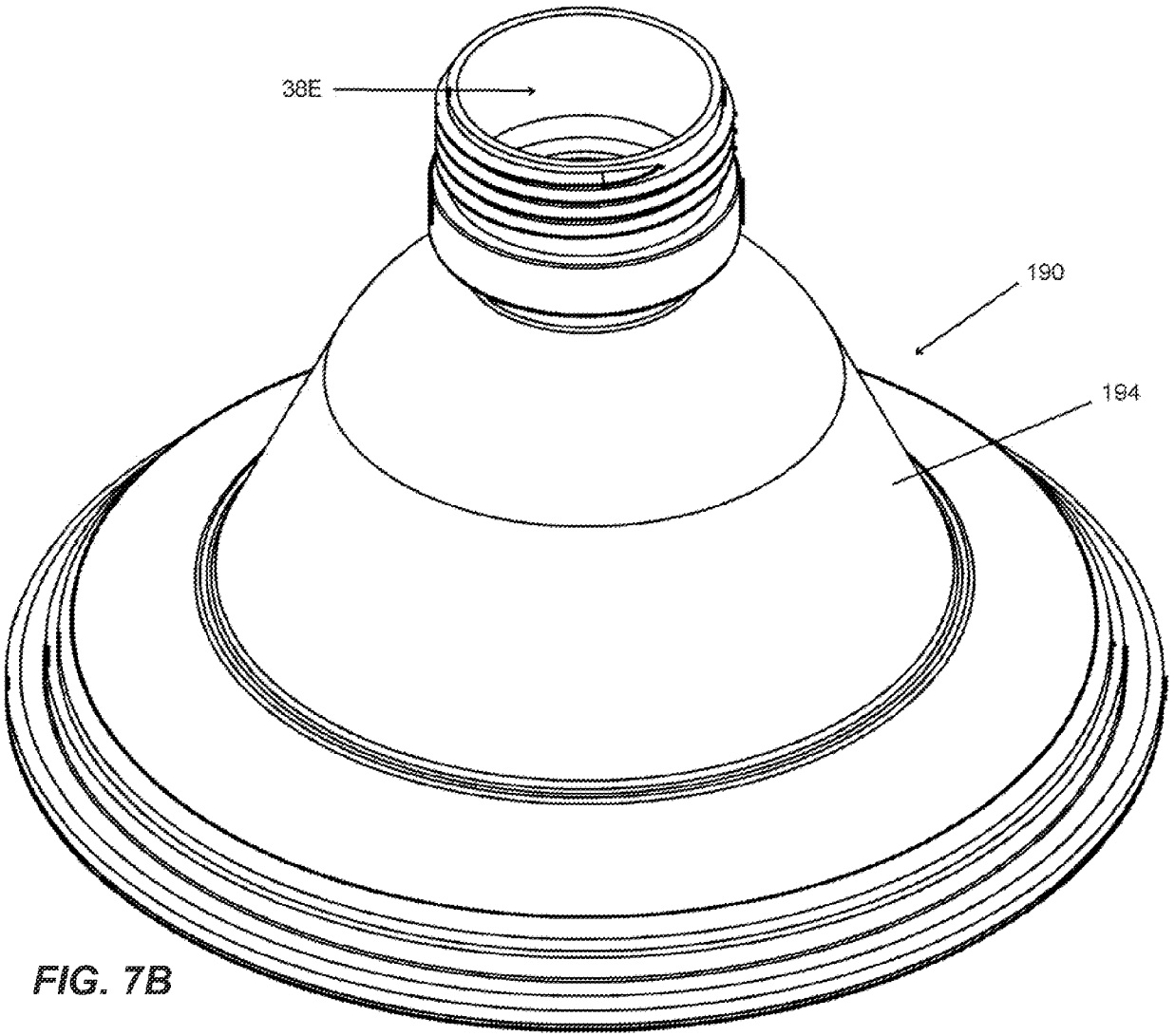
FIG. 7B is a rear perspective view of the device shown in FIG. 7A.
Figure 7C:
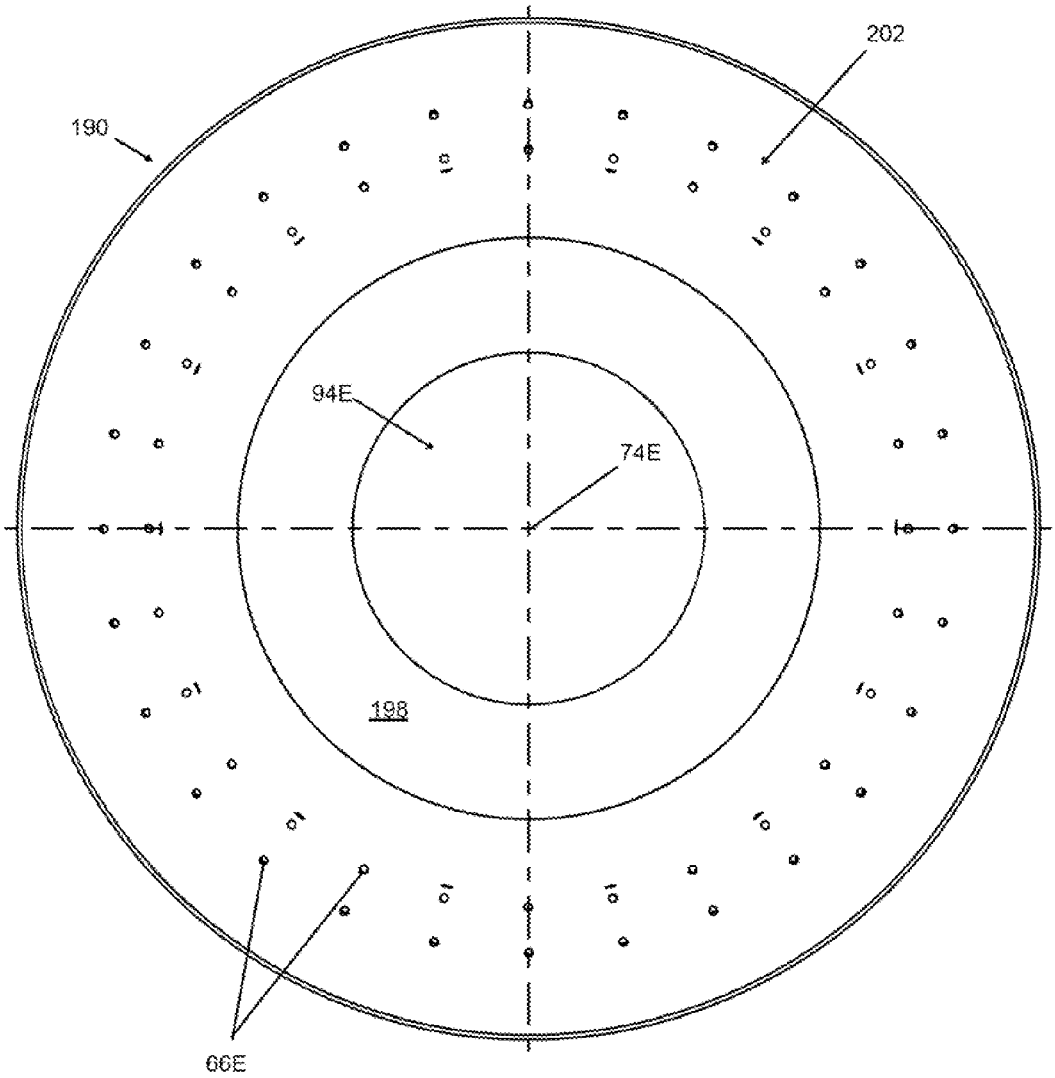
FIG. 7C is a front view of the device shown in FIG. 7A.
Figures 6E, 7D:
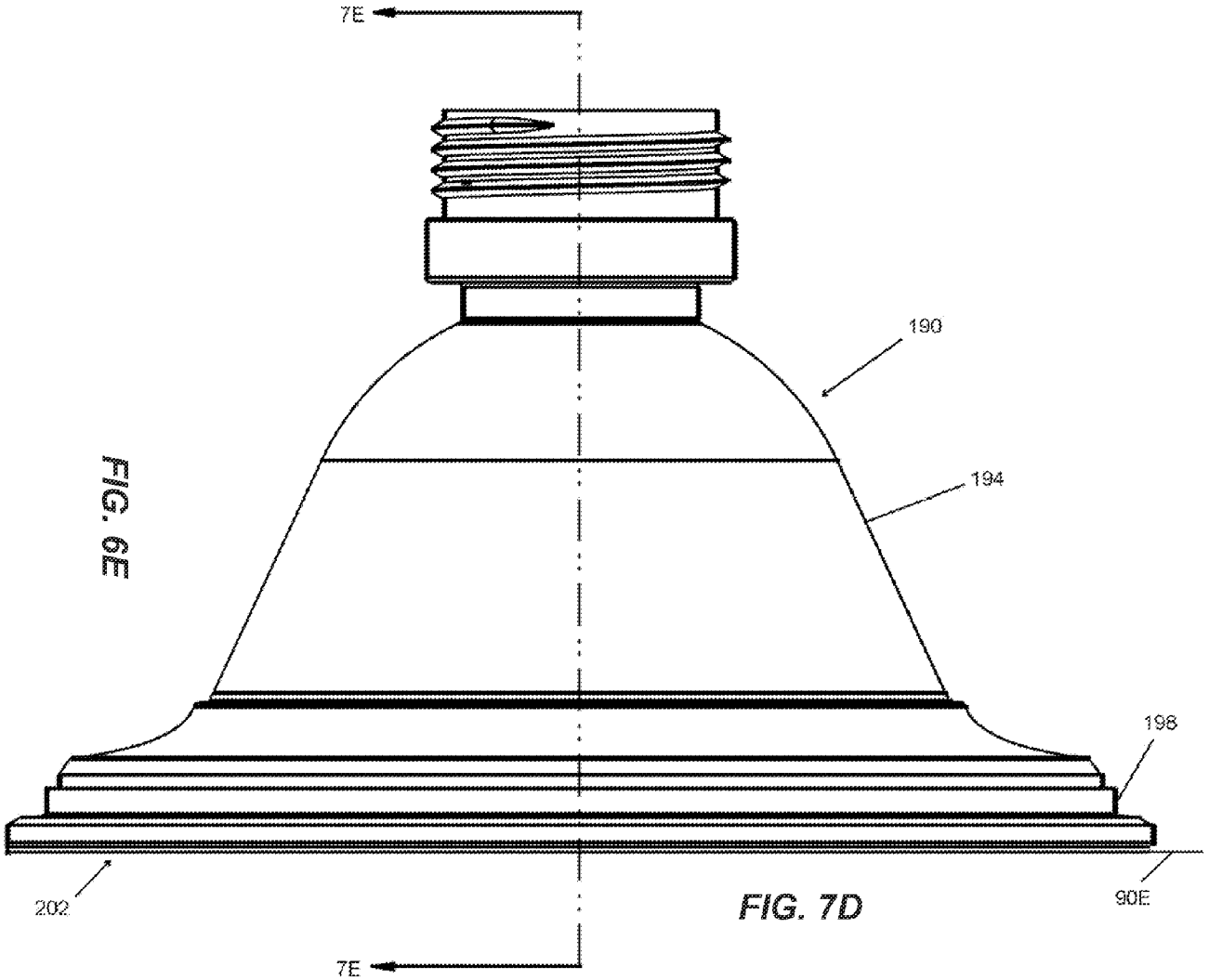
FIG. 7D is a side view of the device shown in FIG. 7A.
Figure 7E:
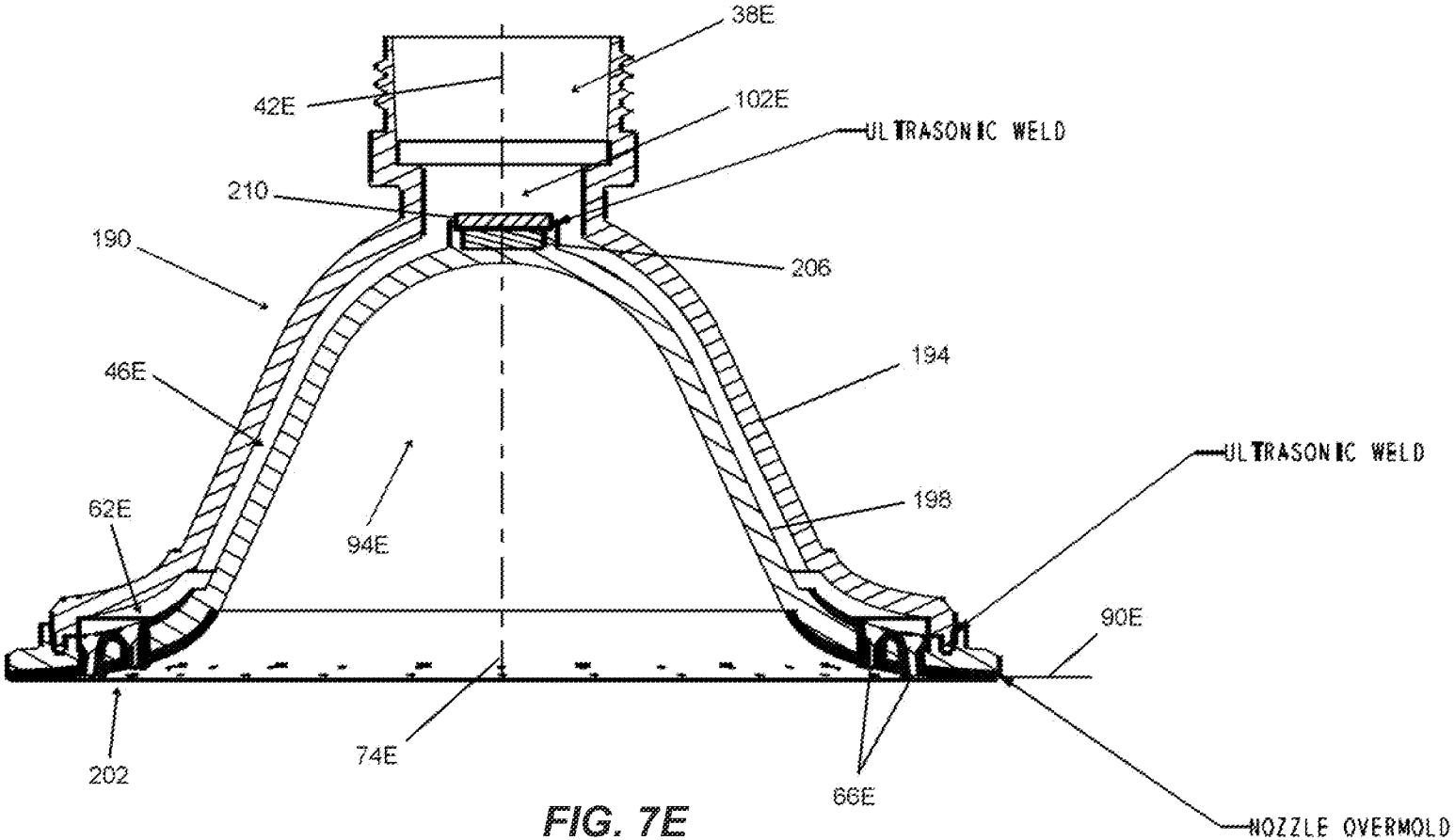
FIG. 7E is a side cross-sectional view of the device shown in FIG. 7A, taken generally along line 7E-7E in FIG. 7D.
Figure 7F:
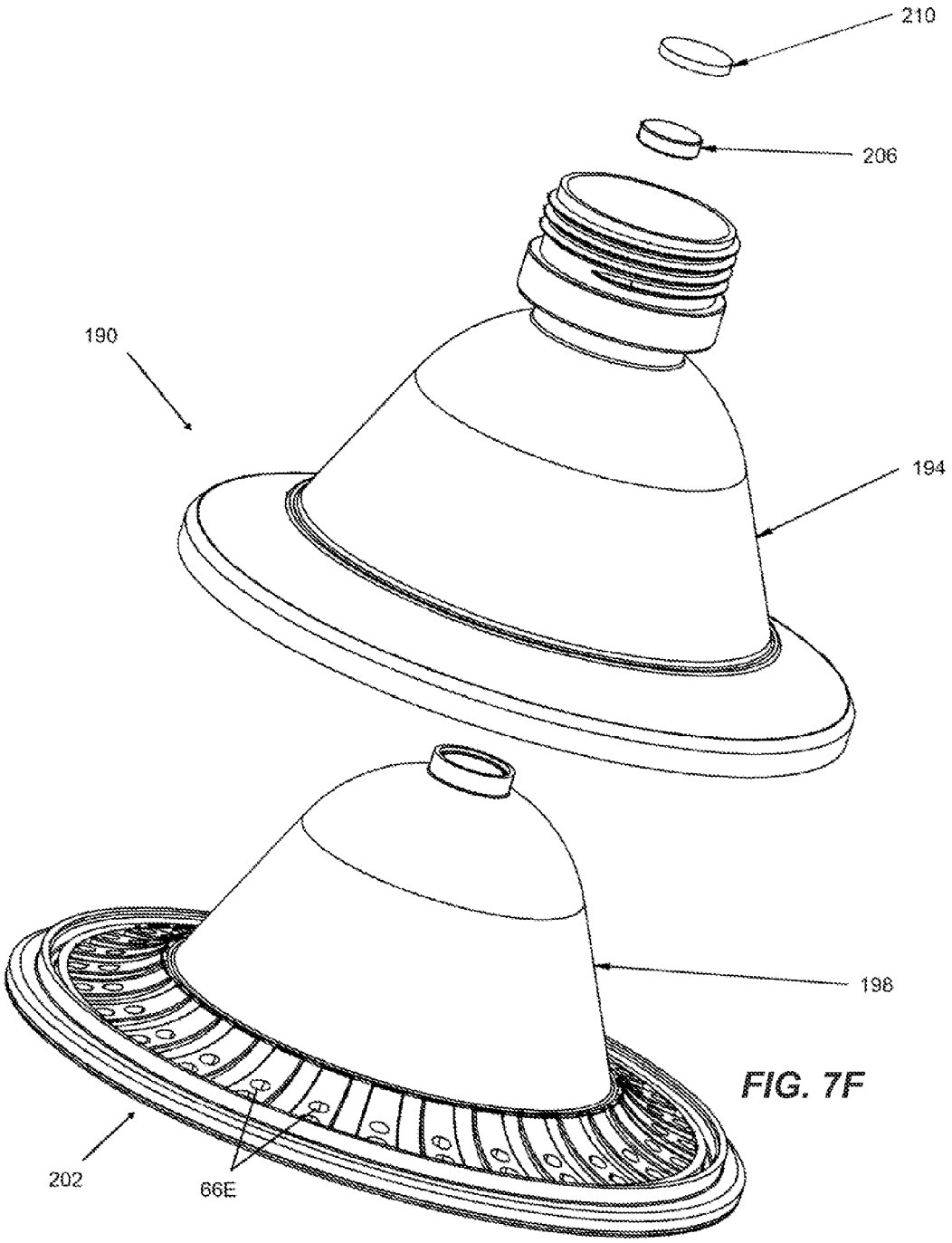
FIG. 7F is an exploded perspective view of the device shown in FIG. 7A.

As shown in FIGS. 6E and 7E-7F, a magnet 206 is supported on the showerhead 22E (e.g., in a recess on the inner waterway member 198), and a cap 210 covers the magnet 206. The illustrated magnet 206 is supported in the inlet chamber 102E, and the cap 210 is connected to the waterway member 198 to enclose the magnet 206, for example, by welding (e.g., ultrasonic), adhesive, etc., to seal the magnet 206. In other constructions (not shown), the magnet 206 may be supported in another manner (e.g., molded into the inner waterway member 198) and/or in another location on the showerhead 22E.

The illustrated speaker 18E includes a housing 106E connected to a face 212, for example, by welding (e.g., ultrasonic), adhesive, etc., to seal the speaker 18E. A screen 122E, such as the screen 122 described above, is disposed behind the face 212 and is preferably micro-etched to provide sound permeability/water impermeability. The speaker 18E also includes (see FIGS. 8E-8F) a printed circuit board (PCB) 214 connected to the speaker components 110E. The PCB 214 provides the communication components 134E and includes a port 216 (e.g., a mini-USB port) connectable to an external source (e.g., a power source (not shown) to charge the battery 138E, an audio source (not shown), etc.).

An ON/OFF switch (e.g., button 218) operates the speaker component 110E, and an indicator 222 (e.g., a LED; see FIGS. 6C, 8A and 8C) lights to indicate that the speaker 18E is "ON". In the illustrated construction, the indicator 222 is incorporated into the button 218.

In other constructions (see FIGS. 13A-13D), the speaker 18 also includes input components (e.g., control buttons 224) to control operation of the remote source. In such a construction, the communication components 134 provide two-way communication between the speaker 18 and the remote source.

Figure 8A:
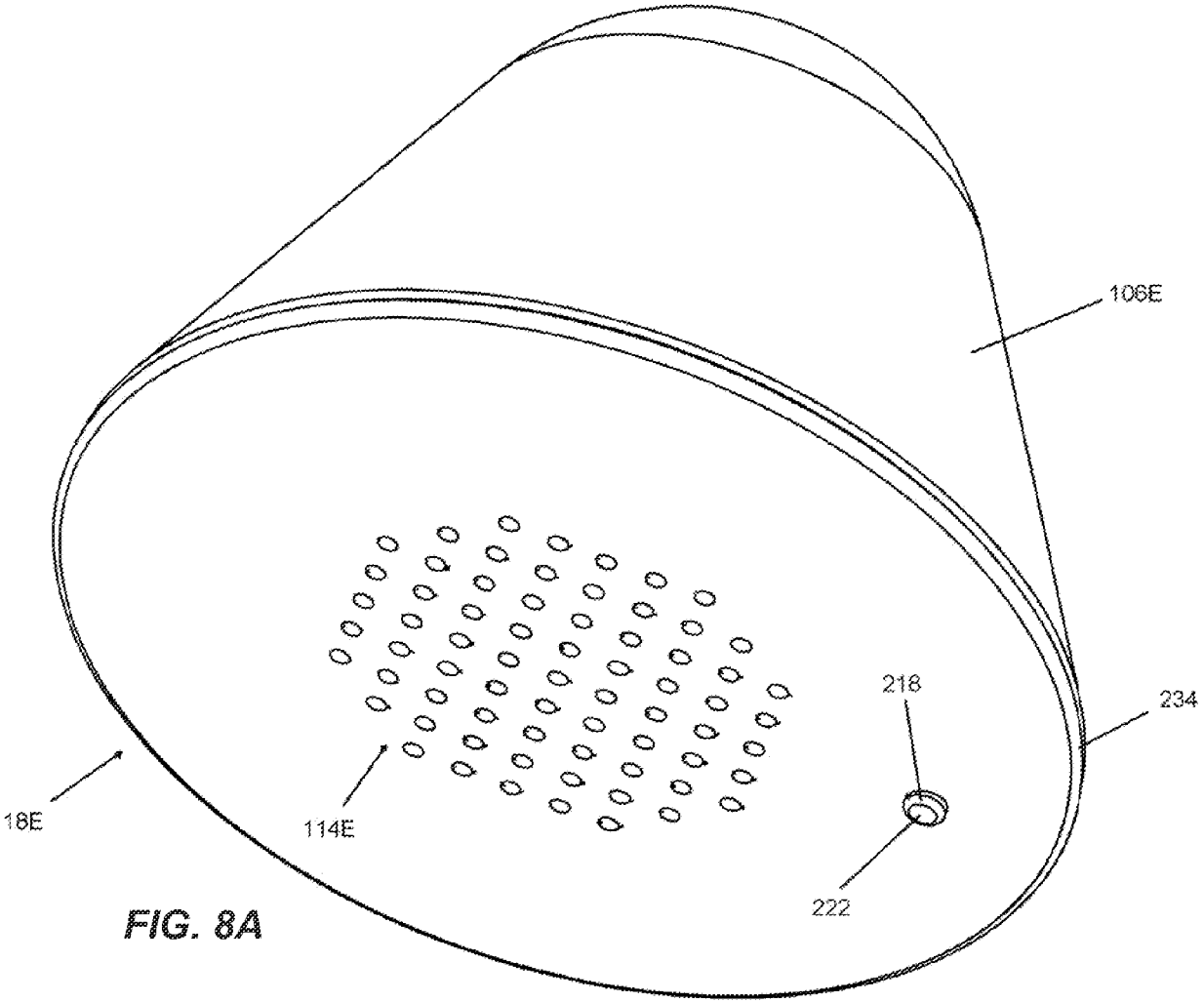
FIG. 8A is a front perspective view of a speaker assembly shown in FIG. 6A.
Figure 8B:
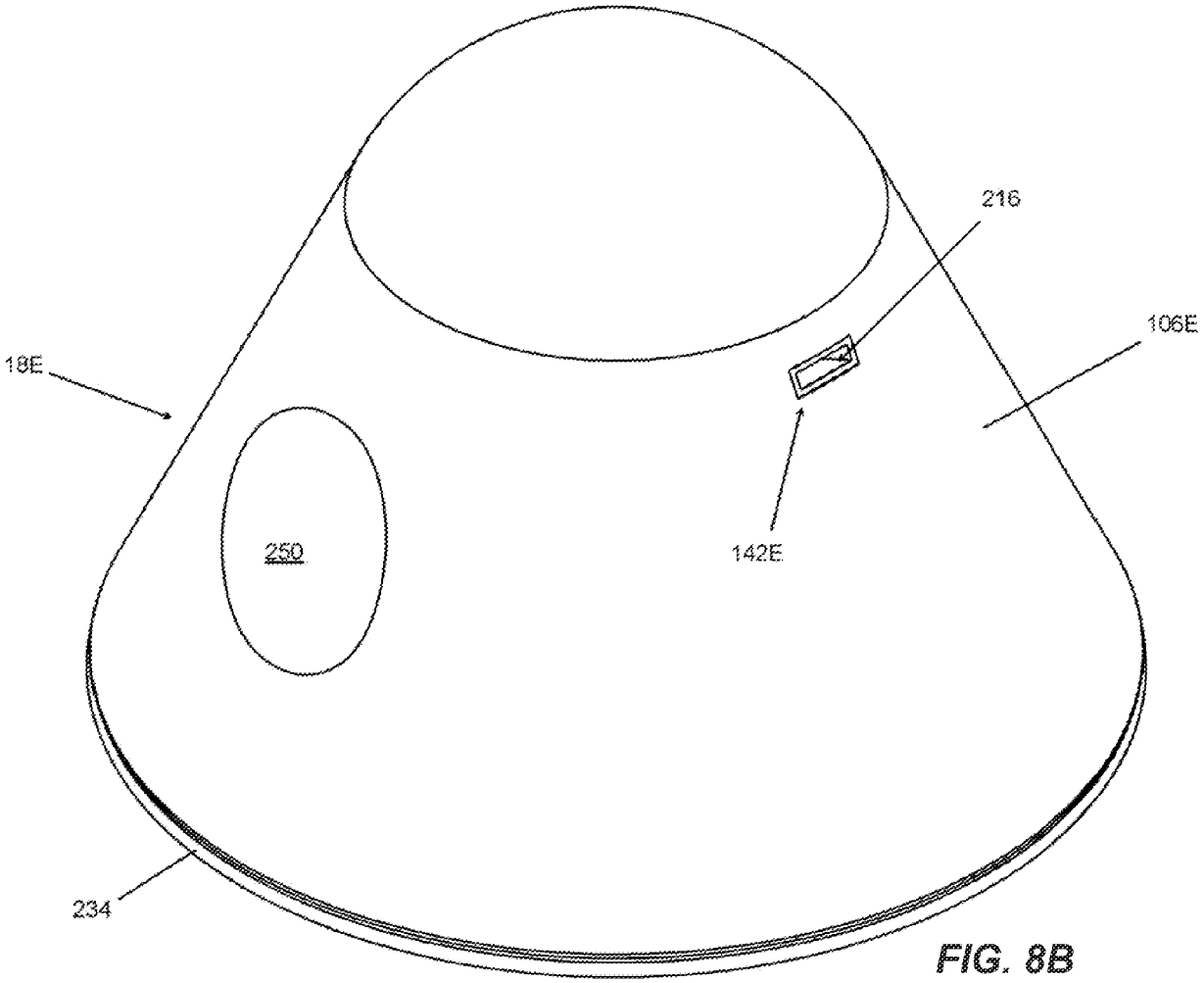
FIG. 8B is a rear perspective view of the assembly shown in FIG. 8A.
Figure 8C:
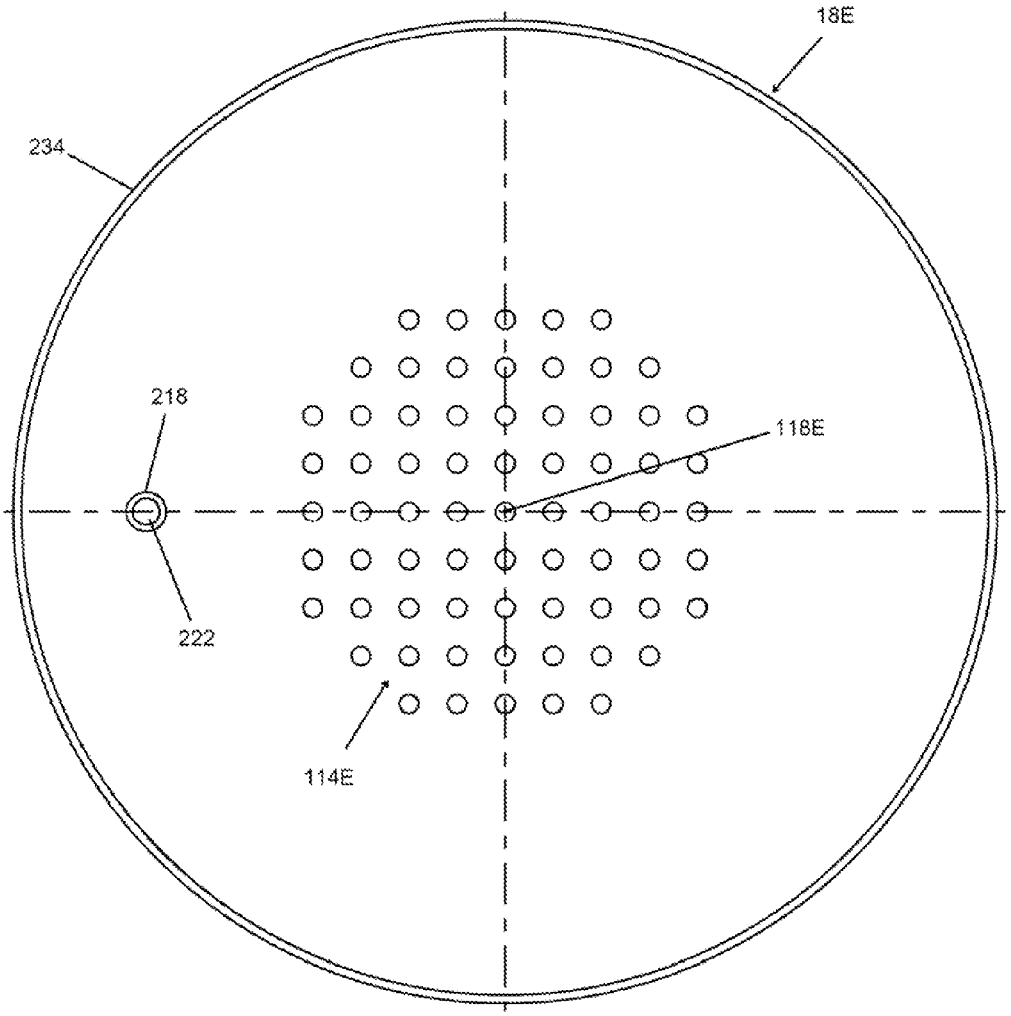
FIG. 8C is a front view of the assembly shown in FIG. 8A.
Figure 8D:
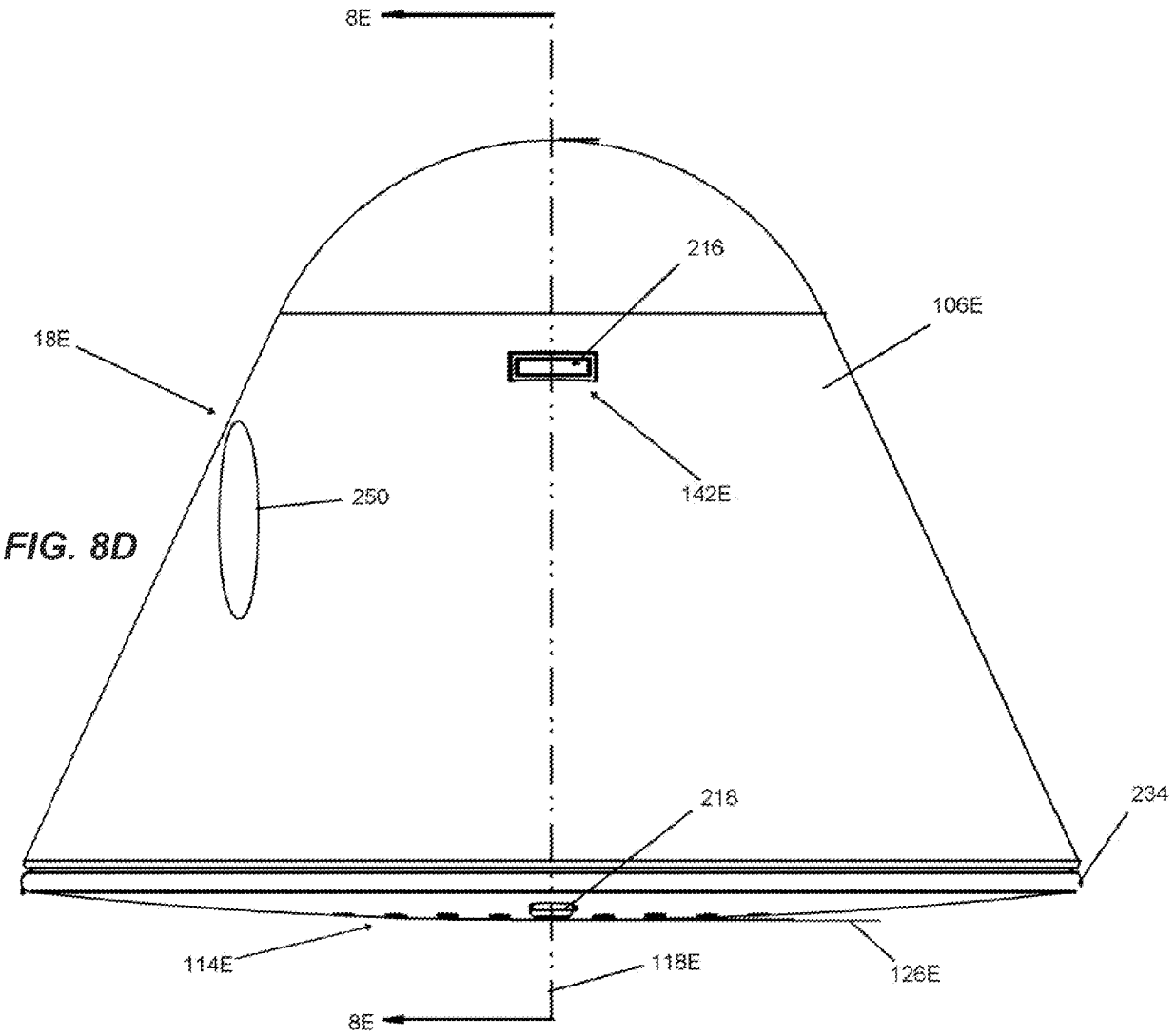
FIG. 8D is a side view of the assembly shown in FIG. 8A.
Figure 8E:
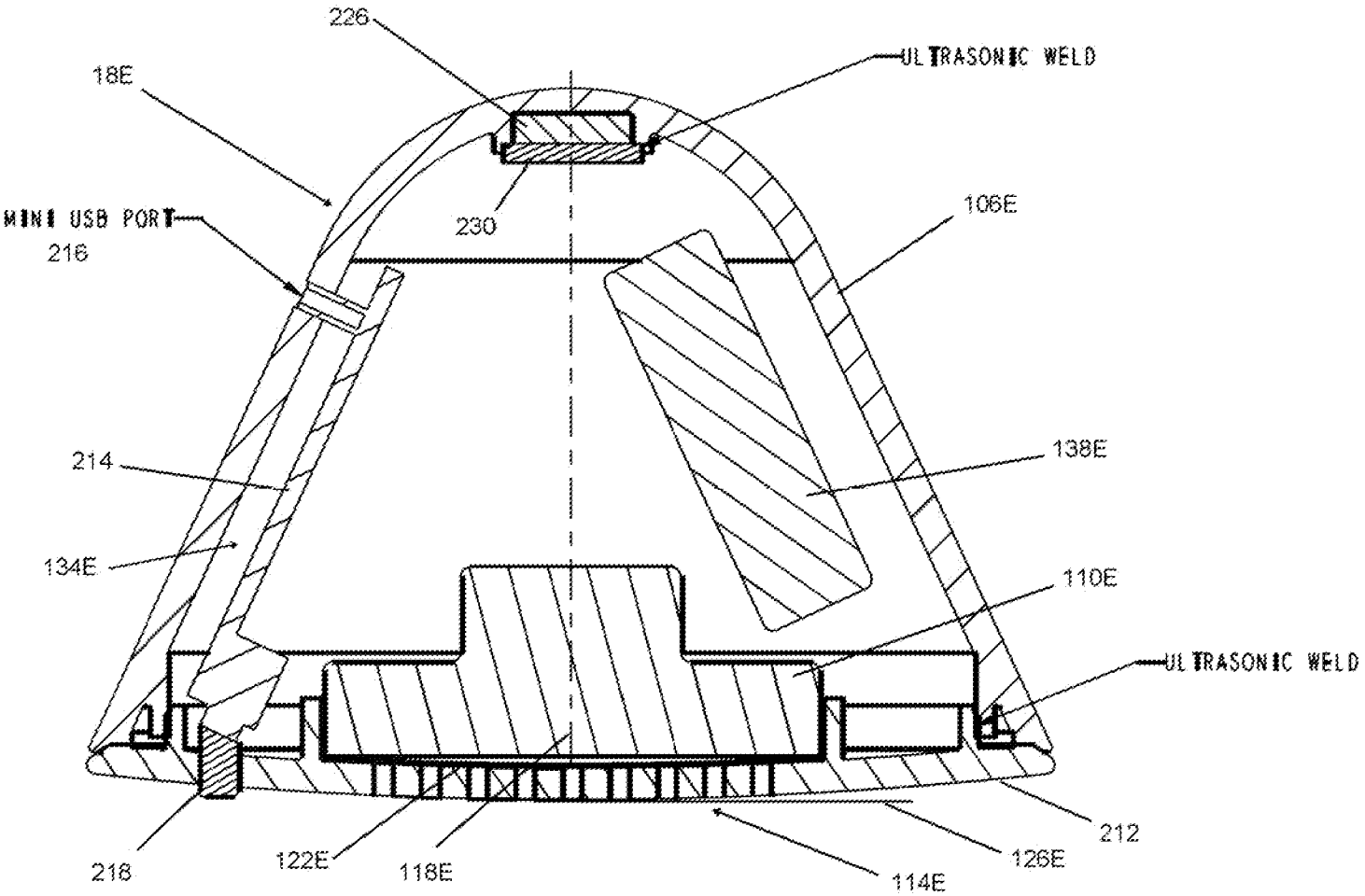
FIG. 8E is a side cross-sectional view of the assembly shown in FIG. 8A, taken generally along line 8E-8E in FIG. 8D.
Figure 8F:
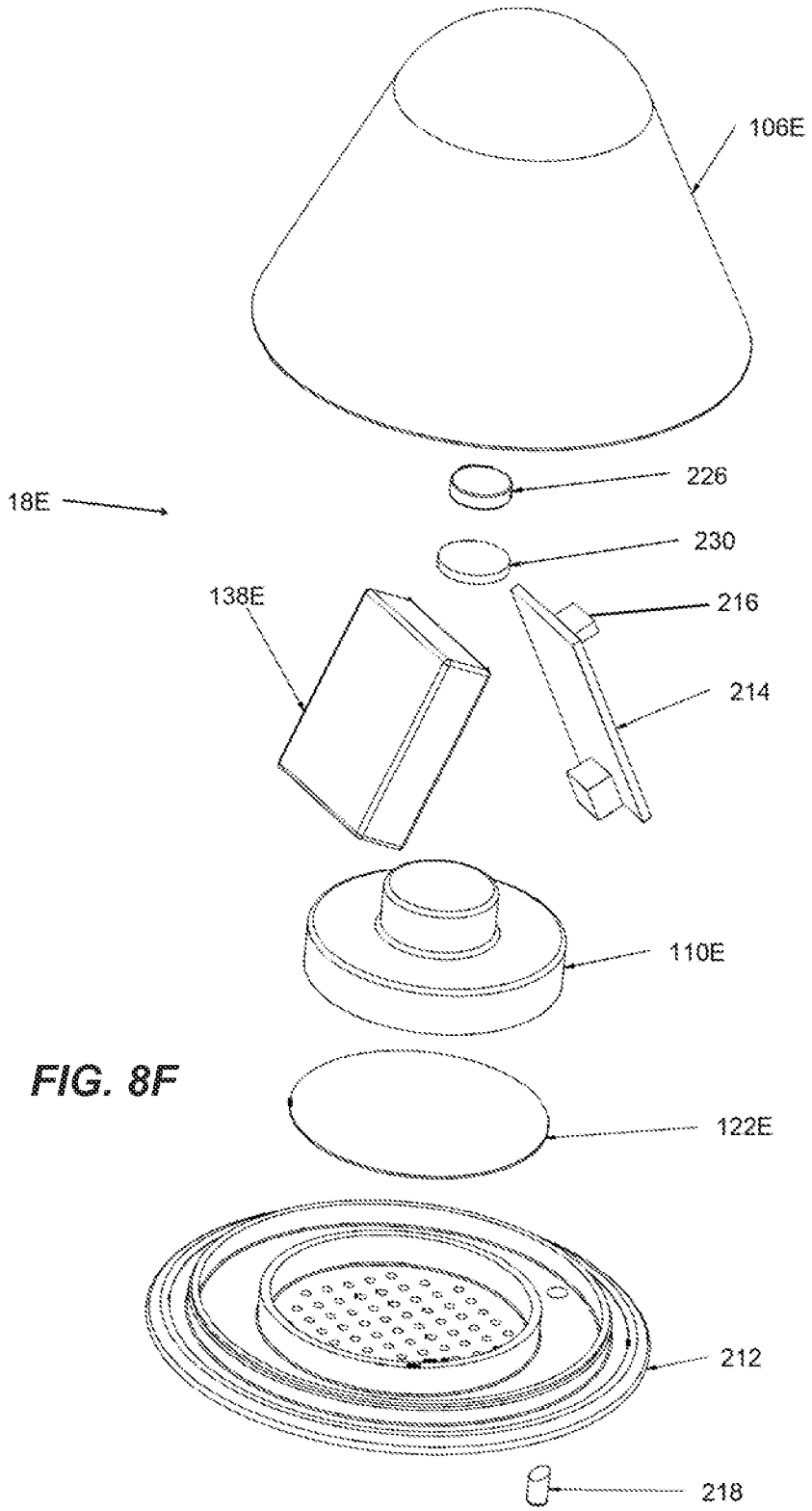
FIG. 8F is an exploded perspective view of the assembly shown in FIG. 8A.

As shown in FIGS. 8E-8F, a magnet 226 is supported on the housing 106E, and a cap 230 covers the magnet 226. The cap 230 is connected to the housing 106E to enclose the magnet 230 in the housing 106E, for example, by welding (e.g., ultrasonic), adhesive, etc.

The waterway members 194, 198 include cooperating recesses to provide the receptacle 94E. In the assembly 10E, the speaker 18E is inserted into and removed from the receptacle 94E through the front of the showerhead 22E. In the illustrated construction, the waterway 46E is annular and extends around the receptacle 94E. Water enters the showerhead 22E and is directed to the inlet chamber 102E behind the speaker 18E. Water flows from the shower inlet 38E to the shower outlets 66E and is diverted around the speaker 18E.

As shown in FIGS. 6D-6E (and in FIGS. 13-16), the speaker 18E projects from the showerhead 22E so that the speaker plane 126E is positioned forwardly of the plane 90E of the spray face 202. In other constructions (see FIGS. 17-18), the planes 126, 90 are generally aligned. In still other constructions (see, for example, FIGS. 1-5 and 19), the speaker plane 126 is recessed from faceplate plane 90. Acoustic analysis of the shower and speaker assembly 10 indicates that the "best" sound production of the speaker 18 is achieved without any geometry of the showerhead 22 (e.g., the flared surface 86 of the face plate 58) applied to the speaker 18, in other words, with the speaker plane 126 aligned with or positioned forwardly of the shower outlet plane 90.

As shown in FIGS. 6B and 6D-6F, the illustrated showerhead housing 30E is generally conical. In other constructions, the showerhead 22 may have a different shape, such as, for example, cup-shaped, semi-spherical (see FIGS. 13 and 19), bell-shaped (see FIGS. 14-15), cylindrical (see FIGS. 16-18), etc. As shown in FIGS. 6F, 8A-8B and 8D-8F, the illustrated speaker 18E is also generally conical. In other constructions, the speaker 18 may have a different shape, such as, for example, bell-shaped (see FIGS. 13-16), cylindrical (see FIGS. 17-18), etc. The receptacle 94 has a shape which is complementary to the shape of the speaker 18 (e.g., a generally conical receptacle 94E is shown in FIG. 7E). The receptacle 94 and speaker 18 preferably have symmetry about the output axis 118 of the speaker such that the speaker can be supported in the receptacle 94E in a plurality of rotational orientations.

The illustrated connecting structure 130E provides a magnetic docking arrangement. In the illustrated construction, the showerhead 22E and the speaker 18E include cooperating magnets 206, 226 to releasably retain the speaker 18E on the showerhead 22E.

In other constructions (not shown), rather than a magnet, one of the showerhead 22E and the speaker 18E may include another type of magnetic element (e.g., an element formed of a ferromagnetic material, etc.) which is attracted to the remaining magnet. In still other constructions (not shown), the magnet(s) 206, 226 may be positioned in a different location on the showerhead 22E and/or on the speaker 18E.

The speaker 18E is arranged to provide a grip surface (the rim 234) so that a user can overcome the force of the connecting structure 130E to remove the speaker 18E from the showerhead 22E. A space 238 is provided between the rim 234 and the spray face assembly 202 to enable user to grasp the speaker housing 106E. In the illustrated construction (see FIG. 6D), the space 238 is an axial space because the speaker 18E projects from the showerhead 22E.

In constructions in which the speaker 18 is aligned with or recessed into the showerhead 22, an annular space may be provided so that the rim 234 may be gripped. Still other arrangements may be provided to allow access to the speaker 18. For example (see FIGS. 17A-17E), a recess or opening 242 is provided on the showerhead 22 to allow access to rim 234 of the speaker 18. In other constructions, portions of the speaker housing 106 may extend beyond the spray face 202. For example, as shown in FIGS. 18A-18E, wings 246 on the speaker 18 project to the radial edge of showerhead 22. In other constructions (not shown), the speaker 18 may include a material (e.g., elastomeric) and/or shape(s) (e.g., scallop shape) providing an improved grip surface.

The pattern of the showerhead outlets 66 and of the face of the speaker 18 may be coordinated. In the illustrated construction (see FIGS. 6A, 6C, 7A, 7C), the outlets 66E are arranged in a generally uniform two-hole pattern for universal nesting of the speaker 18E in the showerhead 22E.

As shown in FIGS. 8B and 8D, a stop feature, such as a "flat" 250, is molded on speaker housing 106E to prevent the speaker 18E from moving (e.g., rolling) when supported on a flat surface (e.g., in use on a countertop, during charging, etc.). The speaker 18E may have another stop feature shape (e.g., a two-dot pattern texture (not shown), raised ridges 252 (see FIGS. 13-16)) on the housing 106E acting in a similar manner.

As shown in FIGS. 13A-13D, the assembly 10 may include a light source 254 which emits light from the receptacle 94 around the speaker 18. In the construction shown in FIGS. 13A-13D, the light source 254 is supported on the speaker housing 106 and reflects out of the receptacle 94.

FIGS. 9-12 illustrate another alternative construction of a shower and speaker assembly 10F. The assembly 10F is similar to the assembly 10, 10A, 10B, 10C, 10D, 10E described above and shown in FIGS. 1A-1D, 2A-2D, 3A-3D, 4A-4D, 5A-5C, 6-8, respectively, and the description above is referred to for common elements. Modified elements are discussed below and have the same reference number "F".

The showerhead 22F includes (see FIGS. 9D-9E and 10A-10H) a waterway assembly 190F communicating with the inlet 38F. The waterway assembly 190F includes (see FIGS. 9D and 10A-10E) outer and inner waterway members 194F, 198F cooperating to define the waterway 46F and the inlet and outlet chambers 102F, 62F, respectively. The waterway members 194F, 198F are connected, for example, by welding (e.g., ultrasonic), adhesive, etc., to provide a fluid tight seam.

The inner waterway member 198F provides a sprayface member defining openings 260. The waterway assembly 190F also includes a nozzle member 264 with nozzles 268, at least some of which have barbs 272. The nozzle member 264 provides the outlets 66F arranged in the face plane 90F (see FIG. 9D). The nozzle member 264 may be formed as a soft thermoplastic elastomer (TPE), and the nozzles/outlets 66F may be self-cleaning.

Figure 9A:
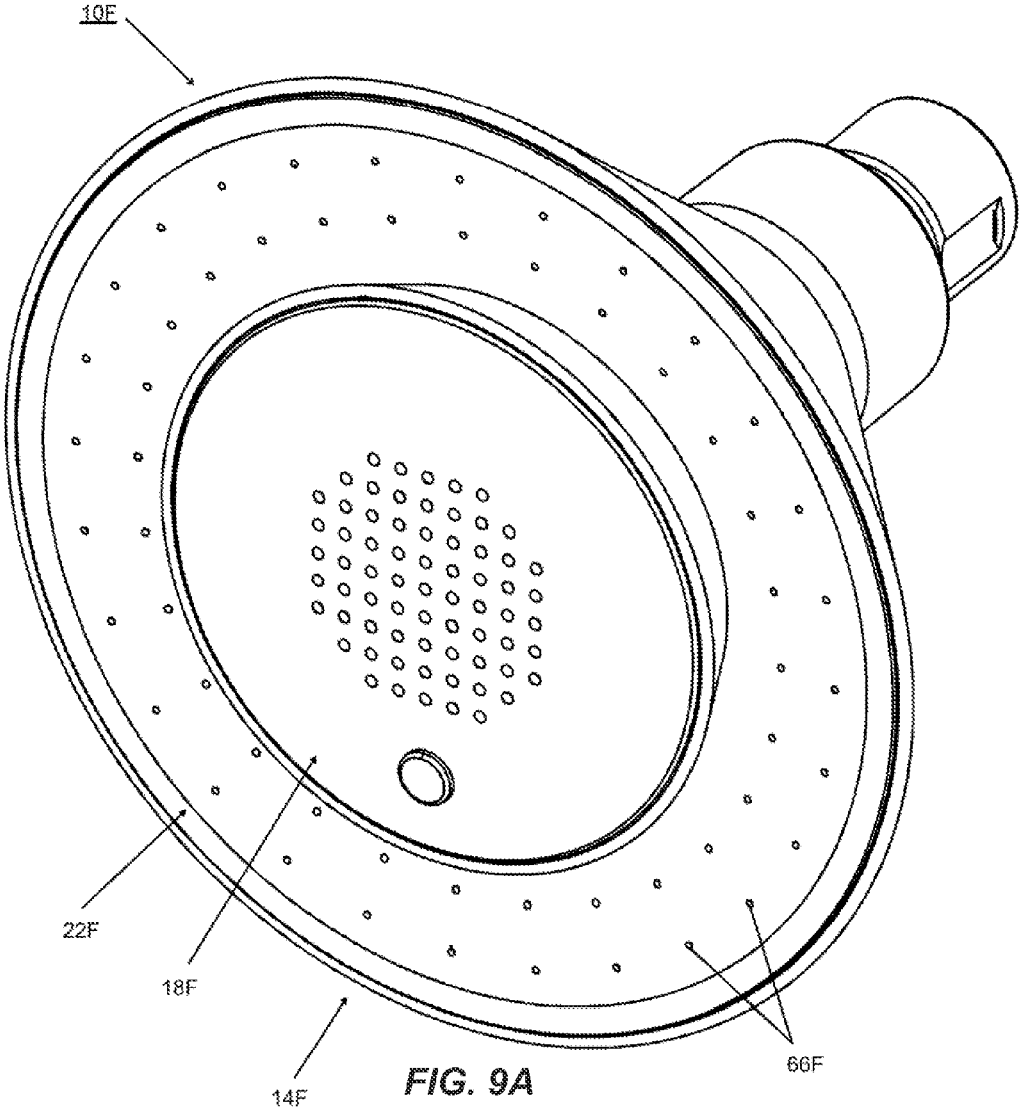
FIG. 9A is a front perspective view of a yet another alternative construction of a shower and speaker assembly.
Figure 9B:
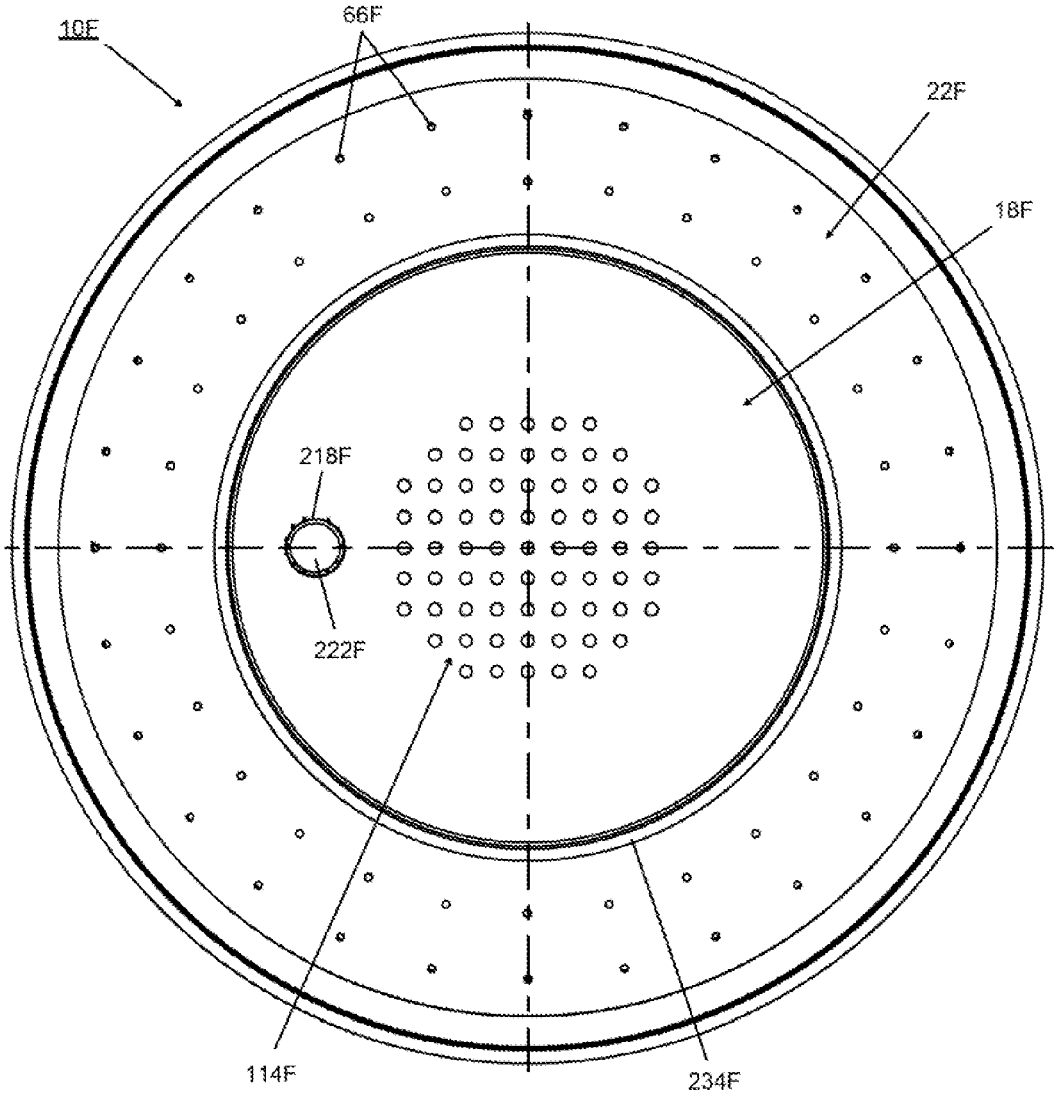
FIG. 9B is a front view of the assembly shown in FIG. 9A.
Figure 9C:
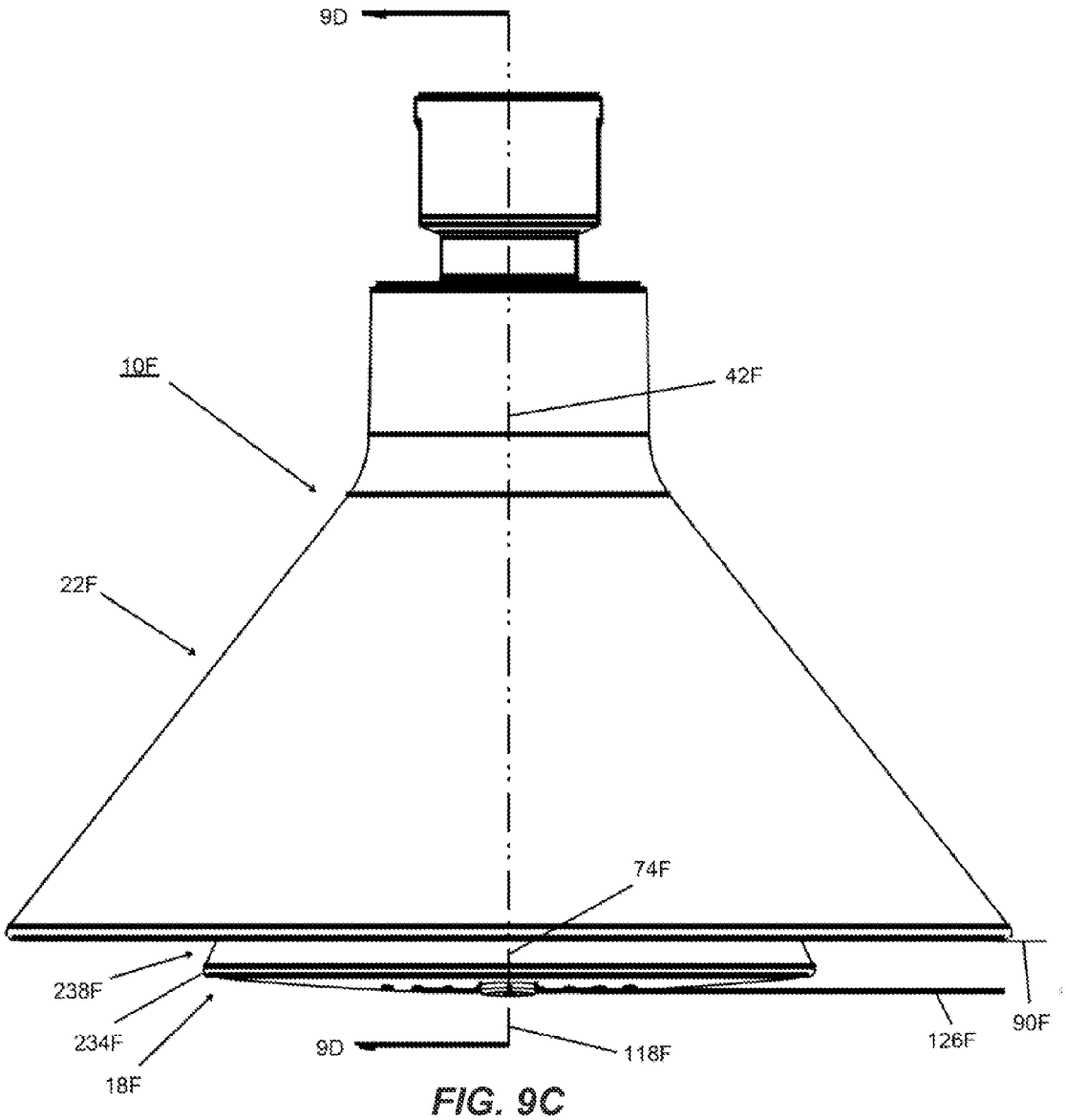
FIG. 9C is a side view of the assembly shown in FIG. 9A.
Figure 9D:
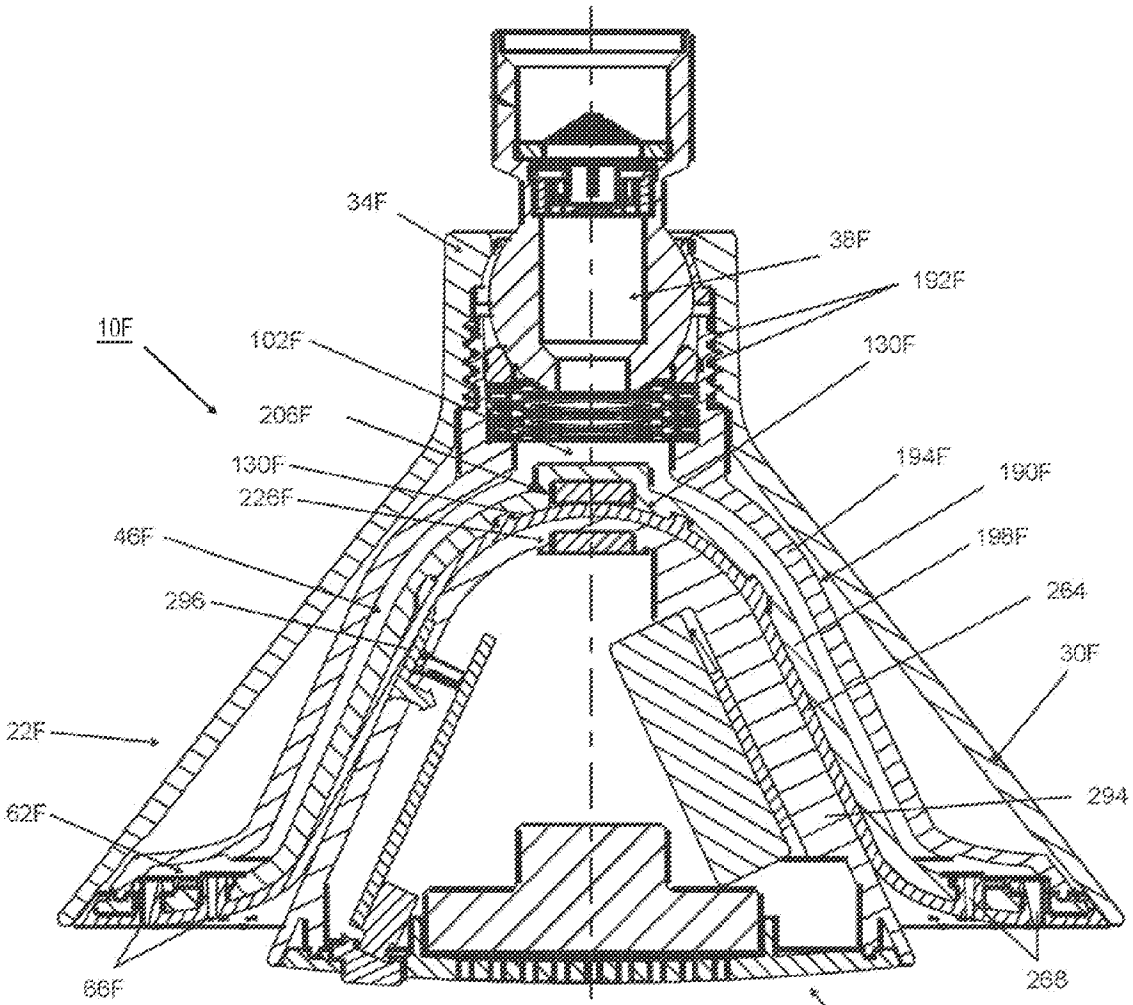
FIG. 9D is a side cross-sectional view of the assembly shown in FIG. 9A, taken generally along line 9D-9D in FIG. 9C.

Each nozzle 268 is received in a corresponding opening 260, and, as shown in FIG. 9D, the barbs 272 engage the inner waterway member 198F to connect the members 198F, 264. Also, in the illustrated construction, the edge 276 of the nozzle member 264 wraps around the edge 280 of the inner waterway member 198F. Ridges 284 on the outer surface of the nozzle member 264 fit in corresponding grooves 288 in the inner waterway member 198F. Additional or alternative connecting arrangements (e.g., adhesive, welding, etc.) may also be provided to connect and/or seal the members 198F, 264.

Figure 9E:
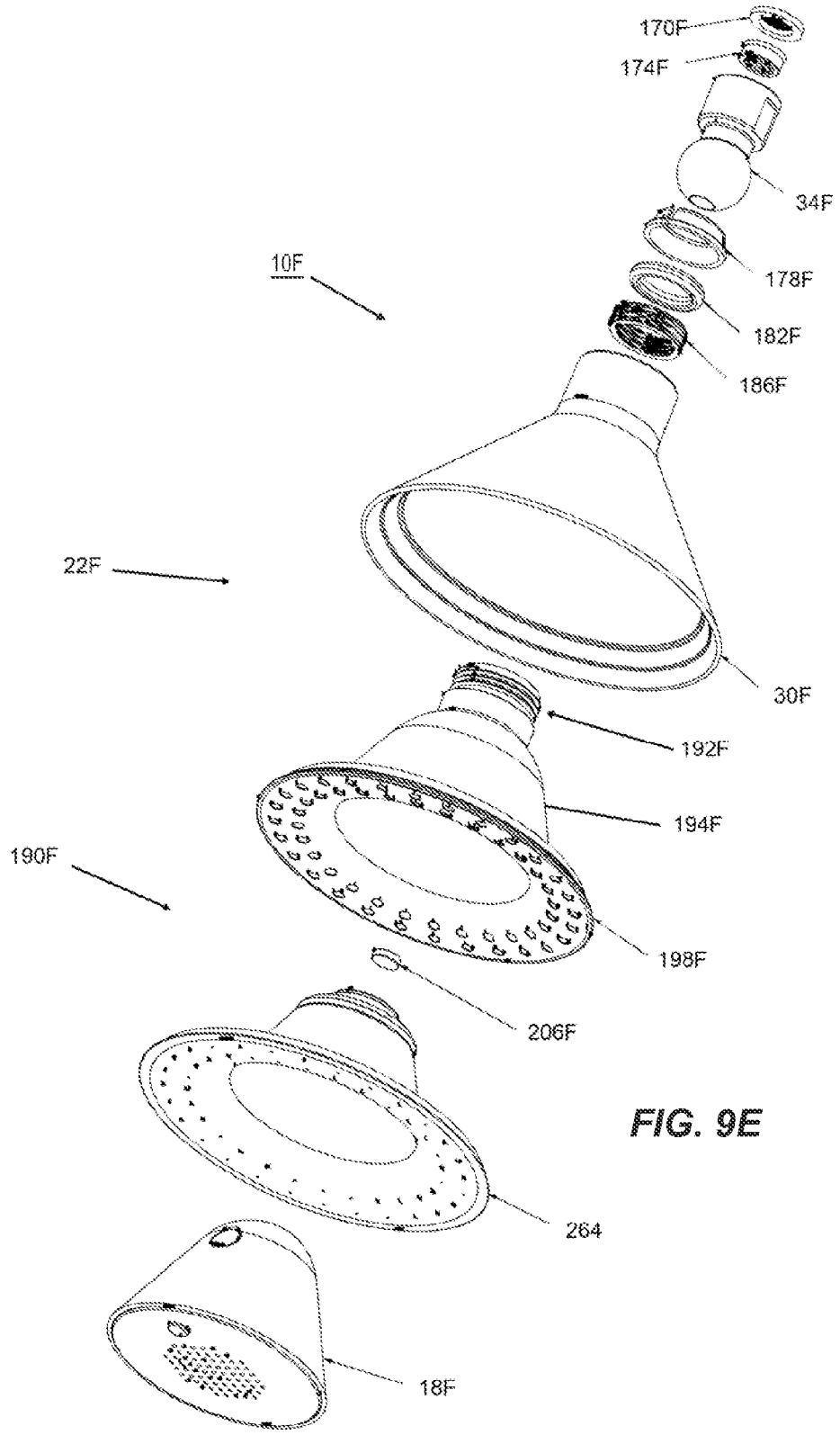
FIG. 9E is an exploded perspective view of the assembly shown in FIG. 9A.
Figure 10A:
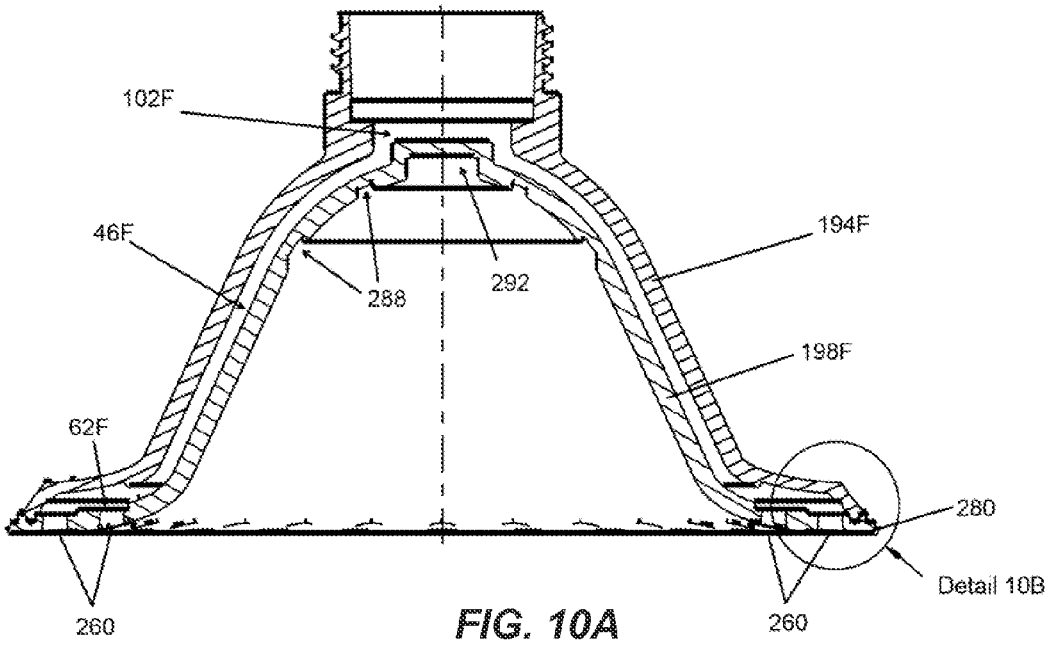
FIG. 10A is a side cross-sectional view of a waterway of the shower device shown in FIG. 9F, with generally the same view as FIG. 9D.
Figure 10B:
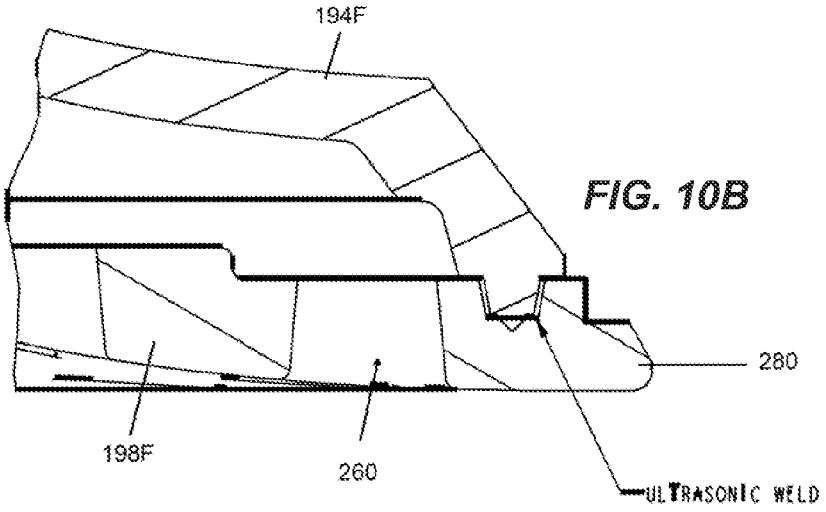
FIG. 10B is an enlarged portion of the waterway shown in FIG. 10A.
Figure 10C:
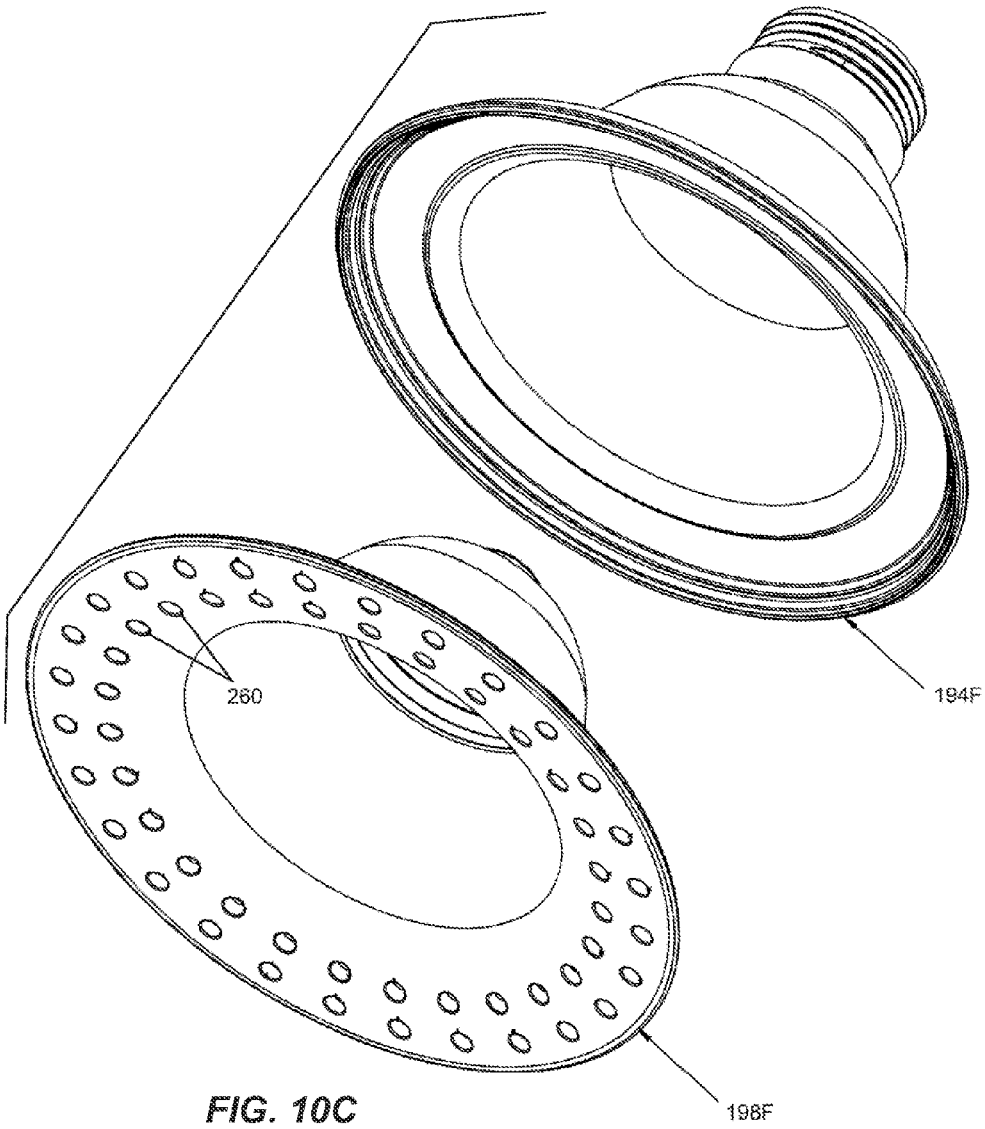
FIG. 10C is an exploded perspective view of the waterway shown in FIG. 10A.
Figure 10E:
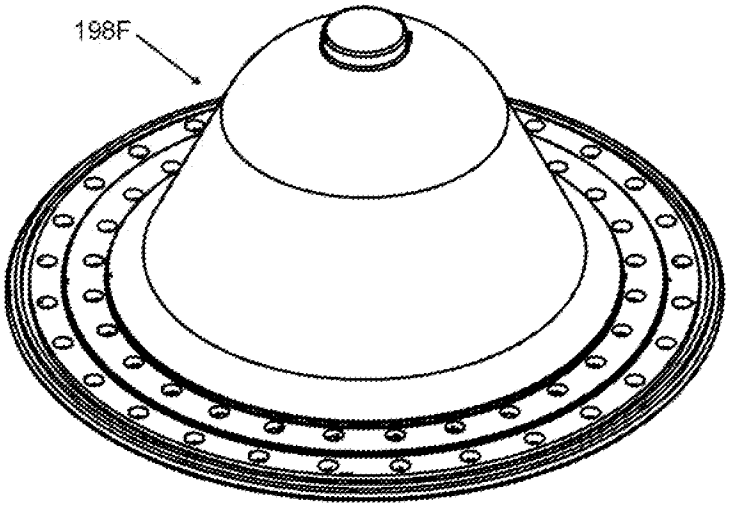
FIG. 10E is a rear perspective view of the sprayface shown in FIG. 10D.
Figure 10D:
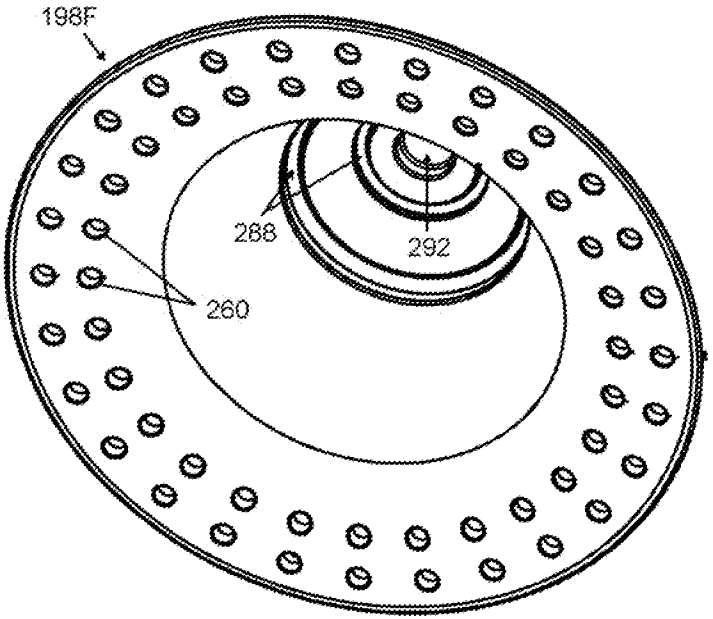
FIG. 10D is a front perspective view of the sprayface of the shower device shown in FIG. 9F.
Figure 10G:
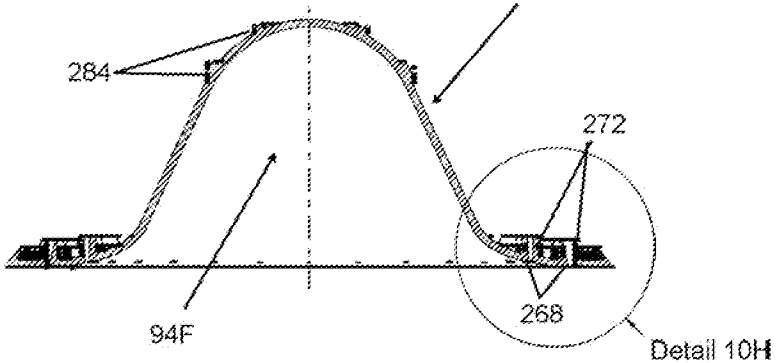
FIG. 10G is a side cross-sectional view of the nozzle portion shown in FIG. 10D.
Figure 10F:
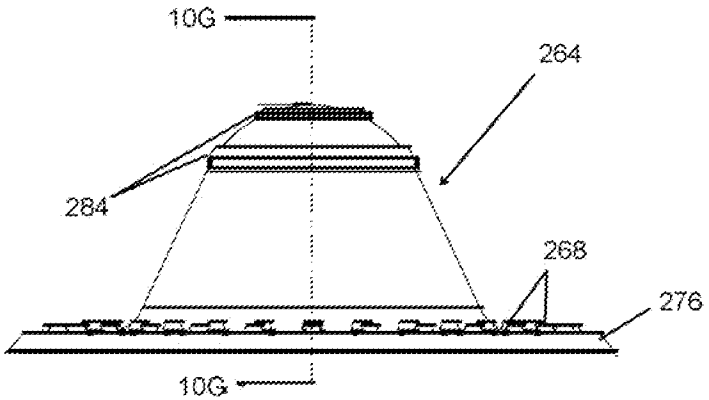
FIG. 10F is a side view of a nozzle portion shown in FIG. 9F.
Figure 10H:
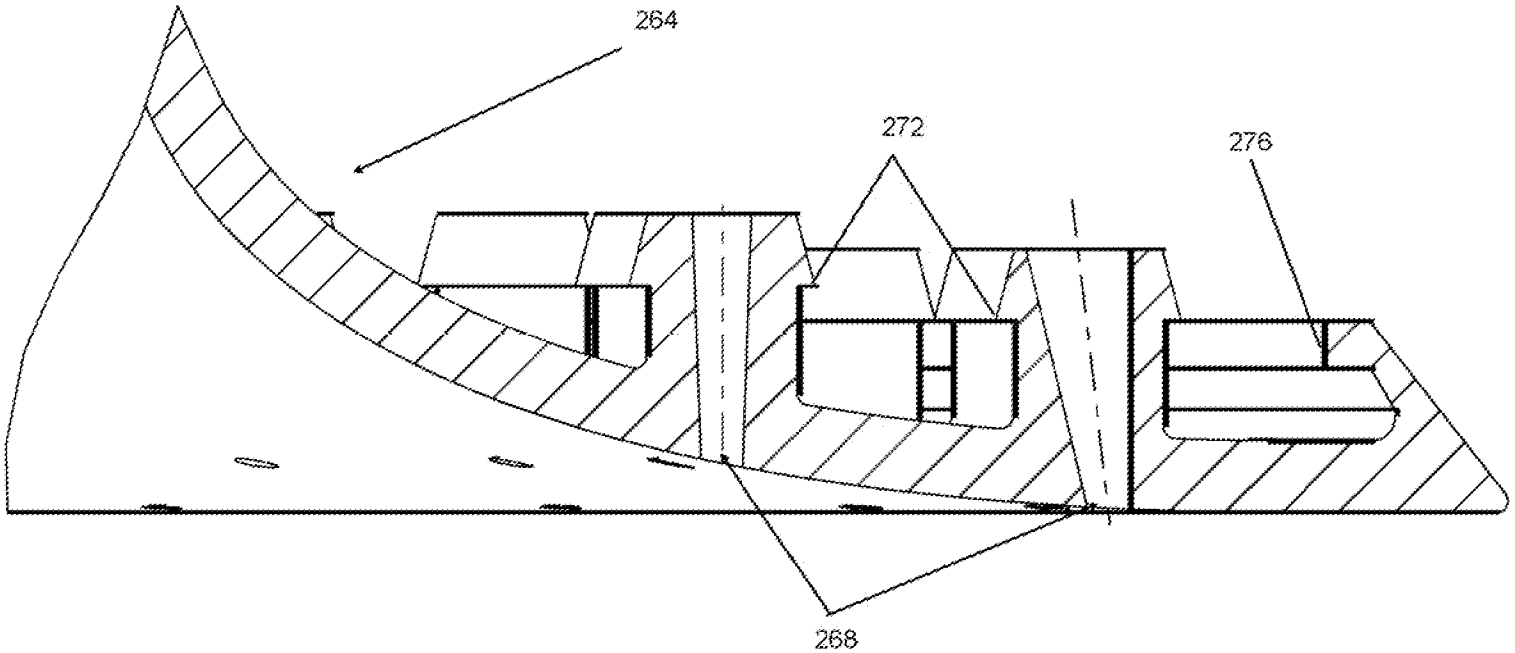
FIG. 10H is an enlarged portion of the nozzle portion shown in FIG. 10G.

As shown in FIGS. 9D-9E, a magnet 206F is supported on the showerhead 22F (e.g., in a recess 292 on the inner waterway member 198F), and the nozzle member 264 covers the magnet 206F. The illustrated magnet 206F is located out of the waterway 46F, enclosed and sealed between the members 198F, 264. The magnet 206F is held in the recess 292, for example, by adhesive (epoxy), press-fit, welding, etc. In other constructions (not shown), the magnet 206F may be supported in another manner (e.g., molded into the inner waterway member 198F or the nozzle member 264) and/or in another location on the showerhead 22F.

Figure 11A:
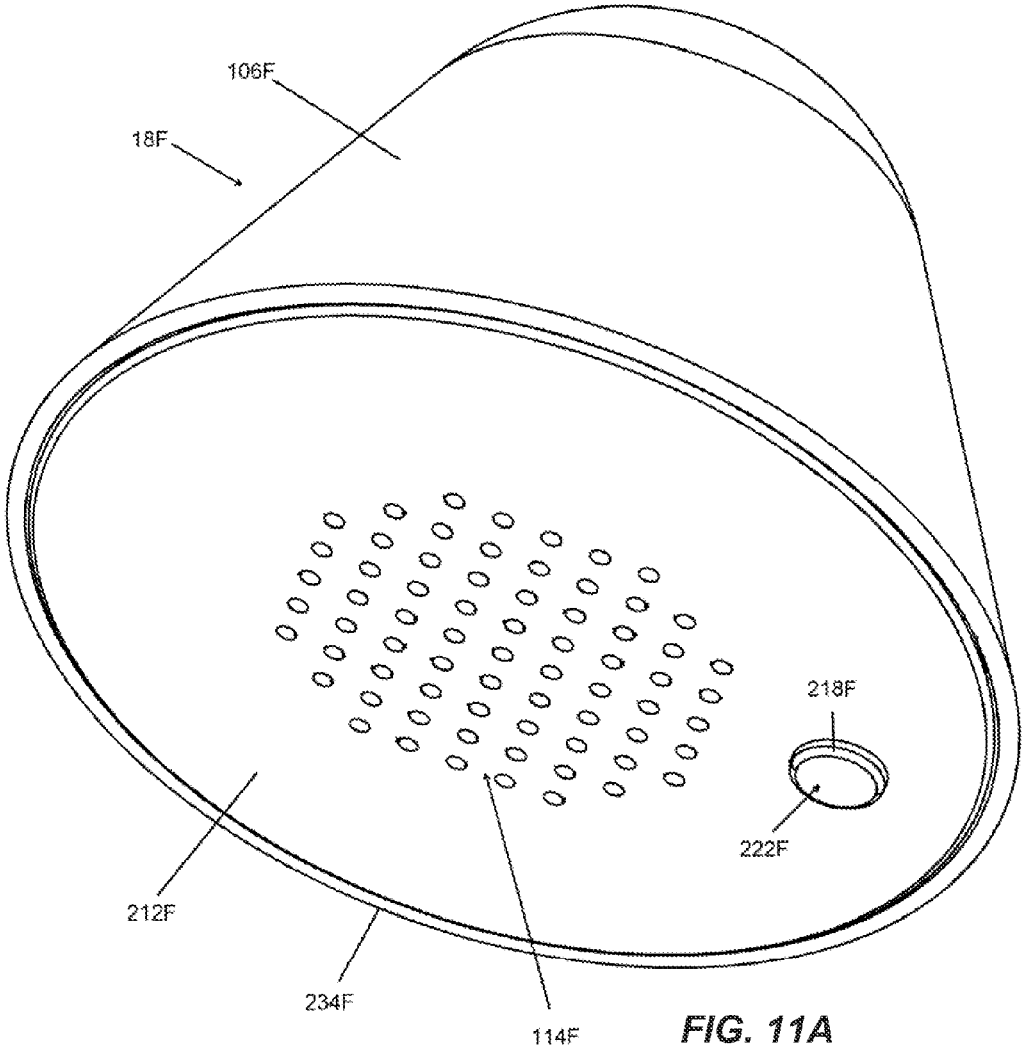
FIG. 11A is a front perspective view of a speaker assembly shown in FIG. 9F.
Figure 11B:
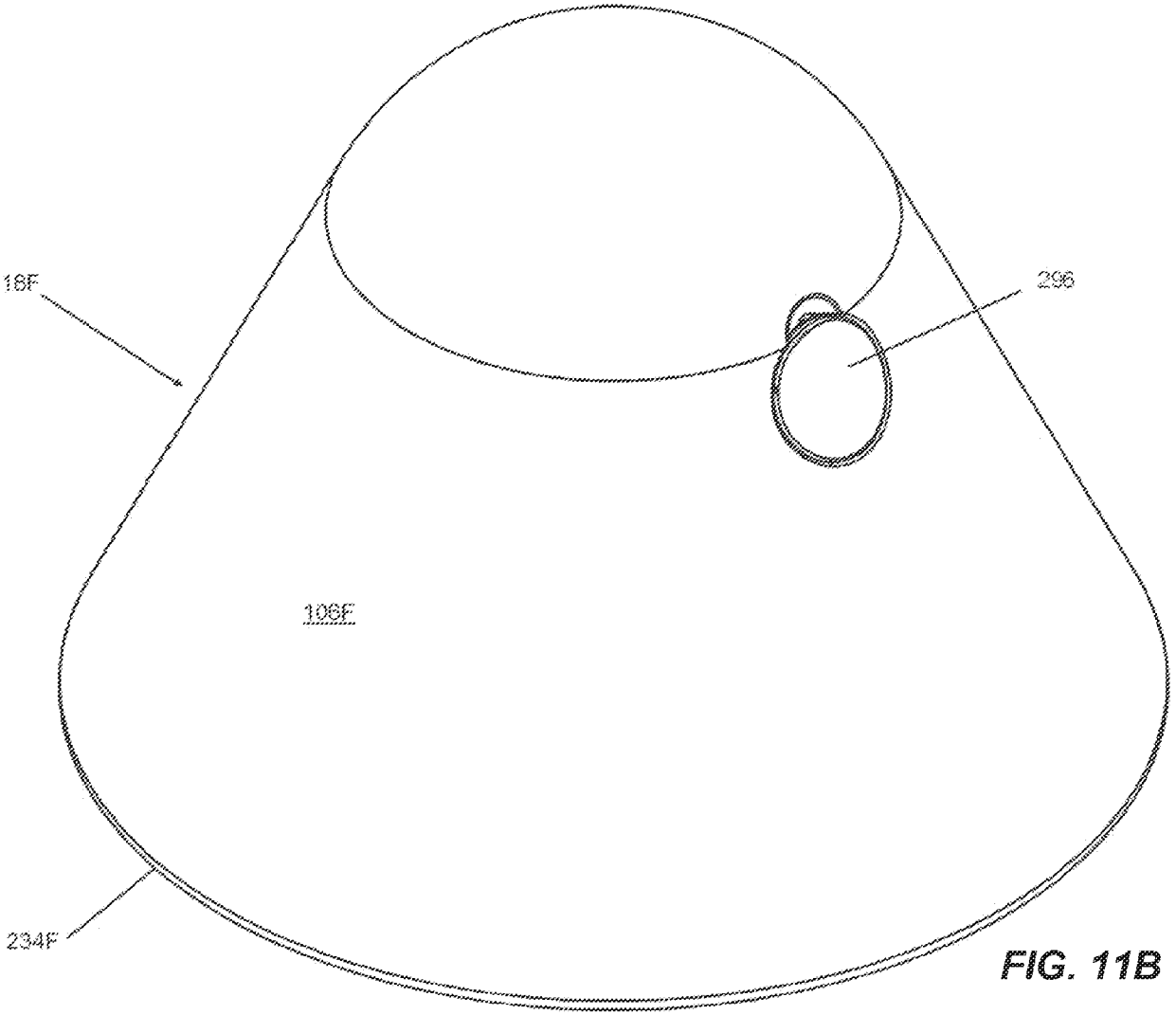
FIG. 11B is a rear perspective view of the assembly shown in FIG. 11A.
Figure 11C:
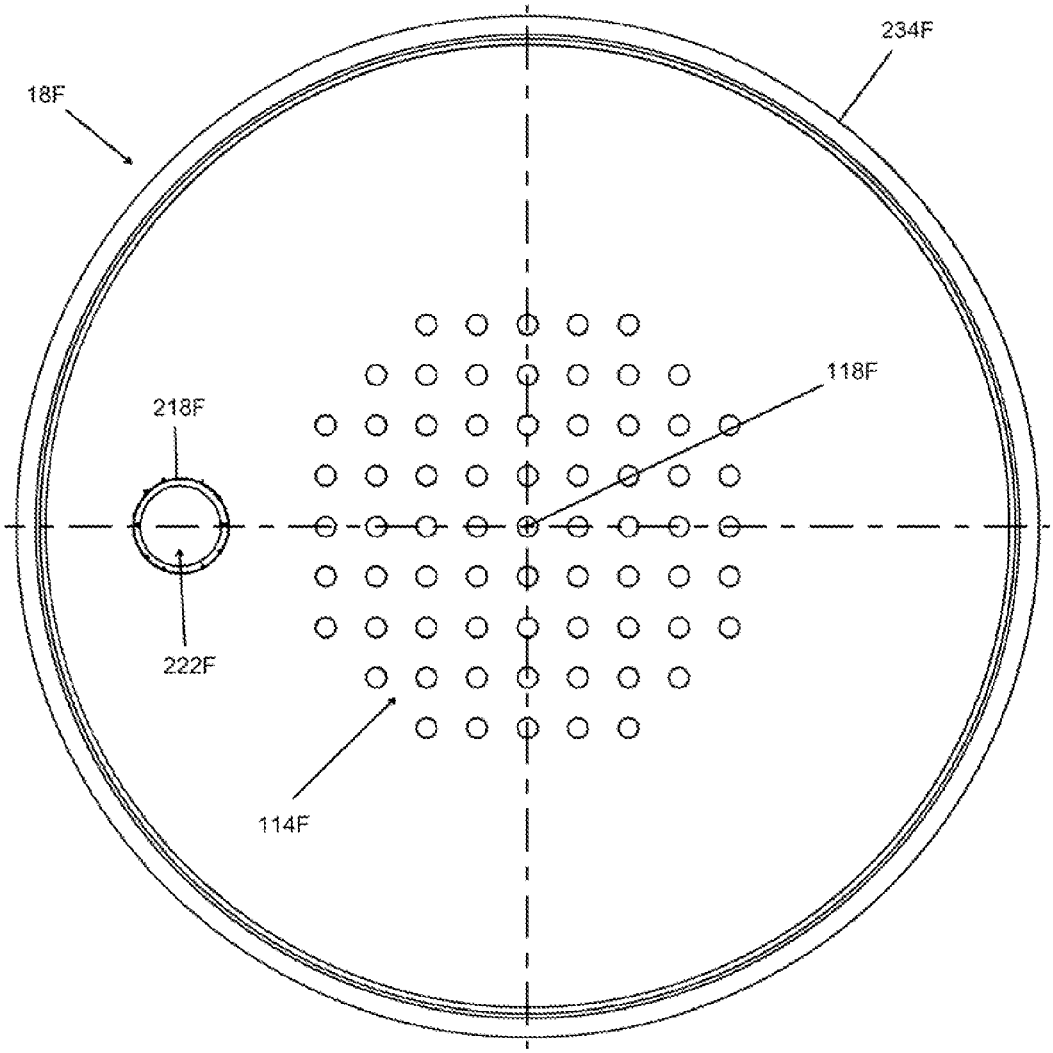
FIG. 11C is a front view of the assembly shown in FIG. 11A.
Figure 11D:
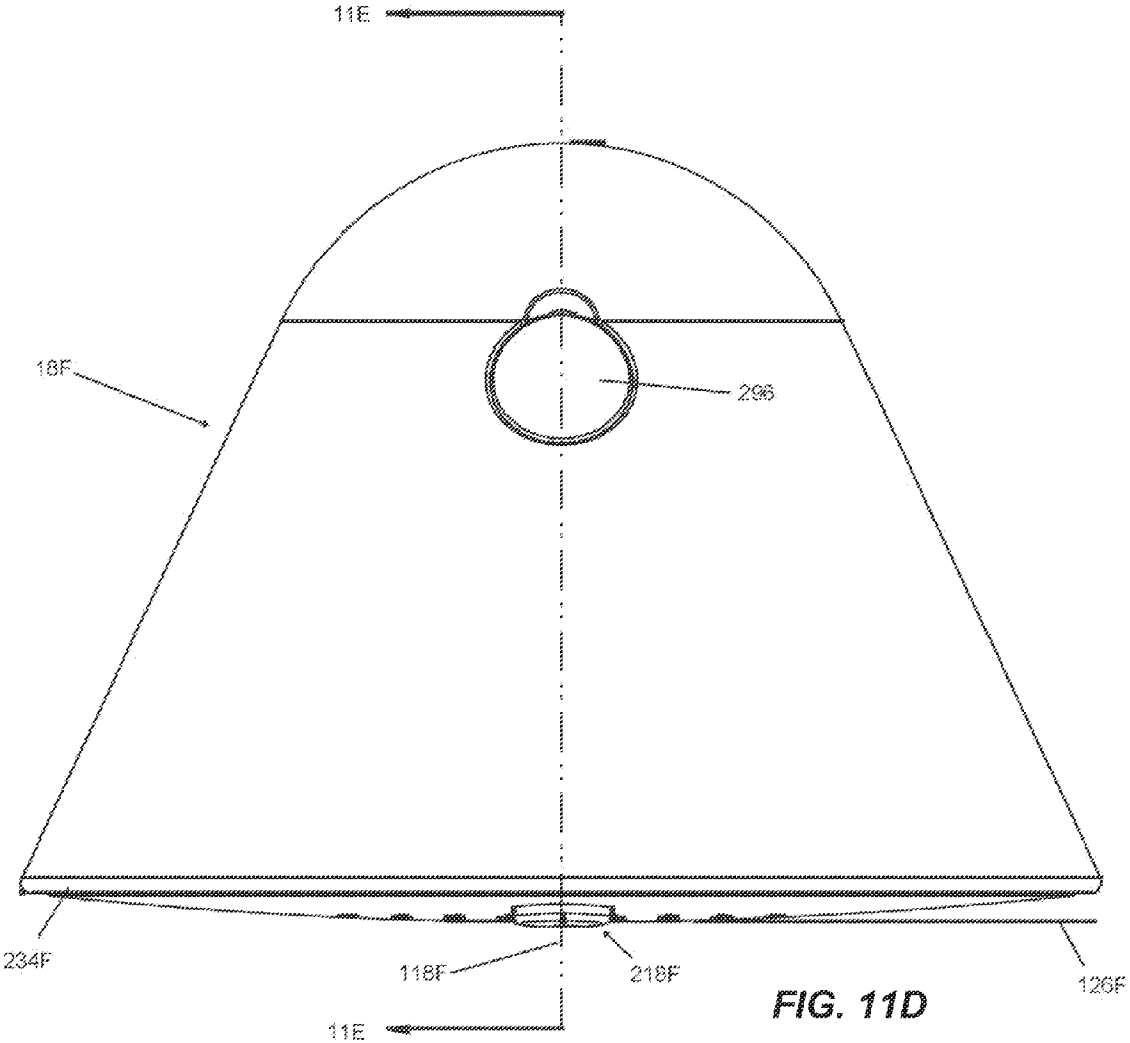
FIG. 11D is a side view of the assembly shown in FIG. 11A.
Figure 11E:
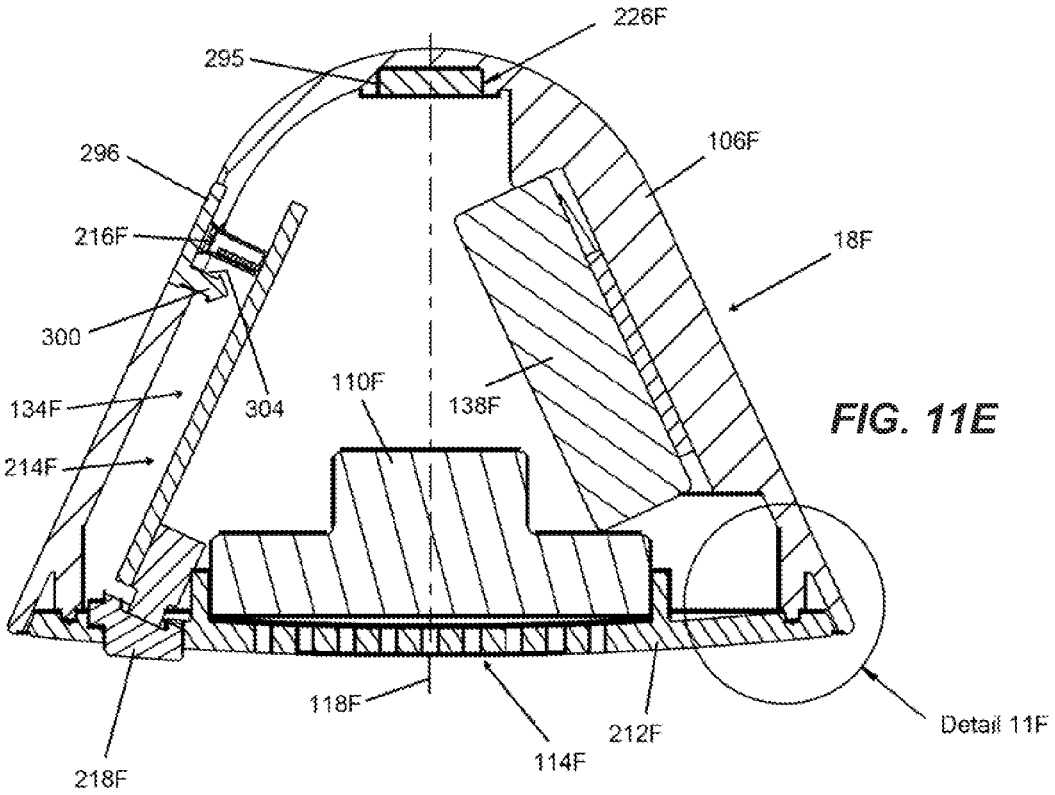
FIG. 11E is a side cross-sectional view of the assembly shown in FIG. 11A, taken generally along line 11E-11E in FIG. 11D.
Figure 11F:
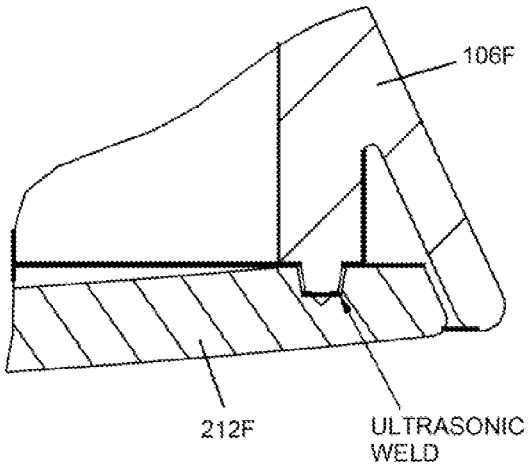
FIG. 11F is an enlarged portion of the assembly shown in FIG. 11E.
Figure 11G:
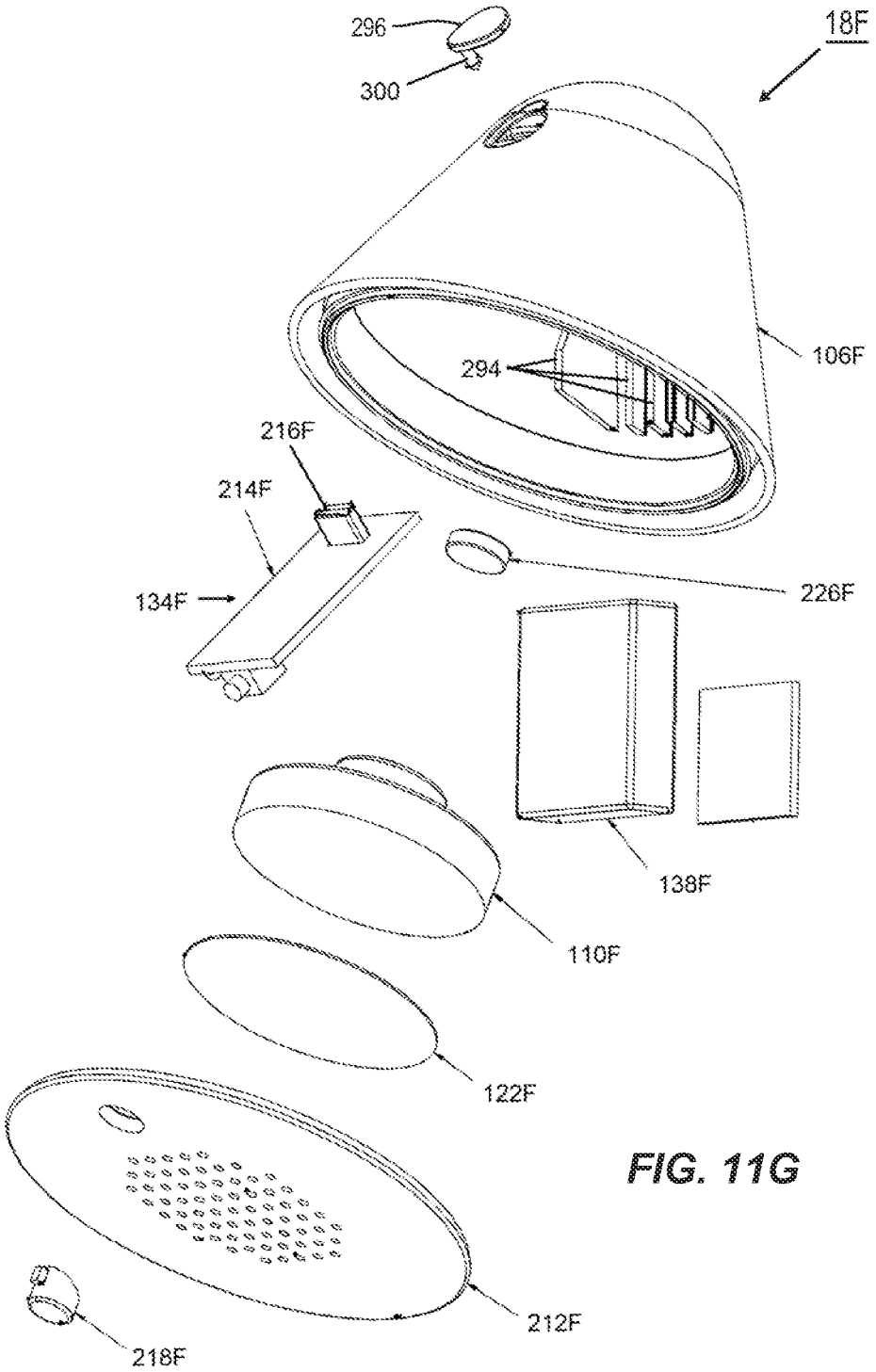
FIG. 11G is an exploded perspective view of the assembly shown in FIG. 11A.
Figure 11H:
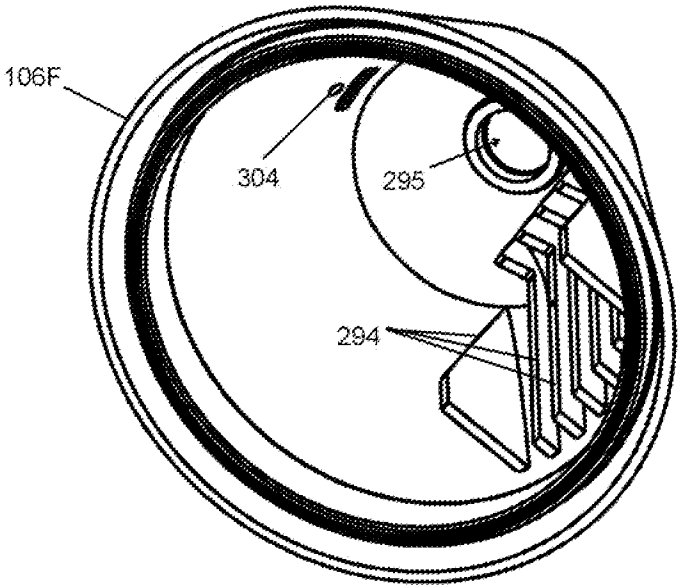
FIG. 11H is a front perspective view of a speaker body shown in FIG. 11A.
Figure 11I:
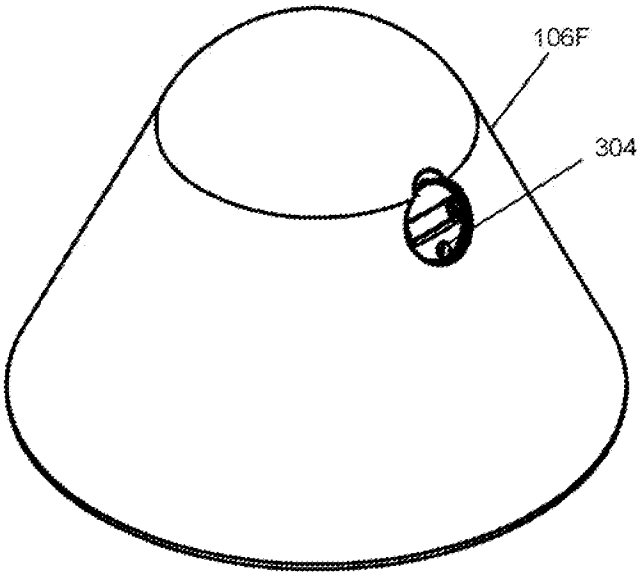
FIG. 11I is a rear perspective view of the speaker body shown in FIG. 11H.

In the illustrated speaker 18F, the housing 106F includes structure (e.g., ridges 294) to support speaker components (e.g., the battery 138F), in this case, in spaced relation from the wall of the housing 106F. As shown in FIGS. 11E and 11G, a magnet 226F is supported and connected to the housing 106E, for example, in a recess 295 by adhesive, (epoxy), press-fit, welding, etc.

The speaker 18F includes a cover 296 to close the port 216F. The cover 296 includes (see FIGS. 11E and 11G) a barbed projection 300 which is inserted through an opening 304 (see FIGS. 11E and 11H-11I) in the housing 106F. In the closed position (see FIGS. 11B and 11D-11E), the cover 296 engages the housing 106F to provide a water-resistant or water-tight seal. The cover 296 is moved (e.g., pivoted about the projection 300, flexed, etc.) to uncover the port 216F. The cover 296 may be biased toward the closed position so that, when the port 216F is not in use, the cover 296 closes the port 216F.

The waterway assembly 190F (members 194, 198, 264) include cooperating recesses to provide the receptacle 94F. In the assembly 10F, the speaker 18F is inserted into and removed from the receptacle 94F through the front of the showerhead 22F. As shown in FIGS. 9C-9D, the speaker 18F projects from the showerhead 22F so that the speaker plane 126F is positioned forwardly of the face plane 90F.

As shown in FIGS. 9C-9E, the illustrated showerhead housing 30F is generally conical. As shown in FIGS. 9E, 11A-11B and 11D-11F, the illustrated speaker 18F is also generally conical. The receptacle 94F has a shape which is complementary to the shape of the speaker 18F (e.g., a generally conical receptacle 94F is shown in FIG. 9D).

The illustrated connecting structure 130F provides a magnetic docking arrangement. In the illustrated construction, the showerhead 22F and the speaker 18F include cooperating magnets 206F, 226F to releasably retain the speaker 18F on the showerhead 22F.

The speaker 18F is arranged to provide a grip surface (the rim 234F) so that a user can overcome the force of the connecting structure 130F to remove the speaker 18F from the showerhead 22F. A space 238F is provided between the rim 234F and the face of the waterway assembly 190F to enable user to grasp the speaker housing 106F.

Figure 12A:
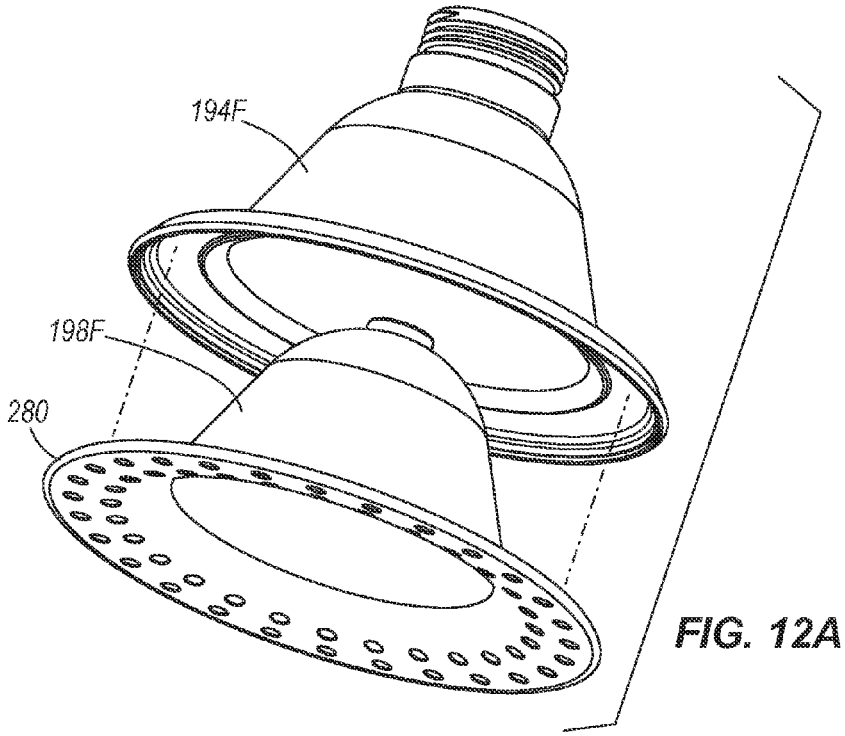
FIGS. 12A-12F illustrate a process for assembling the shower and speaker assembly shown in FIG. 9-11.
Figure 12B:
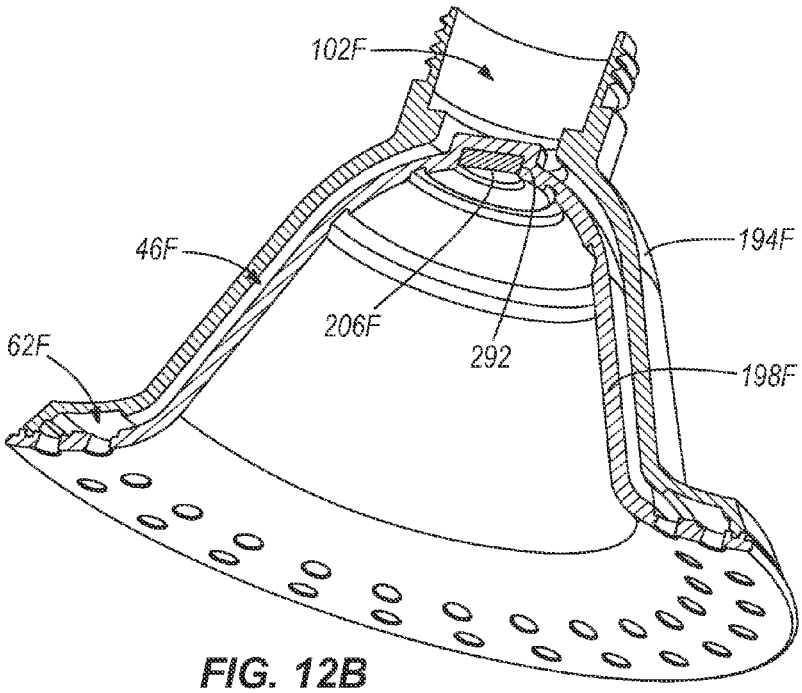
Figure 12C:
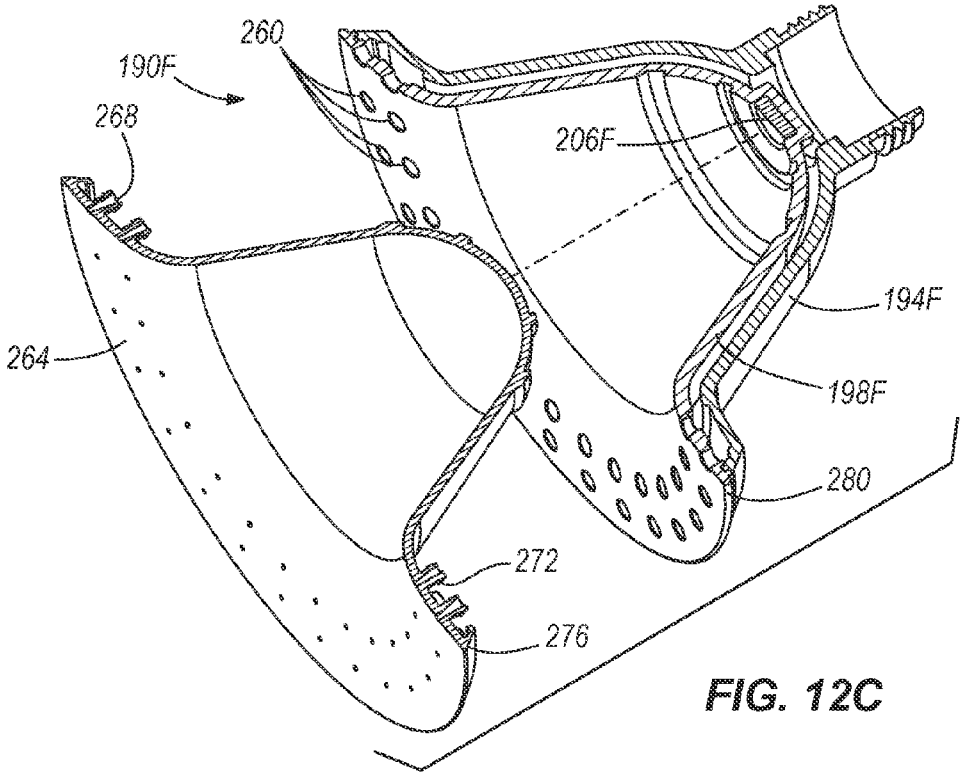
Figure 12D:
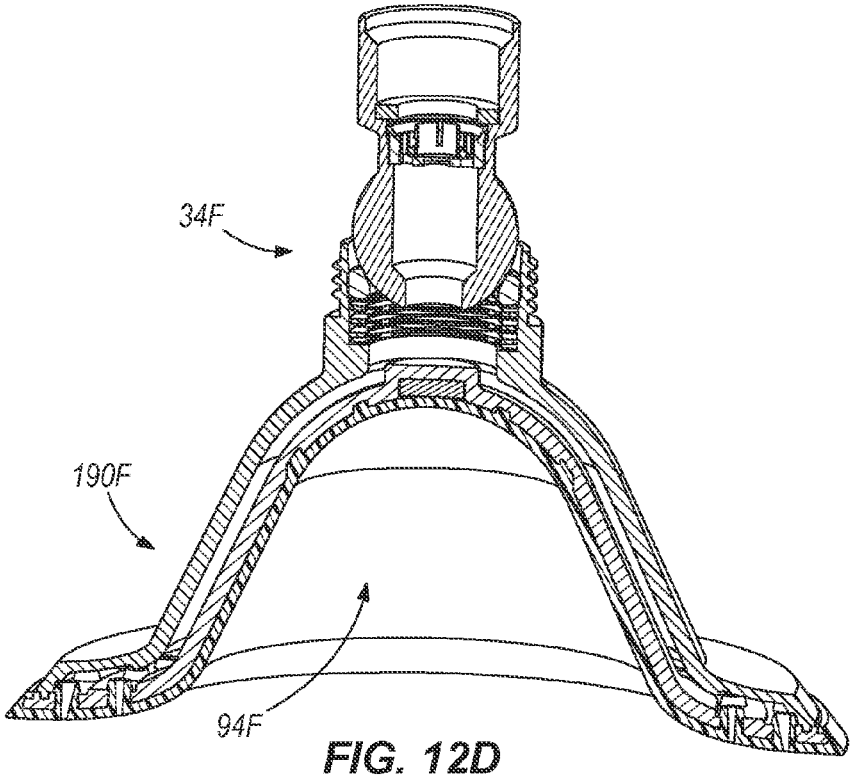
Figure 12E:
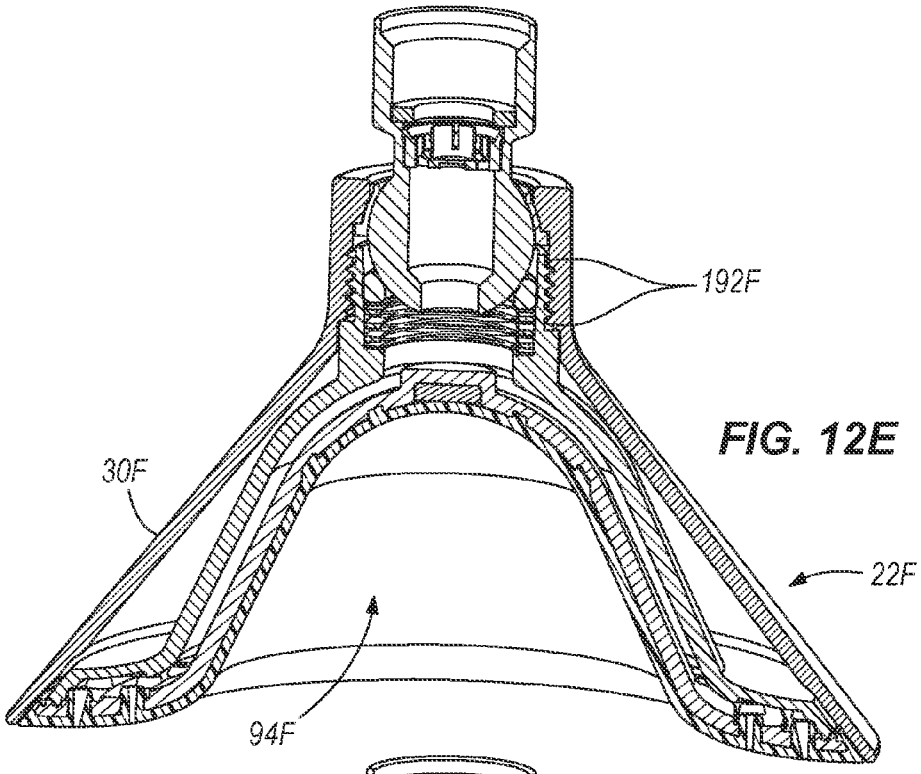

FIGS. 12A-12F illustrate an exemplary process of assembling the shower and speaker assembly 10F. As shown in FIG. 12A, the waterway members 194F, 198F are connected, for example, by welding (ultrasonic), adhesive, etc. The magnet 206F (see FIG. 12B) is positioned in the recess 292 and connected to the inner waterway member 198F, for example, by adhesive (epoxy), press-fit, welding, etc. The nozzle member 264 is assembled to the inner waterway member 198F (see FIG. 12C), with each nozzle 268 being inserted into an associated opening 260, the barbs 272 engaging the inner waterway member 198F and the edge 276 being wrapped around the edge 280 of the inner waterway member 198F.

Figure 12F:
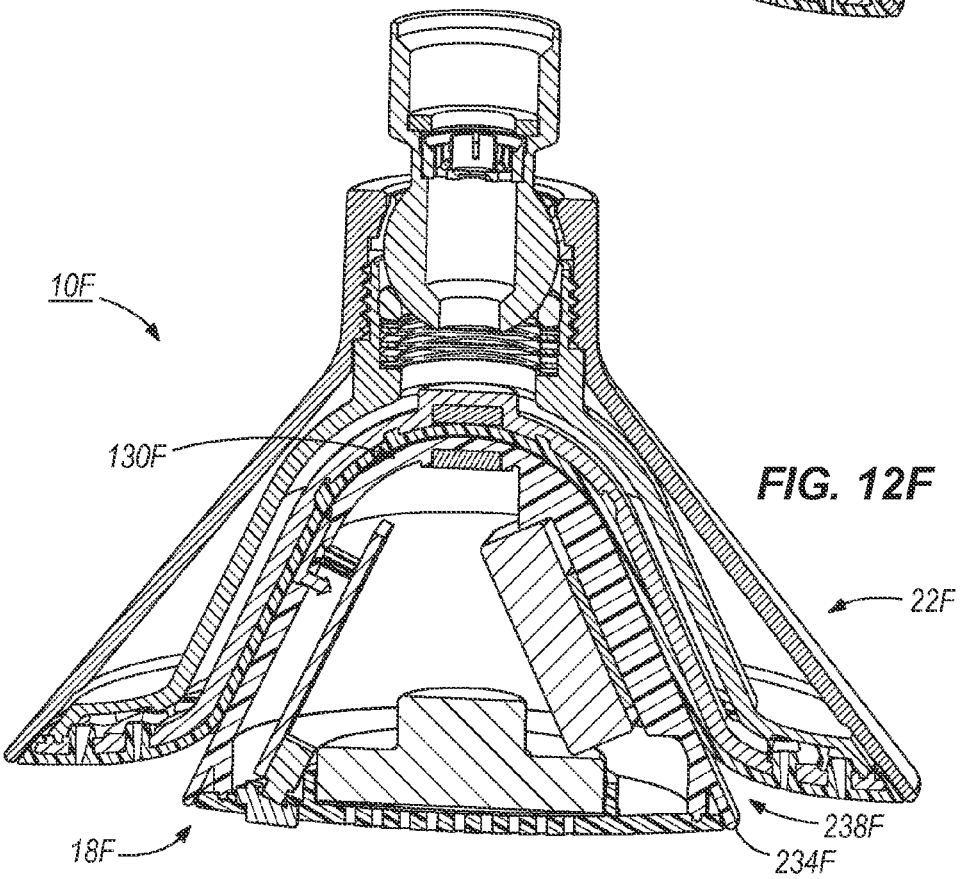
Figure 13A:
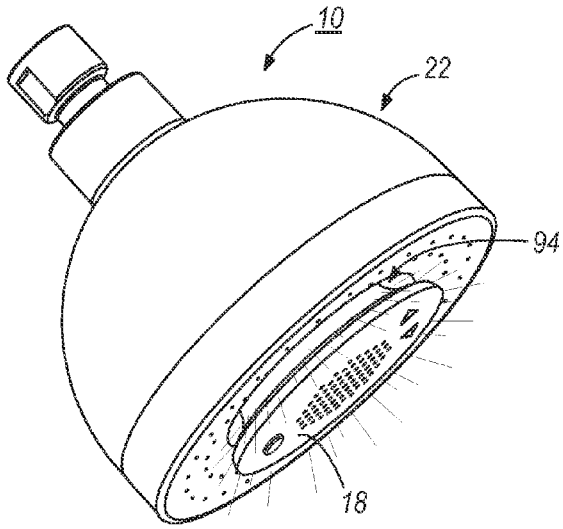
FIG. 13A is a perspective view of yet another alternative construction of a shower and speaker assembly.
Figure 13B:
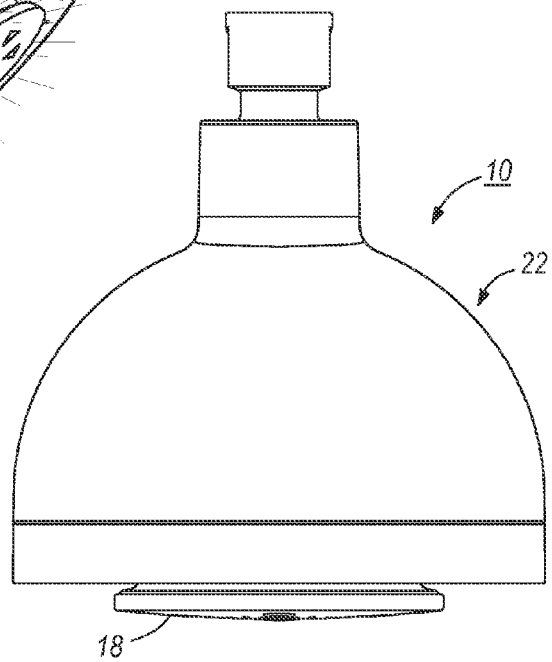
FIG. 13B is a side view of the shower and speaker assembly shown in FIG. 13A.
Figure 13C:
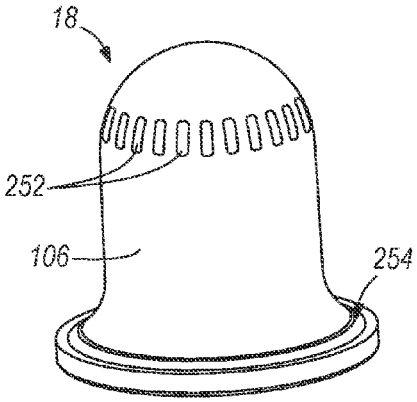
FIG. 13C is a perspective view of the speaker shown in FIG. 13A removed from the shower device.
Figure 13D:
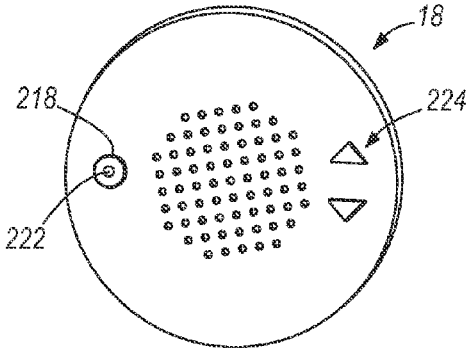
FIG. 13D is a front view of the speaker shown in FIG. 13C.
Figure 14A:
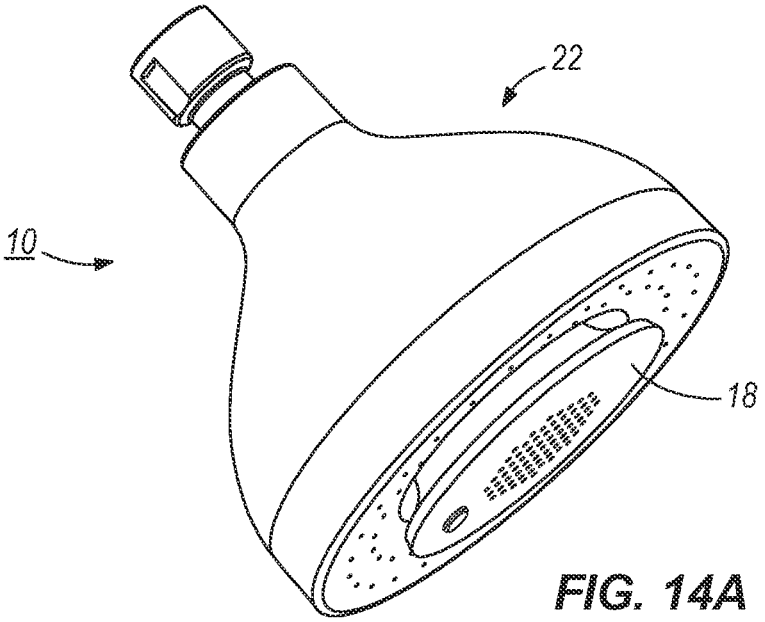
FIG. 14A is a perspective view of another alternative construction of a shower and speaker assembly.
Figure 14B:
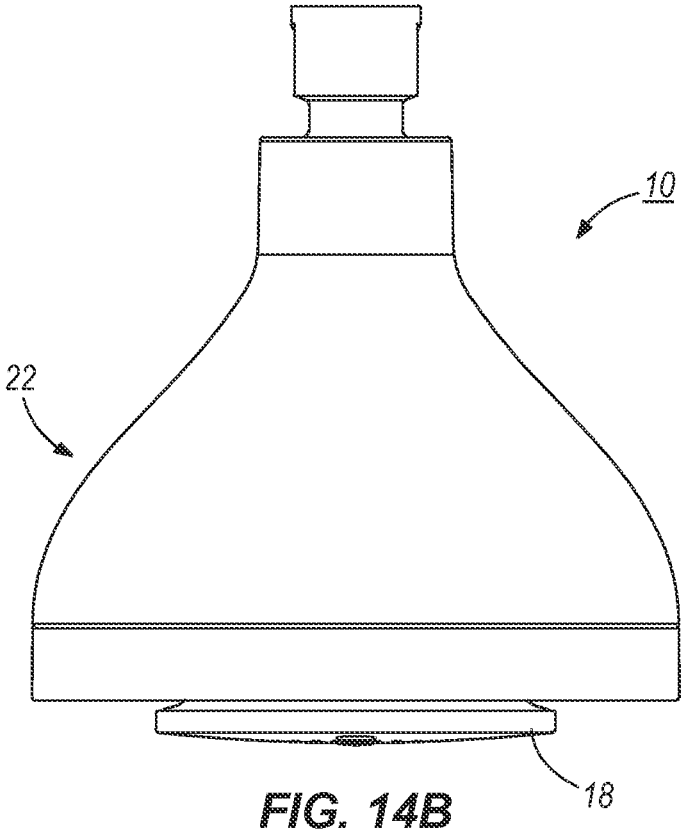
FIG. 14B is a side view of the shower and speaker assembly shown in FIG. 14A.
Figure 15A:
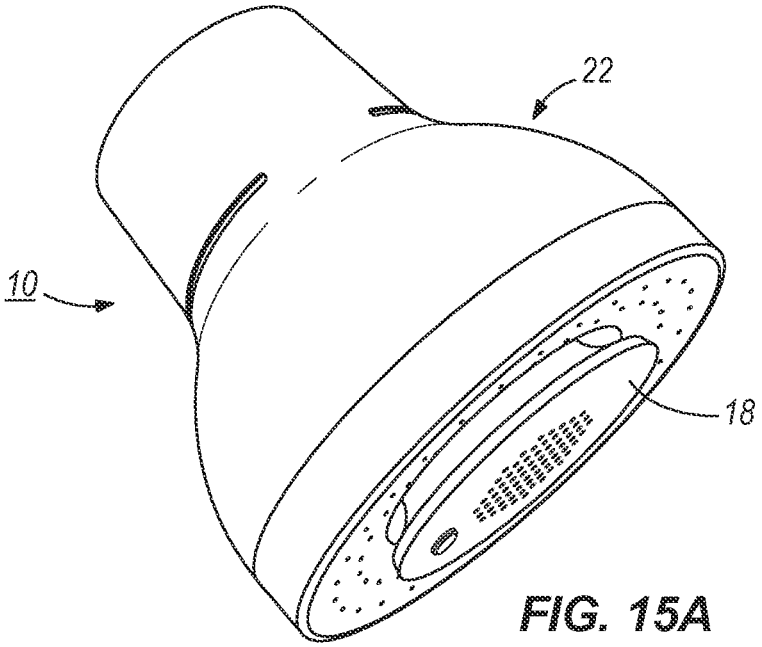
FIG. 15A is a perspective view of another alternative construction of a shower and speaker assembly.
Figure 15B:
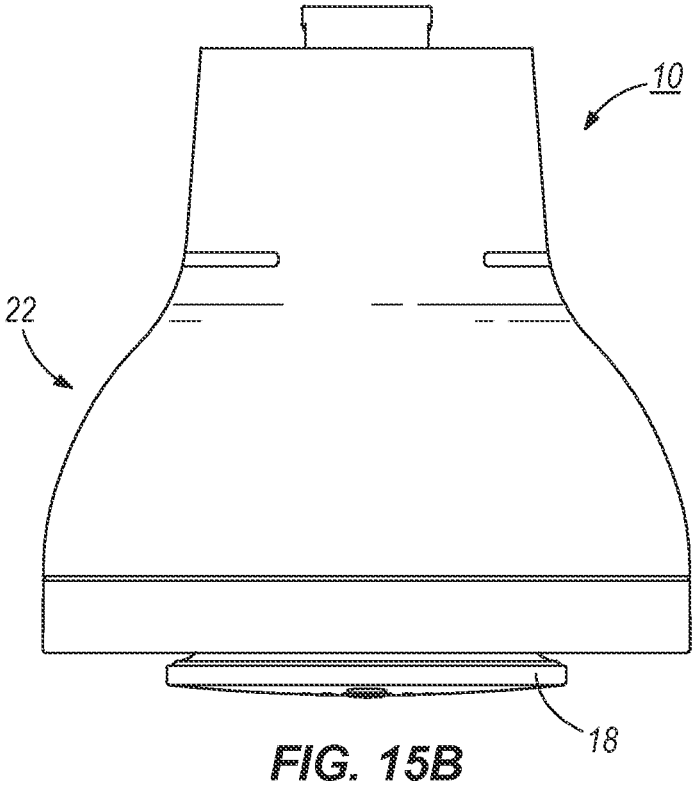
FIG. 15B is a side view of the shower and speaker assembly shown in FIG. 15A.
Figure 16A:
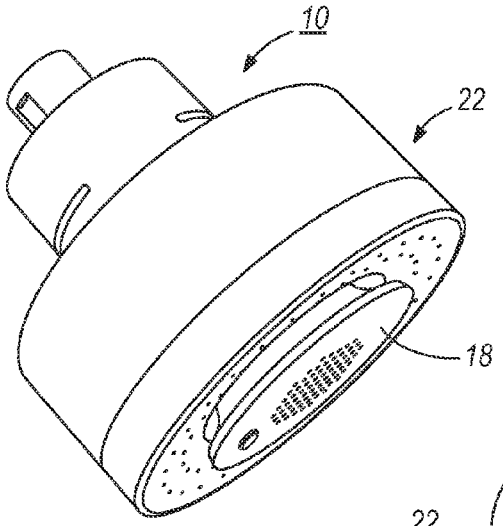
FIG. 16A is a perspective view of another alternative construction of a shower and speaker assembly.
Figure 16B:
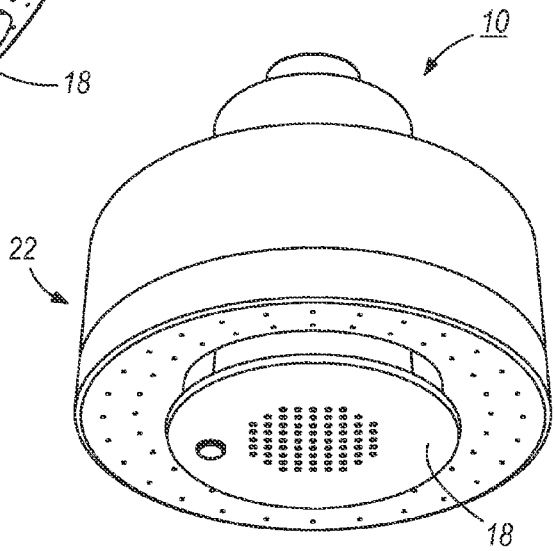
FIG. 16B is a front perspective view of the shower and speaker assembly shown in FIG. 16A.
Figure 16C:
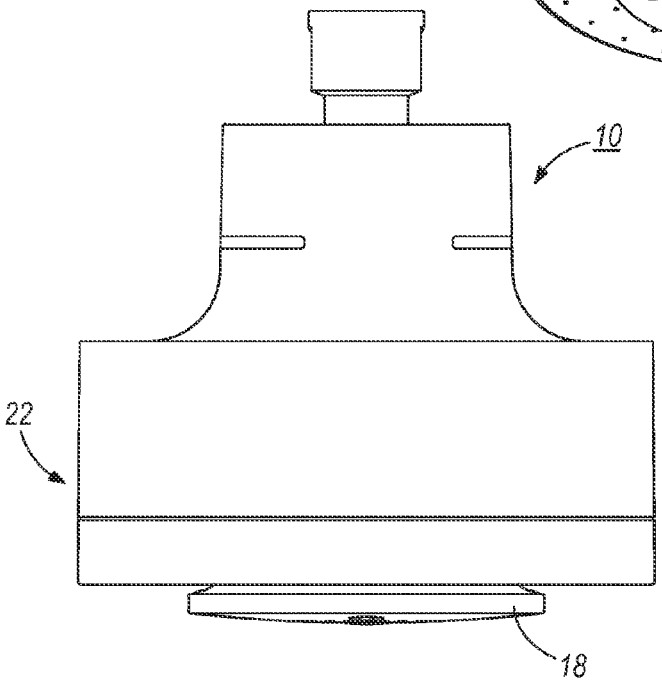
FIG. 16C is a side view of the shower and speaker assembly shown in FIG. 16A.
Figure 17A:
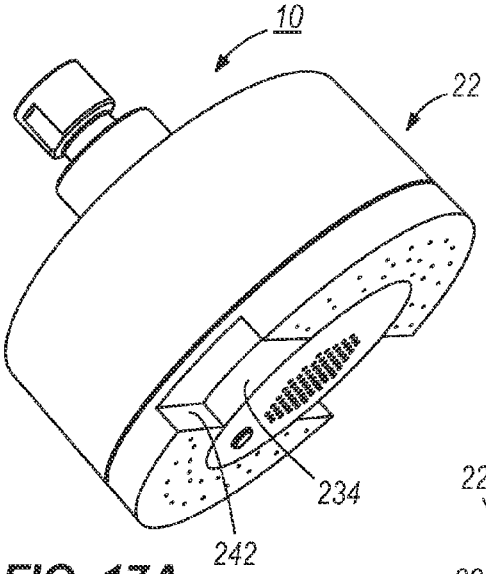
FIG. 17A is a perspective view of another alternative construction of a shower and speaker assembly.
Figure 17B:
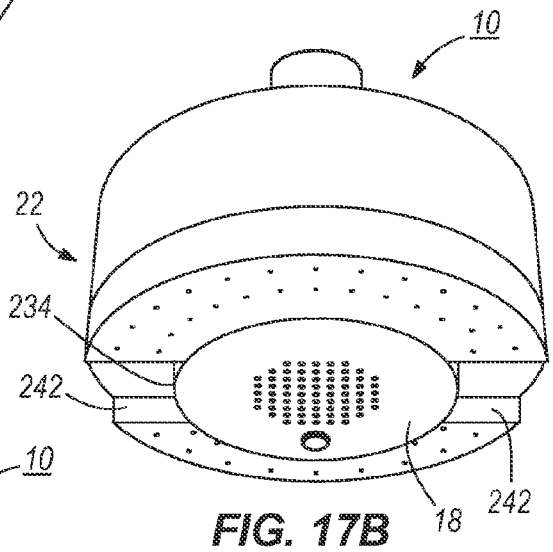
FIG. 17B is a front perspective view of the shower and speaker assembly shown in FIG. 17A.
Figure 17C:
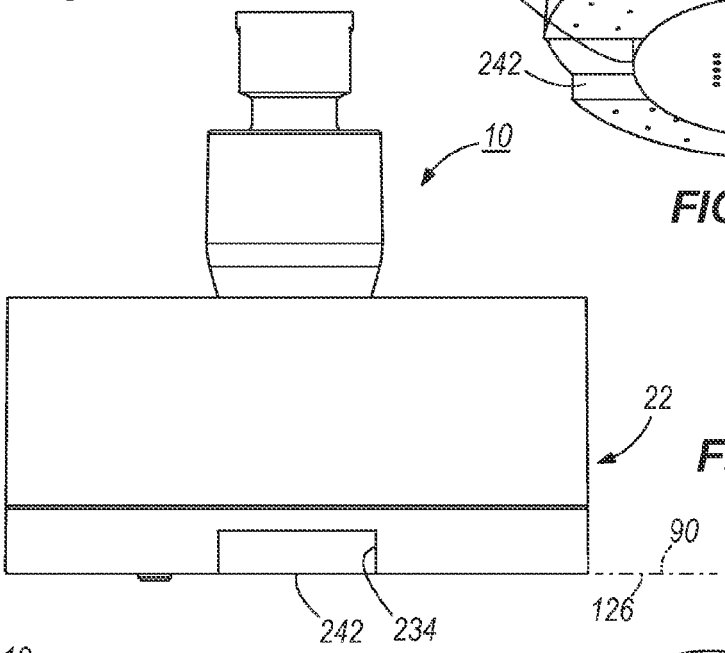
FIG. 17C is a side view of the shower and speaker assembly shown in FIG. 17A.
Figure 17D:
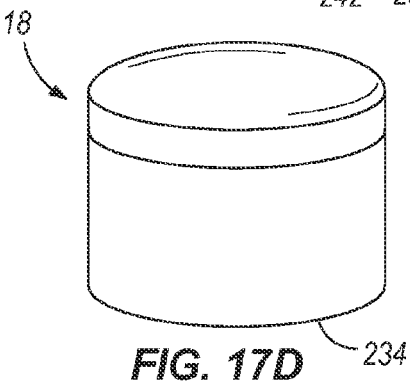
FIG. 17D is a perspective view of the speaker shown in FIG. 17A removed from the shower device.
Figure 17E:
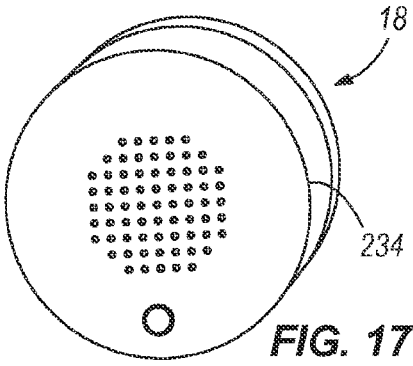
FIG. 17E is a front view of the speaker shown in FIG. 17D.
Figure 18A:
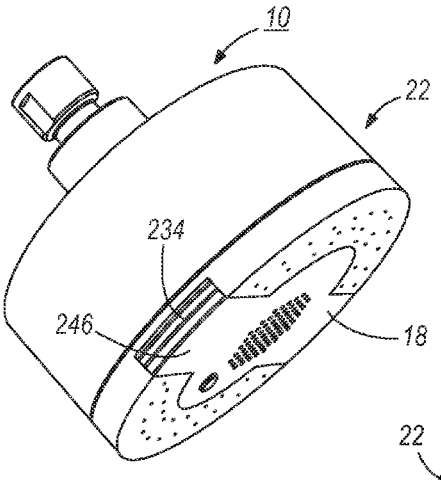
FIG. 18A is a perspective view of another alternative construction of a shower and speaker assembly.
Figure 18B:
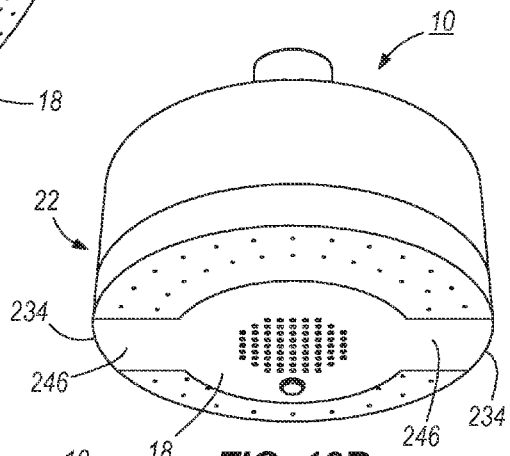
FIG. 18B is a front perspective view of the shower and speaker assembly shown in FIG. 18A.
Figure 18C:
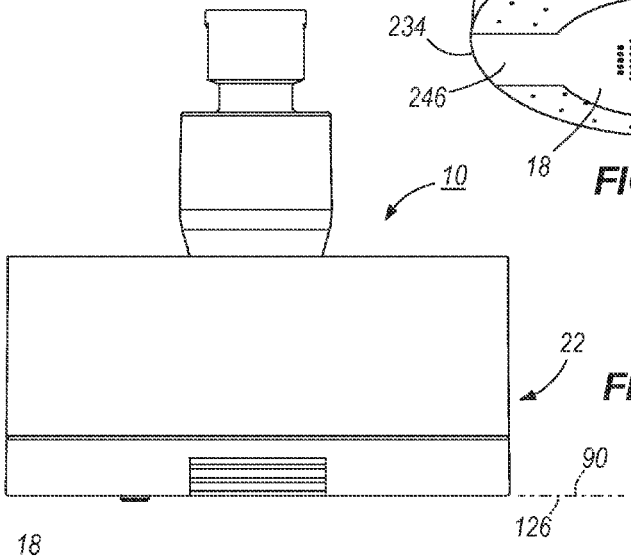
FIG. 18C is a side view of the shower and speaker assembly shown in FIG. 18A.
Figure 18D:
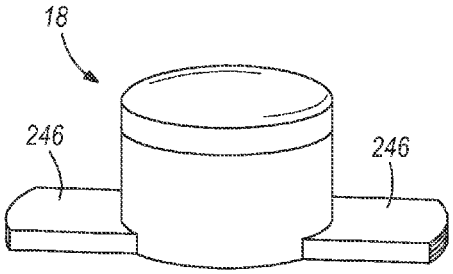
FIG. 18D is a perspective view of the speaker shown in FIG. 18A removed from the shower device.
Figure 18E:
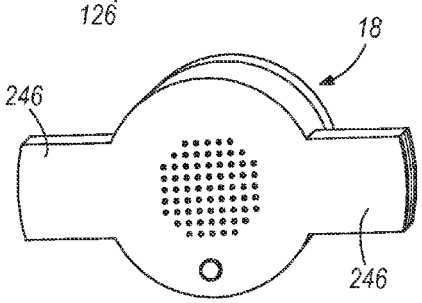
FIG. 18E is a front view of the speaker shown in FIG. 18D.
Figure 19:
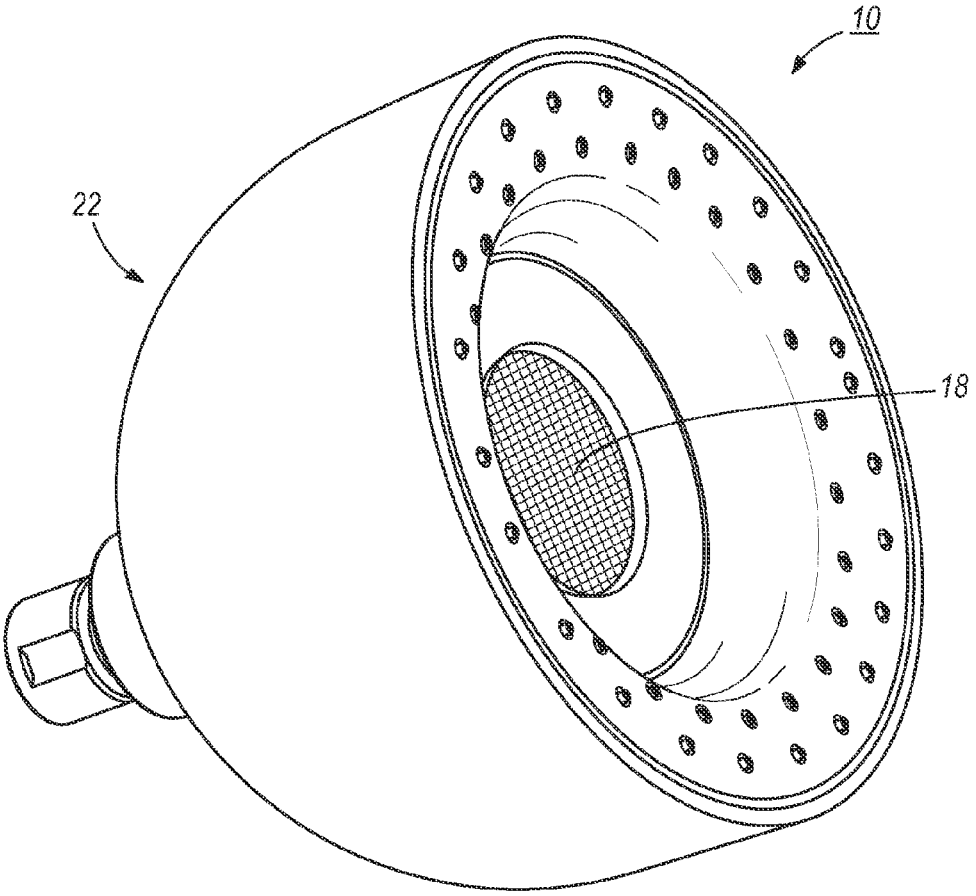
FIG. 19 is a perspective view of yet another alternative construction of a shower and speaker assembly.

The components of the ball joint 34F are connected to the waterway assembly 190F (see FIG. 12D), and the showerhead housing 30F is threaded on (see FIG. 12E), completing assembly of the showerhead 22F. As shown in FIG. 12F, the speaker 18F is inserted into the receptacle 94F and connected to the showerhead 22F by the connecting structure 130F (e.g., the magnets 206F, 226F).

Thus, the invention may generally provide a shower assembly. The shower device may include a waterway which is diverted around the speaker. A second device (e.g., a speaker) may be removable from the shower device. The shower and speaker assembly may be part of a modular system in which the speaker is used with more than one different shower device. The speaker may project from or be aligned with the surface of the face plate of the shower device. The speaker may be recessed from the surface of the face plate of the shower device, and the speaker may output sound through a flared surface of the shower device and into an envelope of water. Various features and advantages of the invention are set forth in the following claims.

What is claimed is:

1. A shower assembly comprising:

a shower device including a device housing defining an inlet and an inlet axis, the inlet communicating with an inlet chamber, an outlet and an outlet axis substantially coaxial with the inlet axis, and a waterway communicating between the inlet chamber and the outlet, the inlet chamber having a radius in a direction transverse to the inlet axis, the outlet being disposed at least partially radially outside of the inlet chamber, the device housing further defining a receptacle having a closed end and an open end, the open end having a larger radius in a direction transverse to the inlet axis than the closed end such that the receptacle generally diverges toward the open end, the inlet chamber being behind the closed end, the waterway extending along the receptacle from the closed end toward the open end, the waterway generally diverging away from the inlet axis from the closed end toward the open end as the waterway extends toward the outlet, the waterway being annular and extending around the receptacle; and a second device supportable in the receptacle.

2. The assembly of claim 1, wherein the shower assembly includes a shower and speaker assembly, and wherein the second device includes a speaker supportable in the receptacle.

3. The assembly of claim 2, wherein the outlet defines an outlet plane, and wherein the speaker includes a speaker housing providing a speaker outlet, the speaker outlet being one of aligned with and positioned forwardly of the outlet plane when the speaker is supported in the receptacle.

4. The assembly of claim 2, wherein the speaker includes a speaker housing providing a speaker outlet and a grip surface formed on an annular rim of the speaker housing, the grip surface facilitating removal of the speaker from the shower device.

5. The assembly of claim 1, and further comprising a magnetic connecting structure operable to releasably connect the second device and the shower device.

6. The assembly of claim 1, wherein the shower device includes a showerhead.

7. The assembly of claim 1, wherein the second device includes a light.

8. A shower and speaker assembly, the assembly comprising:

a shower device including a device housing defining an inlet, an outlet and a waterway communicating between the inlet and the outlet, the outlet defining an outlet plane, the device housing further defining a receptacle;

a speaker supportable in the receptacle, the speaker including a speaker housing providing a speaker outlet and having an at least partially generally conical portion, the speaker outlet being one of aligned with and positioned forwardly of the outlet plane when the speaker is supported in the receptacle; and connecting structure operable to releasably connect the speaker and the shower device, the connecting structure being disposed on the at least partially generally conical portion of the speaker housing;

wherein the device housing also defines an inlet chamber communicating with the inlet, the waterway communicating between the inlet chamber and the outlet; and wherein the waterway is annular and extends around the receptacle.

9. The assembly of claim 8, wherein the connecting structure includes a magnetic connecting structure operable to releasably connect the speaker and the shower device.

10. The assembly of claim 8, wherein the speaker includes a speaker housing providing a speaker outlet and a grip surface formed on an annular rim of the speaker housing, the grip surface facilitating removal of the speaker from the shower device.

11. The assembly of claim 10, wherein the speaker outlet is positioned forwardly of the outlet plane to provide a space to access the grip surface.

12. The assembly of claim 8, wherein the shower device includes a showerhead.

13. A shower and speaker assembly, the assembly comprising:

a shower device including a device housing defining an inlet, an outlet and a waterway communicating between the inlet and the outlet, the device housing further defining a receptacle; and a speaker supportable in the receptacle, the speaker including a speaker housing providing a speaker outlet on one end and a tapered grip surface formed radially of the speaker outlet, the tapered grip surface converging toward an opposite end of the speaker housing, the tapered grip surface facilitating removal of the speaker from the shower device;

wherein the device housing defines an inlet axis, wherein the speaker outlet is positioned forwardly of the outlet plane to provide a space to access the grip surface, wherein the device housing further defines a flare diverging from the receptacle toward the outlet to increase the space to access the grip surface, and wherein the shower device generally defines a plane normal to the inlet axis passing through the tapered grip surface and through the flare.

14. The assembly of claim 13, wherein the tapered grip surface is formed on an annular rim of the speaker housing.

15. The assembly of claim 13, and further comprising a connecting structure operable to releasably connect the speaker and the shower device.

16. The assembly of claim 15, wherein the connecting structure includes a first magnet supported by one of the shower device and the speaker, and a second magnet supported by the other of the shower device and the speaker, the first magnet and the second magnet interacting to releasably connect the speaker and the shower device.

17. The assembly of claim 13, wherein the device housing also defines an inlet chamber communicating with the inlet, the waterway communicating between the inlet chamber and the outlet.

18. The assembly of claim 13, wherein the shower device includes a showerhead.

19. A shower system comprising:

a first shower device including a first device housing defining an inlet, an outlet and a waterway communicating between the inlet and the outlet, the first device housing defining a first receptacle, the first shower device having a first configuration;

a second shower device including a second device housing defining an inlet, an outlet and a waterway communicating between the inlet and the outlet, the second device housing defining a second receptacle, the second shower device having a second configuration different from the first configuration; and a speaker selectively and alternately supportable in the first receptacle and in the second receptacle;

wherein the first device housing further defines a flare diverging from the first receptacle toward the first shower device outlet to provide a space to grip the speaker;

wherein the second device housing further defines a flare diverging from the second receptacle toward the second shower device outlet to provide a space to grip the speaker.

20. The system of claim 19, wherein the configuration includes one of a spray type, a style, and a design.

21. The system of claim 20, wherein the first configuration includes a showerhead, and wherein the second configuration includes one of a rain can, a hand shower, and a wall-mounted water tile.

22. The system of claim 19, wherein the first receptacle and the second receptacle have substantially the same shape.

23. The system of claim 19, and further comprising a connecting structure operable to releasably connect the speaker and at least one of the first shower device and the second shower device.

24. The system of claim 23, wherein the connecting structure includes a magnetic connecting structure operable to releasably connect the speaker and the at least one of the first shower device and the second shower device.

25. The system of claim 19, wherein the first receptacle has a first generally tapered shape, the second receptacle has a second generally tapered shape, and the speaker includes a generally tapered surface generally complementary to the first generally tapered shape and to the second generally tapered shape for being received interchangeably in the first receptacle and in the second receptacle.

* * * * *